US007862341B2

(12) United States Patent
Durand et al.

(10) Patent No.: US 7,862,341 B2
(45) Date of Patent: Jan. 4, 2011

(54) MARKER BOARD

(75) Inventors: James M. Durand, DePere, WI (US); Timothy J. Bouche, Green Bay, WI (US); Lon D. Seidl, Green Bay, WI (US); June M. Klauck, Appleton, WI (US); Steve J. Nemeth, Jr., South Bend, IN (US); Timothy G. Hornberger, Green Bay, WI (US); Greogry R. Wallace, Pembroke (CA); Jason Lind, Avon, CT (US)

(73) Assignee: Krueger International, Inc., Green Bay, WI (US)

( * ) Notice: Subject to any disclaimer, the term of this patent is extended or adjusted under 35 U.S.C. 154(b) by 595 days.

(21) Appl. No.: 11/788,525

(22) Filed: Apr. 20, 2007

(65) Prior Publication Data

US 2008/0040982 A1 Feb. 21, 2008

Related U.S. Application Data

(62) Division of application No. 10/479,683, filed on Jun. 17, 2004, now abandoned.

(51) Int. Cl.
*B43L 1/00* (2006.01)

(52) U.S. Cl. ..... 434/408

(58) Field of Classification Search ..... 434/408, 434/415, 416, 420, 421, 425, 428, 429; 40/748–750, 40/753–755, 617, 747
See application file for complete search history.

(56) References Cited

U.S. PATENT DOCUMENTS

| | | | | |
|---|---|---|---|---|
| 259,216 | A * | 6/1882 | Rood | 248/464 |
| 1,171,343 | A | 2/1916 | Klok | |
| 2,533,983 | A | 12/1950 | Weigle et al. | |
| 3,372,829 | A | 3/1968 | Averill | |
| 3,522,955 | A | 8/1970 | Warner, Jr. | |
| 3,542,446 | A | 11/1970 | Joyce | |
| 3,606,507 | A | 9/1971 | Williams, Jr. | |
| 3,857,619 | A | 12/1974 | Adickes | |
| 4,239,170 | A | 12/1980 | Planebo | |
| 4,584,223 | A * | 4/1986 | Krapf | 428/58 |
| 5,219,216 | A | 6/1993 | Hassel et al. | |
| 5,302,013 | A | 4/1994 | Reiner | |
| 5,437,502 | A | 8/1995 | Warnick et al. | |

(Continued)

FOREIGN PATENT DOCUMENTS

| | | |
|---|---|---|
| DE | 32 05 154 | 7/1983 |

(Continued)

OTHER PUBLICATIONS

Supplemental European Search Report, Appln. No. Ep02778957, dated Aug. 8, 2006.

*Primary Examiner*—Kurt Fernstrom
(74) *Attorney, Agent, or Firm*—Andrus, Sceales, Starke & Sawall, LLP

(57) ABSTRACT

A mobile furniture and accessory system for an office environment includes storage components, table or desk components, screen or partition components, paper management components, marker board components, computer support furniture and the like, for use in facilitating flexibility in manufacturing such components to user specifications and in arranging such components according to user requirements.

13 Claims, 35 Drawing Sheets

U.S. PATENT DOCUMENTS

| | | | | |
|---|---|---|---|---|
| 5,626,478 | A * | 5/1997 | Gatlin | 434/247 |
| 5,638,759 | A | 6/1997 | Klugkist et al. | |
| 5,664,652 | A | 9/1997 | Shamah | |
| 5,738,425 | A | 4/1998 | Rosenberg et al. | |
| 5,740,957 | A * | 4/1998 | Wenkman | 229/92.8 |
| 5,743,414 | A * | 4/1998 | Baudino | 211/69.1 |
| 5,927,837 | A | 7/1999 | Schmidt | |
| 5,975,658 | A | 11/1999 | Verbeek et al. | |
| 5,979,118 | A | 11/1999 | Gortsema et al. | |
| 5,987,825 | A * | 11/1999 | Rosen | 52/36.1 |
| 6,007,891 | A * | 12/1999 | Davis et al. | 428/81 |
| 6,176,559 | B1 | 1/2001 | Tiramani et al. | |
| 6,247,769 | B1 | 6/2001 | Spitzer et al. | |
| 6,460,950 | B2 | 10/2002 | Spitzer et al. | |
| 6,618,974 | B2 * | 9/2003 | Szalay | 40/611.06 |
| 6,736,644 | B1 * | 5/2004 | Vaughn | 434/408 |
| 6,751,899 | B2 * | 6/2004 | Cress et al. | 40/748 |
| 6,802,145 | B2 * | 10/2004 | Sparkowski | 40/617 |
| 6,837,715 | B2 * | 1/2005 | Beno | 434/408 |
| 6,895,704 | B2 * | 5/2005 | Ives et al. | 40/493 |
| 6,945,785 | B2 * | 9/2005 | Sohl et al. | 434/408 |
| 7,568,915 | B1 * | 8/2009 | Lavoie | 434/408 |
| 7,591,385 | B2 * | 9/2009 | Brooks | 211/94.01 |
| 7,604,481 | B2 * | 10/2009 | Owen et al. | 434/408 |
| 2002/0185941 | A1 | 12/2002 | Ferraro et al. | |

FOREIGN PATENT DOCUMENTS

| | | |
|---|---|---|
| DE | 35 28 984 | 2/1987 |
| DE | 198 12 612 | 10/1999 |
| DE | 198 49 815 | 5/2000 |
| EP | 0670125 | 9/1995 |
| EP | 0807723 | 11/1997 |
| EP | 1052751 | 11/2000 |
| JP | 09 224752 A | 1/1998 |
| WO | WO 00/21414 | 4/2000 |
| WO | WO 00/41593 | 7/2000 |

* cited by examiner

FIG. 19
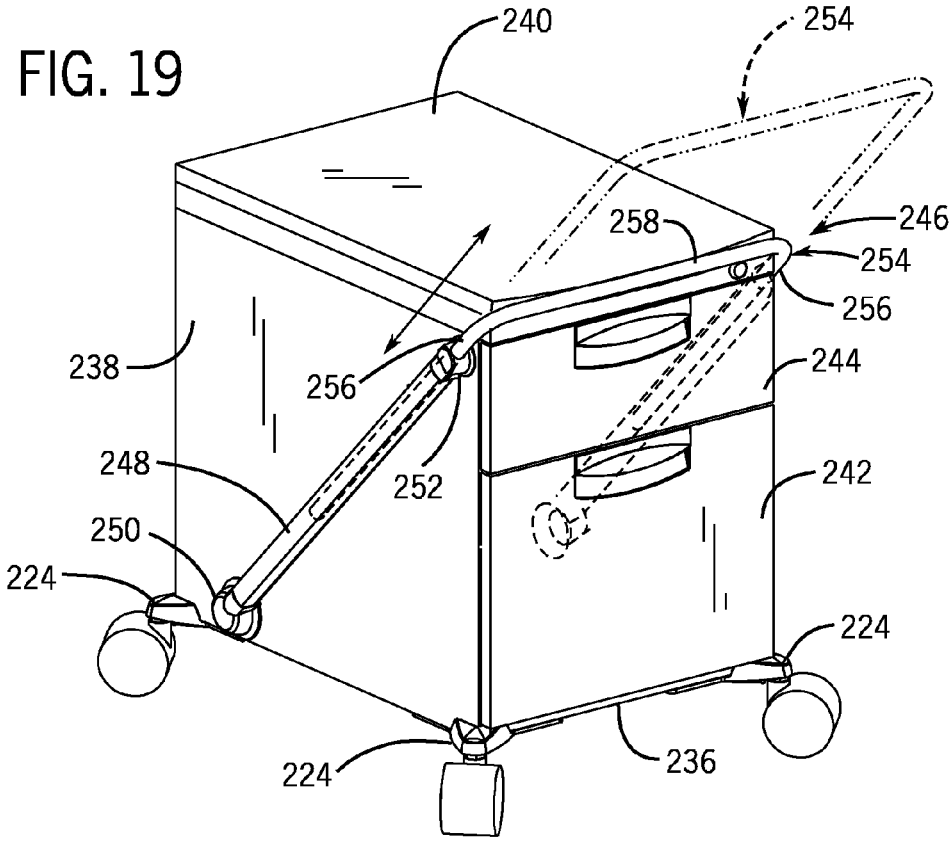
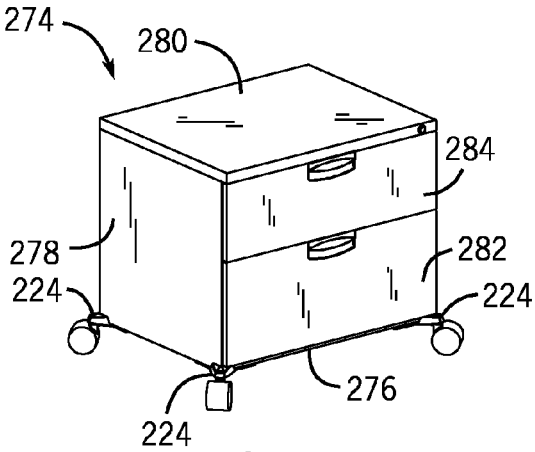
FIG. 23
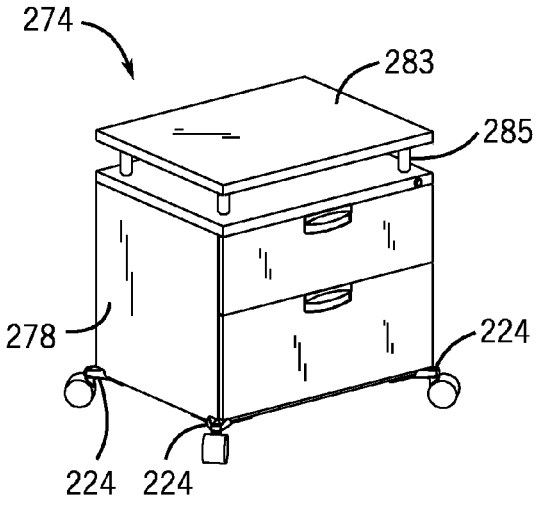
FIG. 24

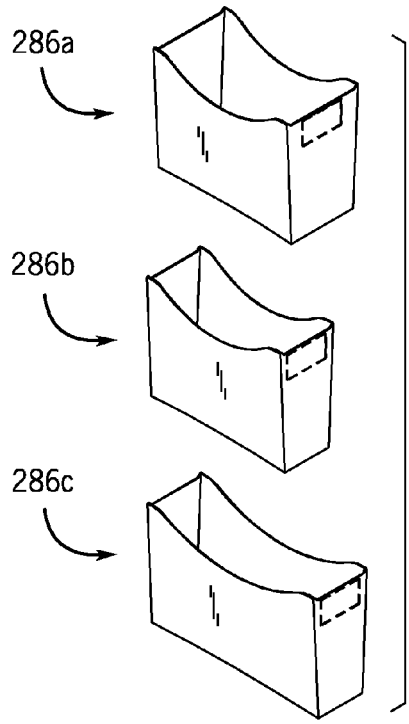
FIG. 25
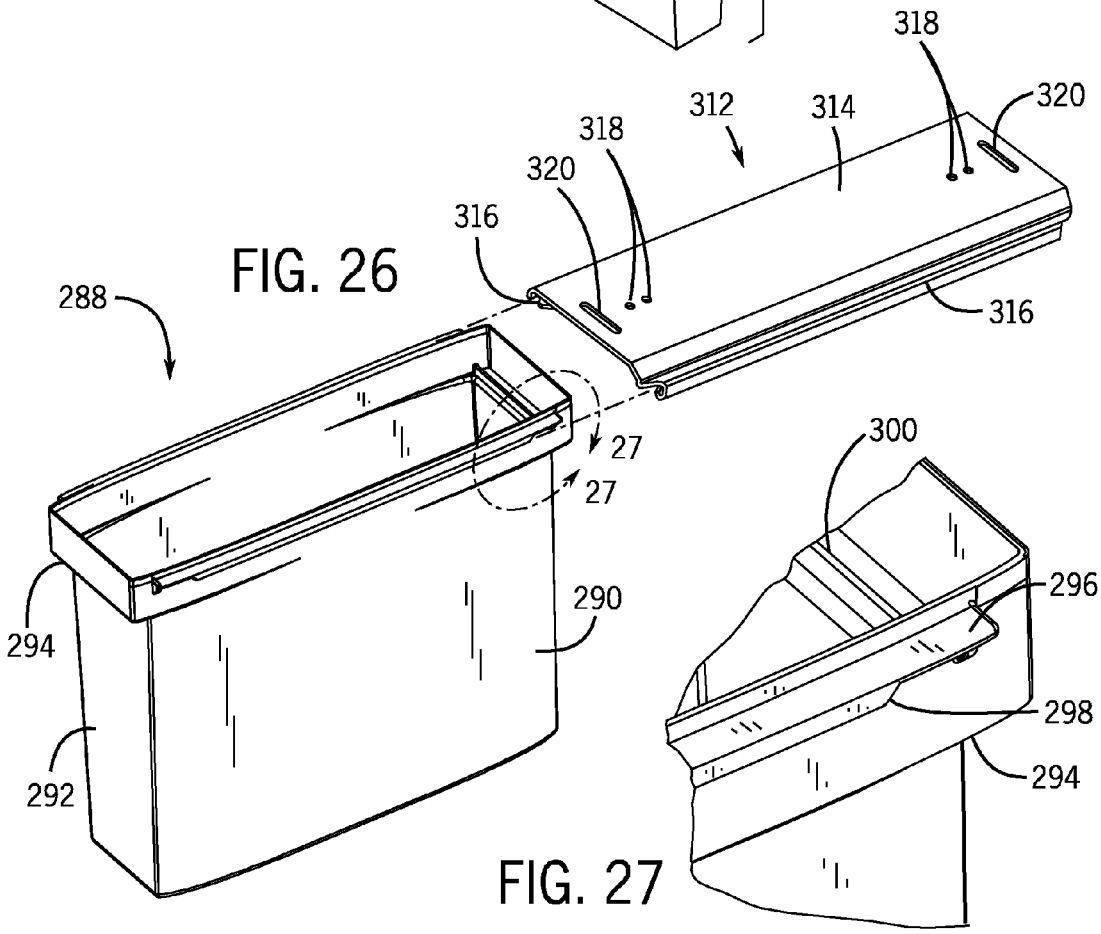
FIG. 26
FIG. 27

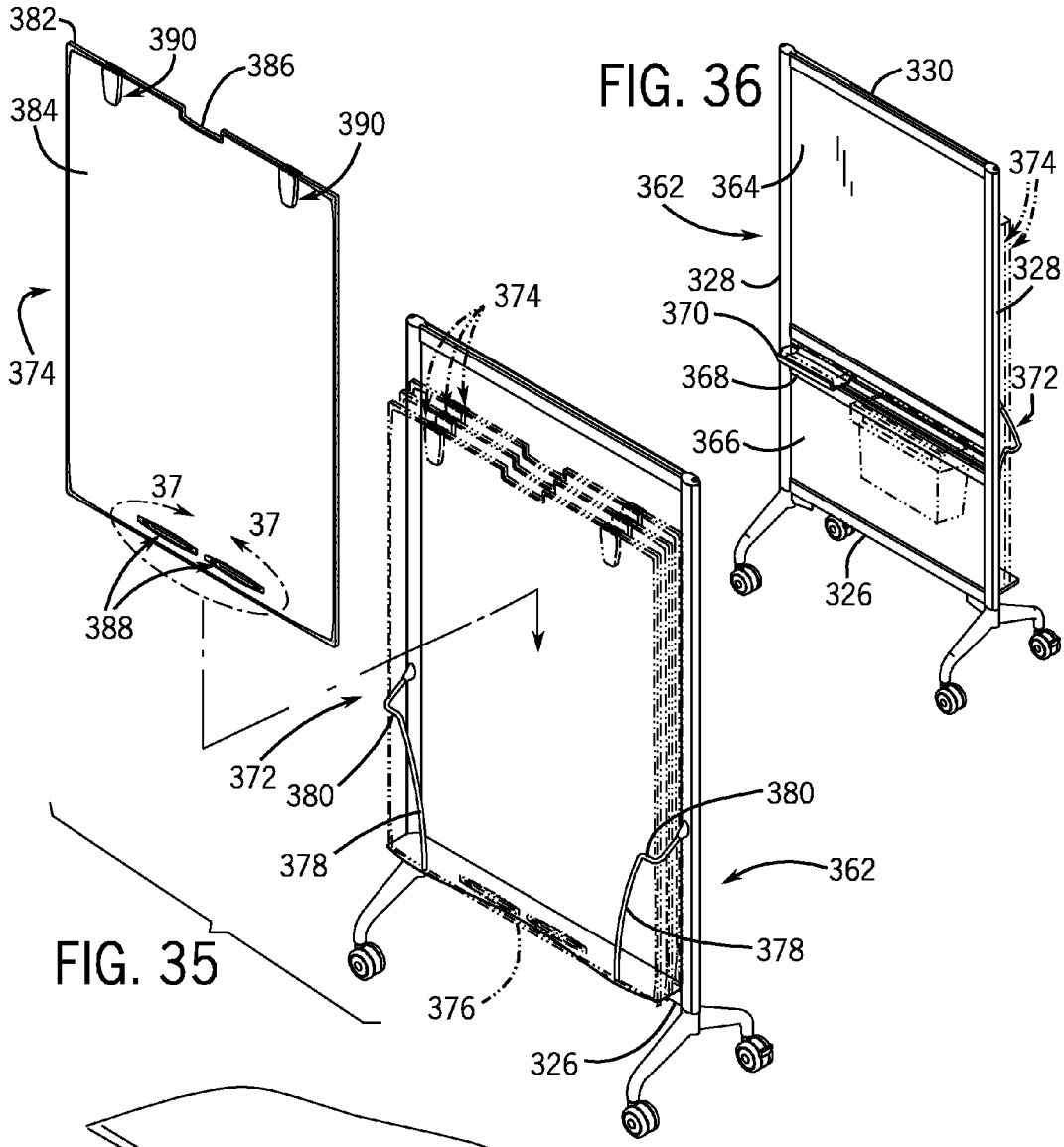
FIG. 36
FIG. 35
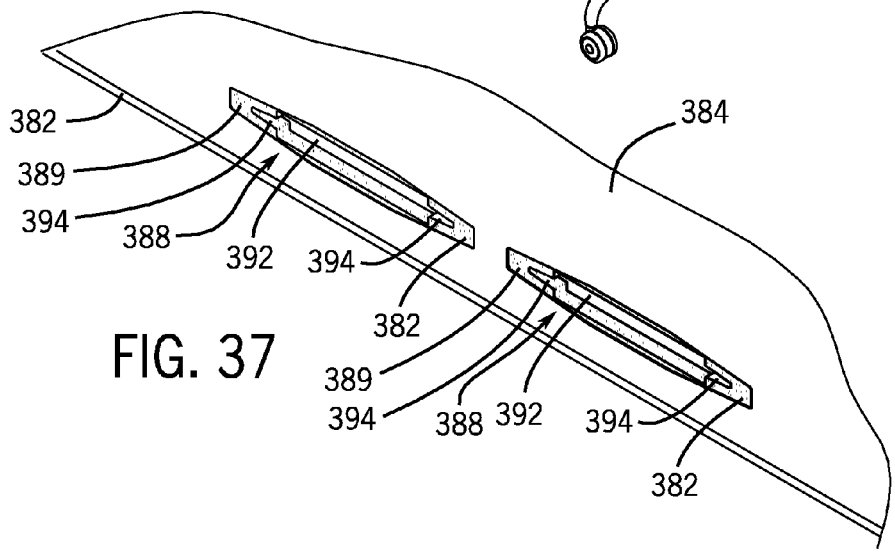
FIG. 37

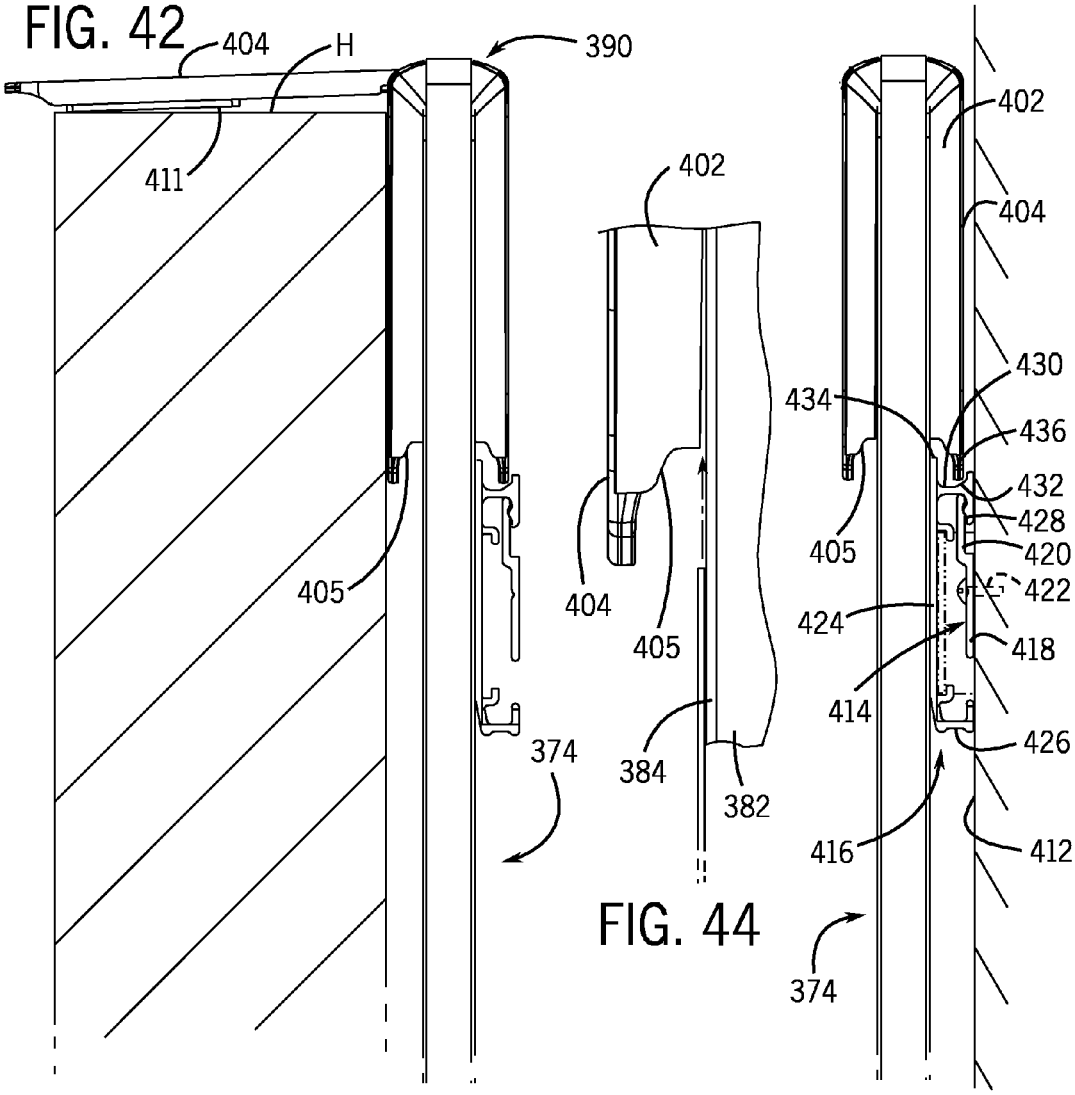
FIG. 42
404
H
390
411
405
374
402
404
405
384
382
FIG. 44
402
404
430
434
436
432
428
420
422
405
424
418
414
426
416
412
374
FIG. 43
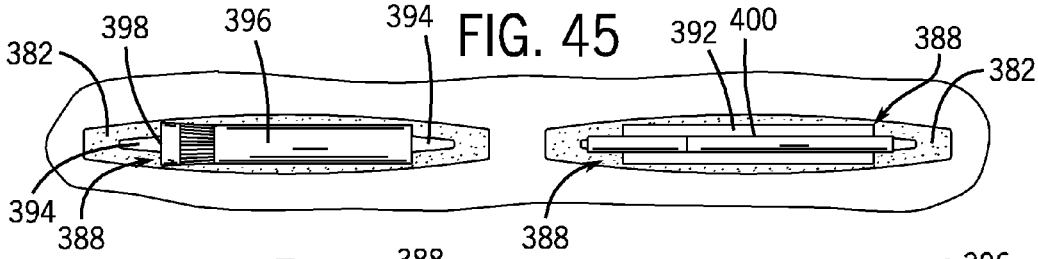
FIG. 45
382
398
396
394
392
400
388
382
394
388
388
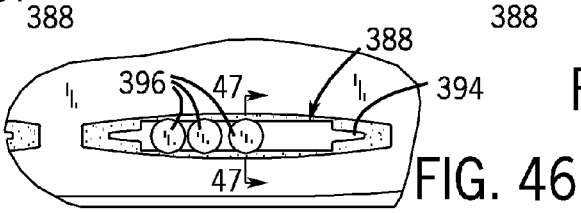
388
396
47
394
47
FIG. 46
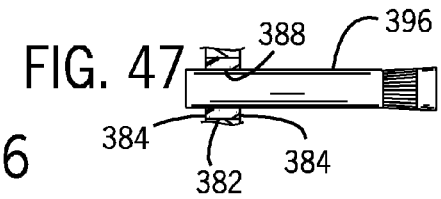
FIG. 47
388
396
384
382
384

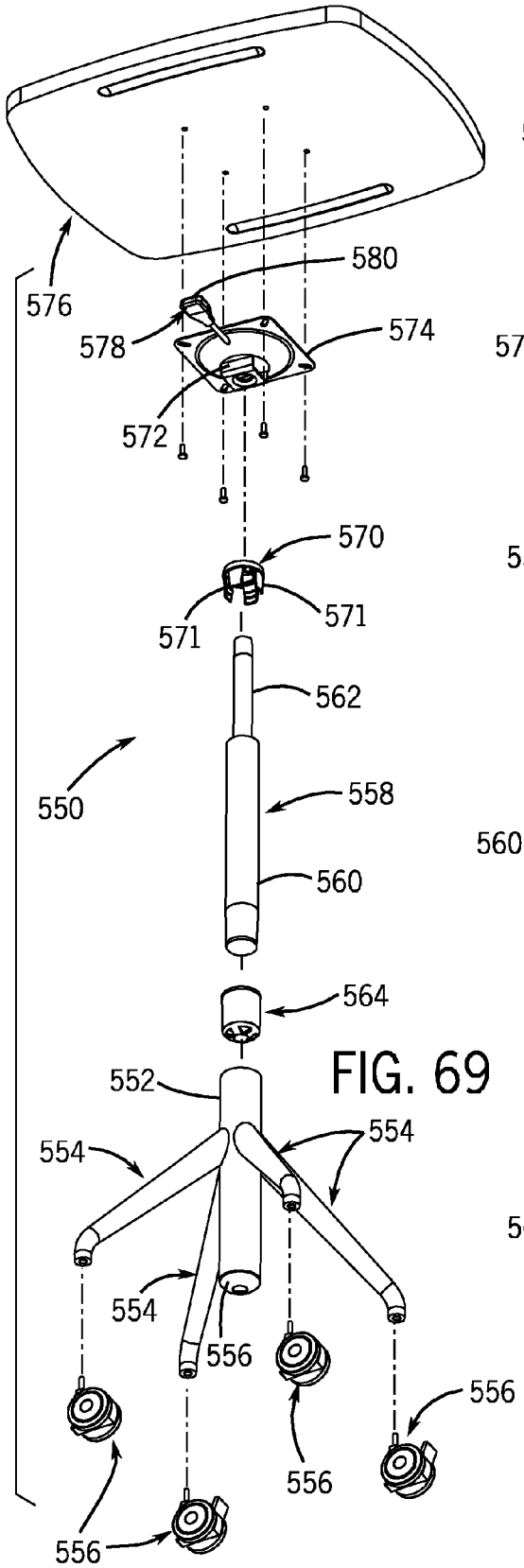
FIG. 69
FIG. 70
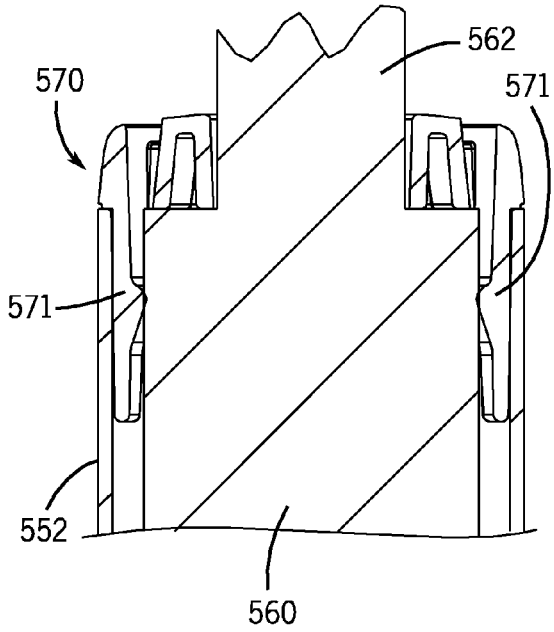
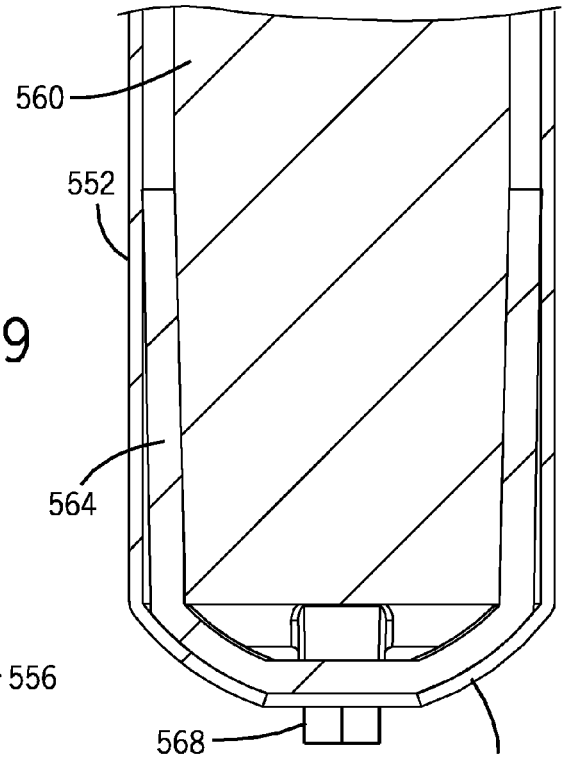
FIG. 71

MARKER BOARD

CROSS-REFERENCE TO RELATED APPLICATION

This application is a divisional of application Ser. No. 10/479,683 filed Jun. 17, 2004 now abandoned.

BACKGROUND AND SUMMARY OF THE INVENTION

This invention relates to furniture such as is employed in an office setting, and more particularly to a furniture and accessory system which includes a number of components which are readily adapted for movement and interchangeability in an office setting.

In many office environments, it is desirable to provide furniture components that can be quickly and easily moved to enable the office to be reconfigured for various tasks. It is also desirable to provide furniture components which can be manufactured according to specific user requirements, to enable the components to be used in an optimal manner by the user. It is further desirable to provide a furniture system in which the components are readily adapted to be used in combination with other components, and in which the components can be moved to varying arrangements and configurations according to the environment in which the components are to be used.

The present invention contemplates a number of furniture and accessory components which are adapted for use in an office environment, and which can be used separately or together and in various combinations and subcombinations, to facilitate work flow, individual and team productivity, and the ability to rapidly and easily reconfigure an office environment for various uses. The invention further contemplates a number of components which are of a modular construction so as to facilitate manufacture according to specific user requirements, to enable the components to easily be assembled according to specific user requirements.

In accordance with one aspect of the present invention, storage units can be constructed in various configurations from a number of modular components. The storage unit components are assembled on a modular base, which is preferably provided with casters or the like for imparting mobility to the storage unit. The modular components assembled together to form the storage unit are in the form of cabinet modules with drawers, shelf modules, and cupboard modules with doors that provide access to the open interior of the cupboard module. The various components can be in different sizes, and can be configured together in various combinations and subcombinations to form a storage unit having a desired configuration according to user requirements and/or the environment within which the storage unit is to be used.

Another aspect of the invention involves a tower-type storage unit, which again includes a base with casters for imparting mobility to the storage unit. The tower-type storage unit includes a series of walls with an open front, and can be assembled in various configurations, again according to user requirements.

Yet another aspect of the invention involves a mobile drawer-type storage unit which has an extendible and retractable handle assembly which facilitates quick and easy movement of the storage unit from one location to another. The storage unit is built on a base with casters, which are configured to extend outwardly from each corner of the base to provide a stable mobile support for the storage unit. The tower-type storage unit and the mobile drawer-type storage unit may be assembled on the same base.

Another aspect of the invention involves a paper management bin arrangement which facilitates storage of papers and which is readily adapted for use in combination with the storage components incorporated into the mobile furniture and accessory system of the present invention. The paper management bin arrangement includes a bin defining an upwardly open interior adapted to receive files, papers or binders. The bin can be supported in a suspension-type manner from a bracket adapted to be mounted to a shelf or the like associated with one of the storage units. Alternatively, the bin can be hung from a slot associated with an external or internal wall defined by one of the storage units, or can be placed in a storage unit drawer. The bin is capable of being used in connection with multiple ones of the components of the storage units constructed according to the present invention, to facilitate work flow for active projects and to facilitate archival storage subsequent to completion of a project.

The present invention also incorporates screen-type partitions, which have a modular construction and which can be assembled in various forms. The partitions include outwardly extending legs for stability, and may include casters or the like for facilitating movement and reconfiguration of the partitions.

Yet another aspect of the invention involves a unique marker board construction which can be mounted in various ways using the components of the mobile furniture and accessory system of the present invention, including suspension from a storage unit, engagement with a partition or suspension from a rail adapted to be engaged with a wall. The marker board includes mounting members which can be opened or closed to adapt the marker board for mounting to various types of supports, and which can also be operated to secure a sheet of paper or the like to the marker board. The marker board includes an arrangement for maintaining various types of markers in engagement with the marker board, to keep the markers at the ready.

Another aspect of the invention involves various types of components such as desks, tables and the like, which provide horizontal work surfaces. In one form, a desk or table top is mounted to the upper end of each of a pair of leg assemblies. The leg assemblies are modular, and are adapted to be used in combination with various types and shapes of table or desk tops. Each leg assembly preferably includes a single table top support and a pair of outwardly extending legs. The height of the table top support can be adjusted, so as to provide adjustability in the elevation of the desk or table top. In one form, a manual adjustment mechanism involves a retainer pin which can be engaged within one of a series of passages defined by the table top support. The leg assemblies can also be adapted for use as a computer stand, in which a computer monitor is supported by the top of the stand, which is supported by the pair of leg assemblies. A CPU cradle is engaged between the leg assemblies, for supporting a computer CPU below the top of the stand and between the leg assemblies. The cradle is preferably supported from a sleeve engaged with each table top support member, defining a passage through which the table top support member extends. The height of the sleeve relative to the support member can be adjusted, using a retainer pin engaged within one of the series of passages defined by the table top support member.

Another aspect of the invention contemplates an adjustable height glide which can be engaged with legs of the various components of the mobile furniture and accessory system of the present invention, such as the tables, desks, and partitions. Such components can be fitted with casters for facilitating movement, with glides, or with a combination of casters and glides. The adjustable height glide includes a base adapted for engagement with a supporting surface such as a floor, and which includes an upstanding outer wall defining an interior within which a threaded connecting shaft is received. The threaded connecting shaft extends upwardly from the outer wall of the base. The threaded connecting shaft extends through the interior of an upper member, which is telescopingly engaged with the outer wall of the base. The upper member is biased upwardly relative to the base by means of a spring, into engagement with the underside of the mounting area of the component to which the glide is to be mounted. The upper portion of the glide is moved inwardly as the threaded connecting shaft is advanced, and moved outwardly under the influence of the spring when the threaded connecting shaft is extended, such that the outer portion functions to conceal the upper area of the threaded connecting shaft located above the upper end of the outer wall of the base.

The various components of the mobile furniture and accessory system of the present invention can be used separately or in various combinations and subcombinations, to adapt to specific user requirements. The components are capable of being produced in various configurations, again according to user requirements and/or to enhance efficient and effective use of space in a work environment.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 19 is an isometric view of one version of a mobile cabinet forming a part of the mobile furniture and accessory system of the present invention;

FIGS. 23 and 24 are isometric views illustrating additional mobile cabinet configurations forming a part of the mobile furniture and accessory system of the present invention;

FIG. 25 is an isometric view illustrating a set of storage bins forming a part of the mobile furniture and accessory system of the present invention;

FIG. 26 is an isometric view showing a hanging version of a storage bin forming a part of the mobile furniture and accessory system of the present invention;

FIG. 27 is a partial isometric view with reference to line 27-27 of FIG. 26;

FIG. 35 is an isometric view of a marker board and the rear of a marker board cart, forming a part of the mobile furniture and accessory system of the present invention;

FIG. 36 is an isometric view of the front of the marker board cart illustrated in FIG. 35;

FIG. 37 is an enlarged partial isometric view with reference to line 37-37 of FIG. 35;

FIG. 42 is a partial section view showing an upper area of a marker board forming a part of the mobile furniture and accessory system of the present invention, and illustrating one of the ways in which the marker board can be suspended for use;

FIG. 43 is a view similar to FIG. 42, showing another way in which the marker board can be suspended for use;

FIG. 44 is an enlarged partial section view showing the manner in which a sheet of paper can be engaged with the marker board of FIGS. 42 and 43;

FIG. 45 is an enlarged partial elevation view of a marker engagement area, as shown in FIG. 37, incorporated into the marker board forming a part of the mobile furniture and accessory system of the present invention;

FIG. 46 is a view similar to FIG. 45, illustrating an alternative manner of securing a marker to the marker board;

FIG. 47 is a partial section view taken along line 47-47 of FIG. 46;

FIG. 69 is an exploded isometric view showing the components of the adjustable height table of FIGS. 66-68;

FIG. 70 is a partial section view with reference to line 70-70 of FIG. 67;

FIG. 71 is a partial section view with reference to line 71-71 of FIG. 67;

DETAILED DESCRIPTION

The mobile furniture and accessory system of the present invention contemplates a number of furniture products and accessories which are adapted to be used in an office environment, and which provide ease of mobility and relocation of the various components incorporated into the system.

Figure 1:
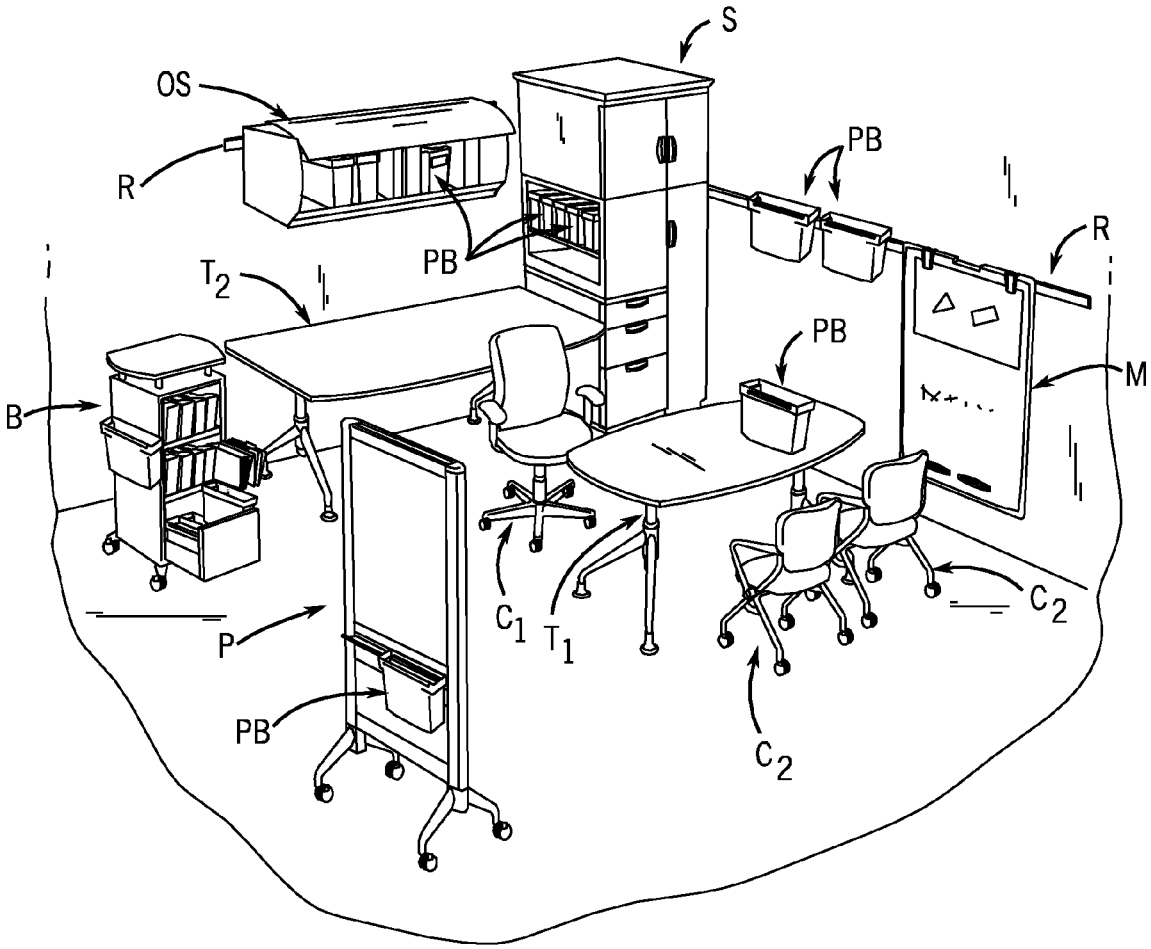
FIG. 1 is an isometric view of various components of the mobile furniture and accessory system of the present invention assembled together in a representative work environment.

FIG. 1 illustrates a representative office environment configuration which can be obtained using the certain components of the mobile furniture and accessory system of the present invention. The components employed in the office environment of FIG. 1 can be readily and easily repositioned to change the layout of the office environment, for flexibility of the open plan office configuration and for different specific uses of the space. Representative components incorporated into the office environment of FIG. 1 include a storage unit S, a pair of desks or tables T1, T2, a binder storage tower B, and a mobile screen or partition P. A series of chairs C1, C2 are provided for use by the occupant of the office environment of FIG. 1. A marker board M is illustrated as being supported by a support rail R secured to a wall which in part defines the space for the office environment of FIG. 1. A series of paper management storage bins PB may be used by the occupant of the office environment of FIG. 1. Bins PB are adapted to be supported by or stored in a number of the components of the office environment of FIG. 1, including suspension-type support from rail R and screen or partition P, and conventional storage within a shelf unit associated with storage unit S. The office environment of FIG. 1 may also include an overhead storage unit OS supported by a support rail R secured to another wall defining the space for the office environment of FIG. 1. The floor-supported components illustrated in the office environment of FIG. 1 are provided with casters or glides, which facilitate movement of such components for reconfiguration to adapt the space for different uses by the occupant of the space, and to also enable movement for altering the overall plan of the office space.

Figure 2:
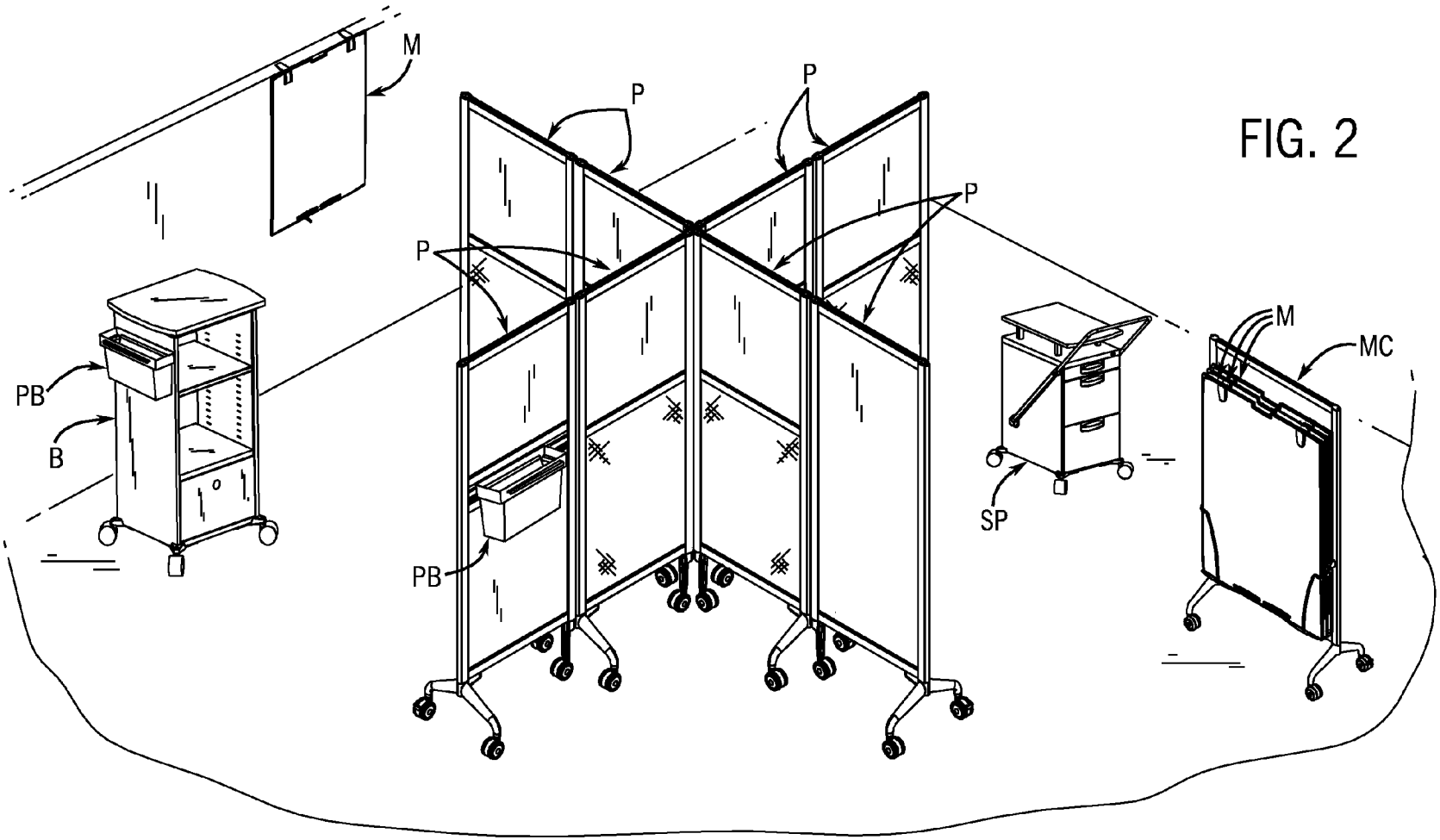
FIG. 2 is an isometric view of additional components of the mobile furniture and accessory system of the present invention assembled together in another arrangement of a work environment.
Figure 3:
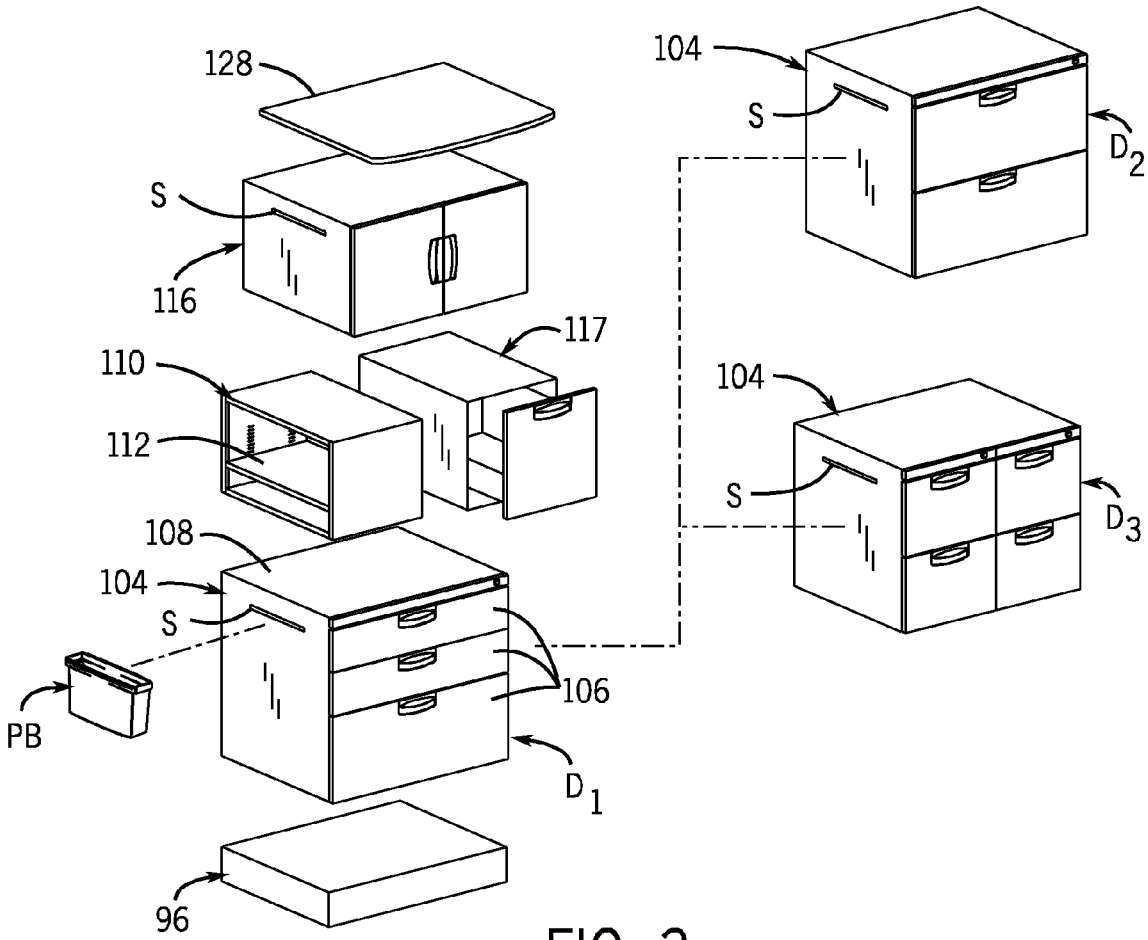
FIG. 3 is an isometric view of various components incorporated into a modular storage unit forming a part of the mobile furniture and accessory system of the present invention.
Figure 4:
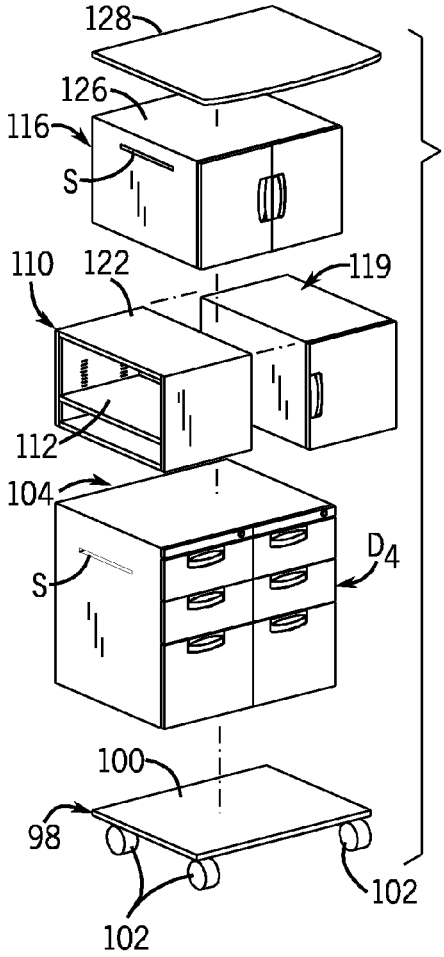
FIGS. 4-7 are views similar to FIG. 3, showing additional configurations of components that can be assembled together to form a modular storage unit forming a part of the mobile furniture and accessory system of the present invention.
Figure 5:
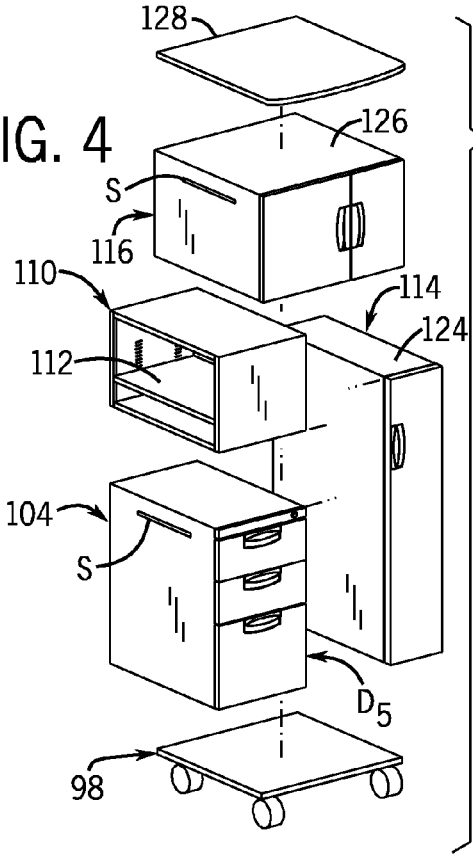
Figure 9:
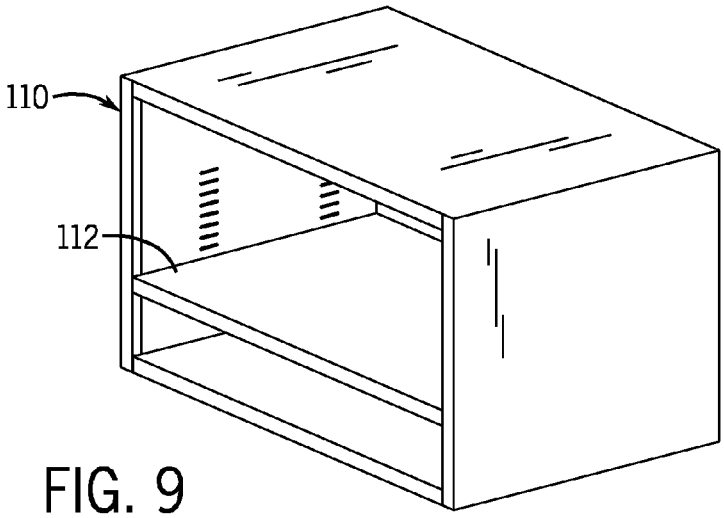
FIGS. 8, 9 and 10 are isometric views of representative components that can be incorporated in the various configurations of a modular storage unit, such as illustrated in FIGS. 4-7, and forming a part of the mobile furniture and accessory system of the present invention.
Figure 10:
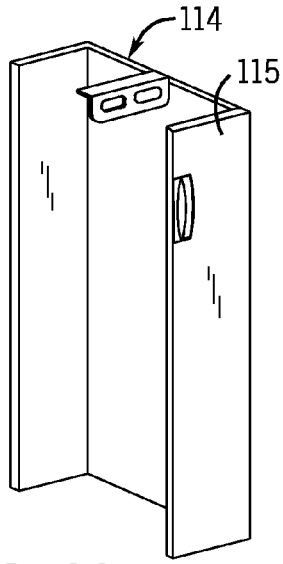
Figure 6:
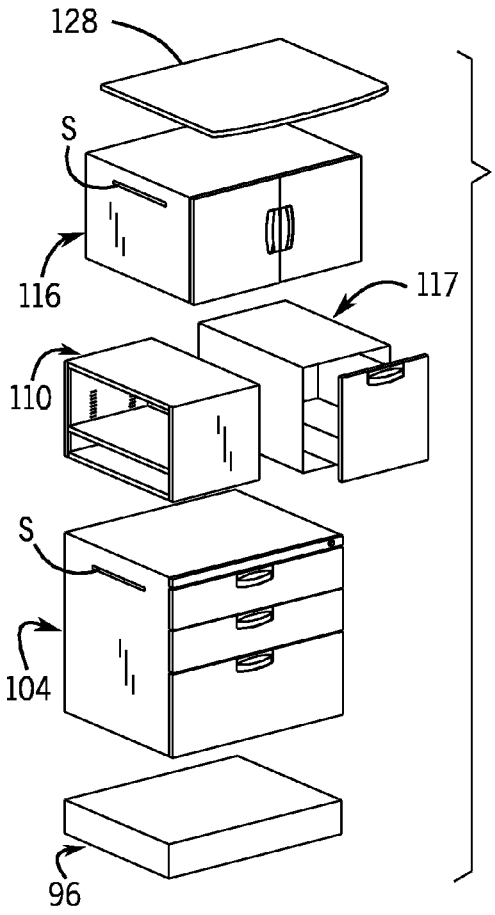
Figure 7:
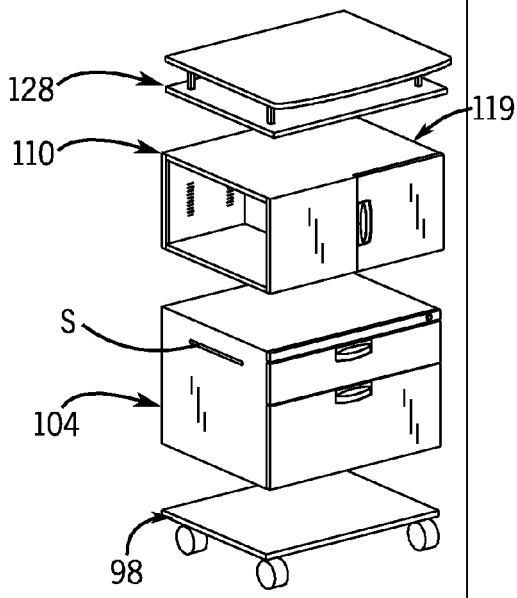
Figure 8:
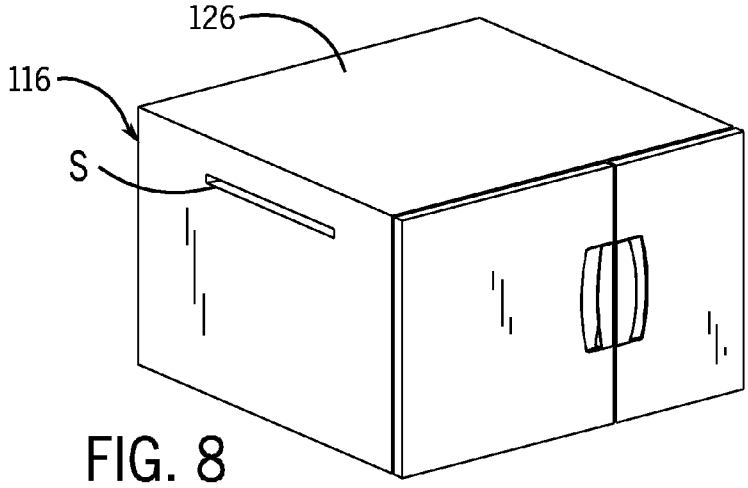

FIG. 2 illustrates another representative office environment configuration which can be obtained using the components of the mobile furniture and accessory system of the present invention. In the environment of FIG. 2, a series of screens or partitions P are moved together to divide the overall space into separate spaces that can be used by several different people. The users of the space may use various storage products that can be moved into and about the space, either for personal or project storage, including a binder tower B and a mobile storage pedestal SP. A series of marker boards M may be adapted for use by the occupants of the space, and can be supported from a wall or from screens or partitions P. A mobile marker board cart MC is adapted to carry a series of marker boards M, and can also be used to support marker boards M during use. Paper management bins PB may be used by the occupants of the space, and supported from various components including screens or partitions P and binder tower B.

The mobile furniture and accessory system of the present invention may be used in other combinations and configurations of components, and additional examples will be shown and described hereafter.

Storage Components

One aspect of the mobile furniture and accessory system contemplates various storage products. In one form, the storage products may be modular in construction. As shown in FIGS. 3-10, the modular storage products are built on a mobile stationary platform or base module 96, or on a platform or base module 98 which includes a base member 100 having a series of casters 102 located one at each corner defined by base member 100.

In a representative combination, a drawer module 104 includes a cabinet and a series of pull-out drawers 106, all of which may be configured to accommodate files or may be conventional storage-type drawers. The cabinet of drawer module 104 defines a top 108. Drawer module 104 has a depth which corresponds to the depth of base module 96 or base member 100, and has a width which may be equal to or less than that of base module 96 or base member 100. Drawer module 104 may be provided with various drawer configurations, representatively illustrated at $D_1$, D2, $D_3$, $D_4$ and $D_5$. It should be appreciated that the illustrated drawer configurations are exemplary only, and that other drawer styles and configurations may be employed. A bookcase module 110 is adapted to be placed on and secured to top wall 108 of drawer module 104. Bookcase module 110 may have the same footprint as drawer module 104, or may have a width less than that of drawer module 104. Bookcase module 110 is of conventional construction including an open front and an adjustable shelf 112 which divides the interior of bookcase module 110 into upper and lower storage areas. A wardrobe module 114 is adapted to be mounted to base member 100. Wardrobe module 114 is dimensioned so as to have the same depth as drawer module 104, and a width which, in combination with a narrow drawer module 104, equals the width of base module 96 or base member 100. Wardrobe module 114 includes an open interior which is accessible through a door 115. Wardrobe module 114 has a height which equals the combined height of drawer module 104 and bookcase module 110. In an arrangement in which the drawer module 104 has a width which equals that of base module 96 or base member 100, a single drawer module 117 or a single door cabinet module 119 may be engaged with the top wall 108 of drawer module 104, in combination with bookcase module 110. A full-width cupboard module 116 is adapted to be mounted to the upper ends of bookcase module 110 and wardrobe module 114. Cupboard module 116 has an open interior which is accessible through a single door or a pair of doors 118, 120. The footprint of cupboard module 116 is the same base module 96 or as base member 100, which in turn is the same as the combined footprint of drawer module 104 (and bookcase module 110) in combination with wardrobe module 114. Cupboard module 116 is adapted to be secured to an upper wall 122 of bookcase module 110 and to an upper wall 124 of wardrobe module 114. Cupboard module 116 in turn defines an upper wall 126, and a top panel 128 is adapted to be secured to upper wall 126 of cupboard module 116. Typically, top panel 128 will have a similar style, color and appearance as base member 100, so as to provide an aesthetically appealing appearance to the modular storage system constructed of components 100-128.

Certain of the side walls of the various components may be provided with a horizontal slot S, which can be used to releasably mount a paper management bin PB to the component, in a manner to be explained.

The various components illustrated in FIGS. 3-10 can be positioned in various orientations relative to each other and relative to base modules 96 or 98, according to the configuration desired by the user.

Figure 11:
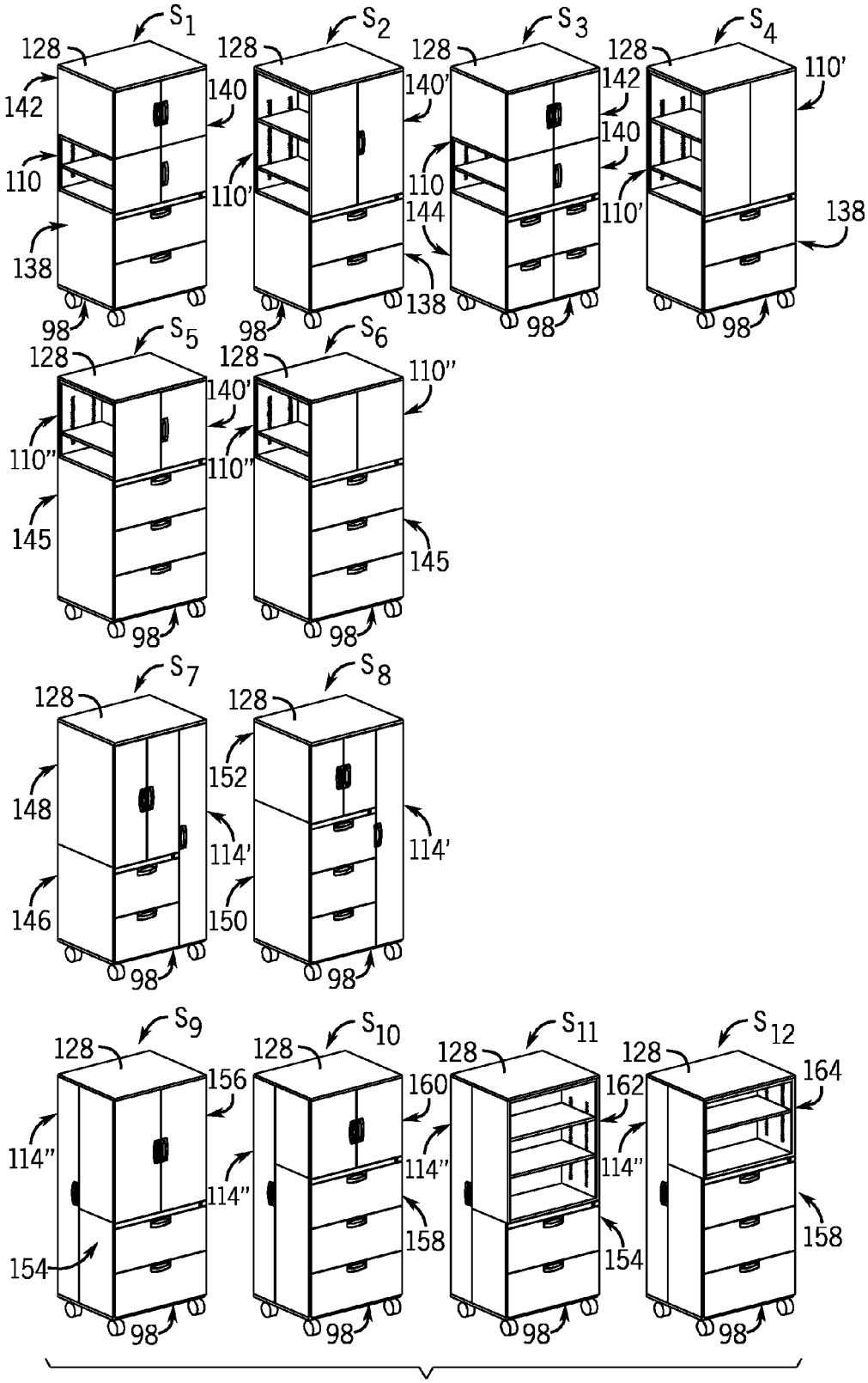
FIG. 11 is a view illustrating representative combinations of components incorporated into a modular storage unit having a first height and forming a part of the mobile furniture and accessory system of the present invention.

FIG. 11 illustrates various storage unit configurations having a first modular height, and which can be obtained using the modular storage component concept in accordance with the invention. In a first storage unit configuration $S_1$, a drawer module 138 is mounted to base member 100 of base module 98. Drawer module 138 is similar to a full width drawer module 104 with two full-width drawers. A bookcase module 110 and a single-door cupboard module 140 (which is identical to module 119) are secured to the top wall of drawer module 138. Bookcase module 110 and cupboard module 140 are configured to define the same footprint as-drawer module 138 and base member 100. A two-door cupboard module 142 (which is identical to module 116) is mounted to the upper walls of bookcase module 110 and cupboard module 140. Again, cupboard module 142 has the same footprint as base module 98 and the components between cupboard module 142 and base module 98. A top panel 128 is mounted to the upper wall of cupboard module 142. As noted previously, the components of storage unit $S_1$ may be moved to different orientations relative to each other, other than the specific orientation shown.

A storage unit $S_2$ includes base module 98 and drawer module 138 as described with respect to storage unit $S_1$. Storage unit $S_2$ also includes a tall bookcase module 110' and a tall single-door cupboard module 140', which are configured similarly to bookcase module 110 and cupboard module 140, respectively. Top panel 128 is mounted to the upper walls of bookcase module 110' and cupboard module 140'.

A storage unit $S_3$ includes bookcase module 110, single-door cupboard module 140 and two-door cupboard module 142, as described previously. Storage unit $S_3$ further includes a drawer module 144 having the same footprint as base module 98, but incorporating four drawers instead of the two drawers as illustrated in storage units $S_1$ and $S_2$.

A storage unit $S_4$ includes a drawer module 138 mounted to base module 98, in combination with a pair of back-to-back tall bookcase modules 110'. Top panel 128 is mounted to the upper walls of tall bookcase modules 110'.

Storage units $S_5$ and $S_6$ each include a drawer module 145 constructed similarly to drawer module 138 but including three drawers rather than two. Storage unit $S_5$ includes an intermediate height bookcase module 110", which is constructed similarly to bookcase modules 110 and 110', having a height greater than bookcase module 110 but less than tall bookcase module 110'. Storage unit $S_5$ further includes a single-door cupboard module 140', which has a height greater than that of single-door cupboard module 140 and equal to that of bookcase module 110". Storage unit $S_6$ includes back-to-back bookcase modules 110".

Storage units $S_7$ and $S_8$ each include a full-height wardrobe module 114'. Storage unit $S_7$ includes a drawer module 146 constructed similarly to drawer module 138, but having a lesser width such that drawer module 146 and wardrobe module 114 cooperate to define a footprint the same as that of base member 100. A tall partial-width cupboard module 148 is mounted to the upper wall of drawer module 146, defining an open interior which is accessible through a pair of doors. Cupboard module 148 defines the same footprint as drawer module 146, and cooperates with wardrobe module 114' to define the same footprint as base member 100. Top panel 128 is mounted to the upper ends of cupboard module 148 and wardrobe module 114.

Storage unit $S_8$ includes a drawer module 150 constructed similarly to drawer module 146 but including three drawers rather than two. Storage unit $S_8$ further includes a cupboard module 152 constructed similarly to cupboard module 148 but having a lesser height, such that drawer module 150 and cupboard module 152 have a combined height which equals that of wardrobe module 114'. Again, top panel 128 is mounted to the upper ends of cupboard module 152 and wardrobe module 114'.

Storage modules $S_9$, $S_{10}$, $S_{11}$, and $S_{12}$, each include a transversely mounted wardrobe module 114" having a width which equals that of base member 100. Storage module $S_9$ includes a drawer module 154 which includes a pair of drawers, and which has a lesser depth than drawer module 138, such that drawer module 154 and wardrobe module 114" cooperate to define a footprint which equals that of base member 100. A cupboard module 156 is mounted to the upper wall of drawer module 154, having a depth equal to that of drawer module 154. Cupboard module 156 and drawer module 154 have a combined height equal to that of wardrobe module 114", and top panel 128 is mounted to the upper ends of wardrobe module 114" and cupboard module 156.

Storage unit $S_{10}$ is constructed similarly to storage unit S, but includes a drawer module 158 constructed similarly to drawer module 154 but having three drawers instead of two and a greater height than that of drawer module 154. A cupboard module 160 is mounted to the upper wall of drawer module 154, and is constructed similarly to cupboard module 156 but having a lesser height, such that the combined height of drawer module 158 and cupboard module 160 equals that of wardrobe module 114". Top panel 128 is mounted to the upper ends of cupboard module 116 and wardrobe module 114".

Storage unit $S_{11}$ includes wardrobe module 114" as well as drawer module 154. In addition, a tall bookcase module 162 (similar to 110) is mounted above drawer module 154, and is dimensioned such that drawer module 154 and bookcase module 162 have a height which equals that of wardrobe module 114". Top panel 128 is mounted to the upper ends of wardrobe module 114" and bookcase module 162.

In a similar manner, storage unit $S_{12}$ includes wardrobe module 114" and drawer module 158 having three drawers. A bookcase module 164 (similar to 110"), constructed similarly to bookcase module 162 but having a lesser height, is mounted to the upper wall of drawer module 158. Again, the combined height of drawer module 158 and bookcase module 164 equals that of wardrobe module 114", and top panel 128 is mounted to the upper ends of wardrobe module 114" and bookcase module 164.

It should be understood that the components shown and described with respect to storage units $S_1$-$S_{12}$ are illustrative of a virtually unlimited number of components and combinations of components which can be mounted to base module 98 in a similar manner, to provide a differently configured storage unit according to user requirements.

All versions illustrated in FIG. 11 have the same height, which corresponds in height to a conventional height of a wall panel employed in an open plan office system, e.g. 66 inches. In all configurations, the various components can be moved to different angular positions relative to each other, according to the configuration desired by the user.

Figure 12:
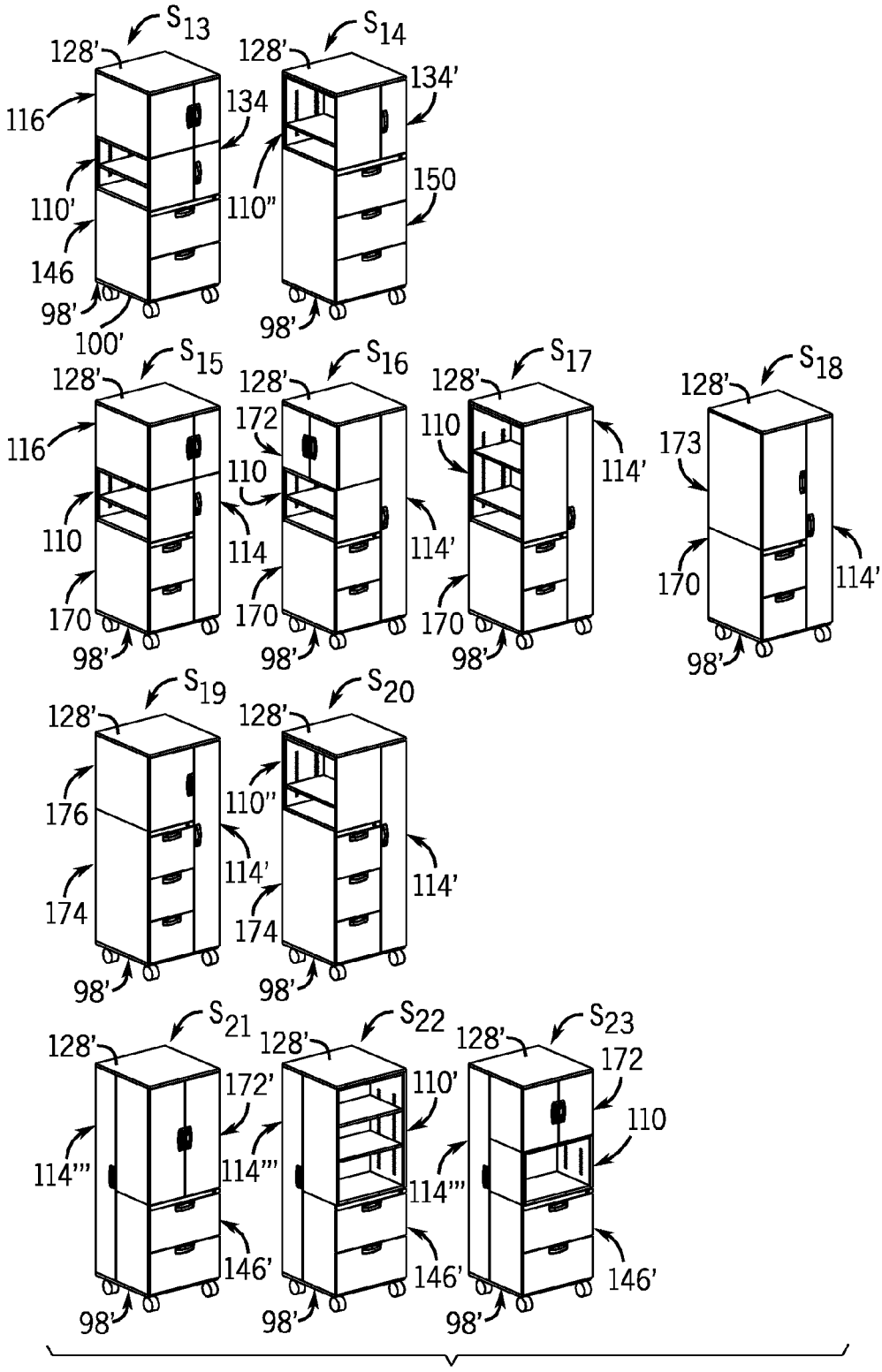
FIG. 12 is a view similar to FIG. 11, showing various combinations of components incorporated into a modular storage unit having a second height, and forming a part of the mobile furniture and accessory system of the present invention.

FIG. 12 illustrates a series of storage unit configurations built on a base 98' having a lesser width than base 98. Again, the storage unit configurations of FIG. 12 are all of a similar height, representatively corresponding to the height of a conventional panel in a wall system, such as 66 inches. Certain of the components in the storage unit configurations of FIG. 12 correspond to those described with respect to FIG. 11, and like reference characters will be used to facilitate clarity.

As shown in FIG. 12, a storage unit $S_{13}$ includes a drawer module 146 having two relatively large drawers. Drawer module 146 is mounted to base member 100' of base module 98', and bookcase module 110 is mounted to the top wall of drawer module 146 along with a narrow cupboard module 134. Bookcase module 110 and cupboard module 134 define a combined footprint which is the same as drawer module 146 and base module 98'. Cupboard module 116 is mounted to the upper walls of bookcase module 110 and narrow cupboard module 134, and a top panel 128' is mounted to the top wall of cupboard module 116.

A storage unit $S_{14}$ includes a three-drawer module 150 mounted to base module 98'. An intermediate height bookcase module 110" is mounted to the upper wall of drawer module 150, along with a single-door cupboard module 134', which is constructed similarly to cupboard module 134 but having a greater height which equals that of bookcase module 110". Top panel 128' is mounted to the upper walls of bookcase module 110" and cupboard module 134'.

A storage unit $S_{15}$ includes a narrow two-drawer module 170 and a wardrobe module 114 mounted to base module 98'. Bookcase module 110 is mounted to the upper wall of drawer module 170, which have a combined height equal to that of wardrobe module 114. Cupboard module 116 is mounted to the upper walls of bookcase module 110 and wardrobe module 114, and top panel 128' is mounted to the upper wall of cupboard module 116.

A storage unit $S_{16}$ includes a full-height wardrobe module 114' and drawer module 170 mounted to base module 98'. Bookcase module 110 is mounted to the upper wall of drawer module 170. A laterally facing cupboard module 172 is mounted to the upper wall of bookcase module 110. Top panel 128' is mounted to the upper walls of bookcase module 172 and wardrobe module 114'.

A storage unit $S_{17}$ includes drawer module 170 and full-height wardrobe module 114' mounted to base module 98', along with a tall bookcase module 110'. Top panel 128' is mounted to the upper walls of bookcase module 110' and wardrobe module 114'.

A storage unit $S_{16}$ includes a full-height wardrobe module 114' and drawer module 170 mounted to base module 98'. A forwardly opening single-door cupboard module 173 is mounted to the upper wall of drawer module 117, and top panel 128' is mounted to the upper walls of cupboard module 173 and wardrobe module 114'.

A storage module $S_{19}$ includes full-height wardrobe module 114' along with a narrow drawer module 174 mounted to base module 98'. Drawer module 174 is similar to drawer module 170, but has a greater height and includes three drawers rather than two. A single-door cupboard module 176 is mounted to the upper wall of drawer module 174, and has the same footprint as drawer module 174. Top panel 128' is mounted to the upper ends of cupboard module 176 and wardrobe module 114'.

A storage unit $S_{20}$ includes drawer module 174 and full-height wardrobe module 114' mounted to base module 98'. Bookcase module 110''' is mounted to the upper wall of drawer module 174, and top panel 128' is mounted to the upper waits of bookcase module 110" and wardrobe module 114'.

A storage unit $S_{21}$ has a laterally facing wardrobe module 114''' and a drawer module 146' mounted to base module 98'. Wardrobe module 114'''' is constructed similarly to lateral wardrobe 114" (FIG. 2), but has a lesser depth so as to equal the width of base module 98'. Drawer module 146' is constructed similarly to drawer module 146, but again has a lesser depth and cooperates with wardrobe module 114''' to define the same footprint as base module 98'. A tall cupboard module 172' is mounted to the upper wall of drawer module 166', which has a combined height equal to that of wardrobe module 114'''. Top panel 128' is mounted to the upper walls of cupboard module 172' and wardrobe module 114'''.

A storage unit $S_{22}$ includes lateral wardrobe module 114''' and drawer module 146' mounted to base module 98'. A tall bookcase module 110' is mounted to the upper wall of drawer module 146', which define a combined height equal to that of wardrobe module 114'''. Top panel 128' is mounted to the upper walls of bookcase module 110' and wardrobe module 114'''.

A storage unit $S_{23}$ includes lateral wardrobe module 114''' and drawer module 146' mounted to base module 98'. In addition, bookcase module 110 and cupboard module 172 are stacked on top of drawer module 146' to define a height equal to that of wardrobe module 114'''. Top panel 128' is mounted to the upper walls of cupboard module 172 and wardrobe module 114'''.

Again, the components illustrated in connection with storage units $S_{13}$-$S_{23}$ are representative of any number of component types and sizes which may be mounted to base module 98'. The component dimensions are selected such that the assembled components all have the same height, in this case 66 inches, which corresponds to a conventional wall panel height in an open plan space dividing system. Further, as before, the various components may be placed in different orientations relative to each other than the specific illustrated orientations, to provide additional flexibility in the storage unit design. In the case of the storage unit configurations illustrated in FIG. 12, base module 98' has a square footprint, which provides even greater flexibility in positioning the various components in different orientations relative to each other.

Figure 13:
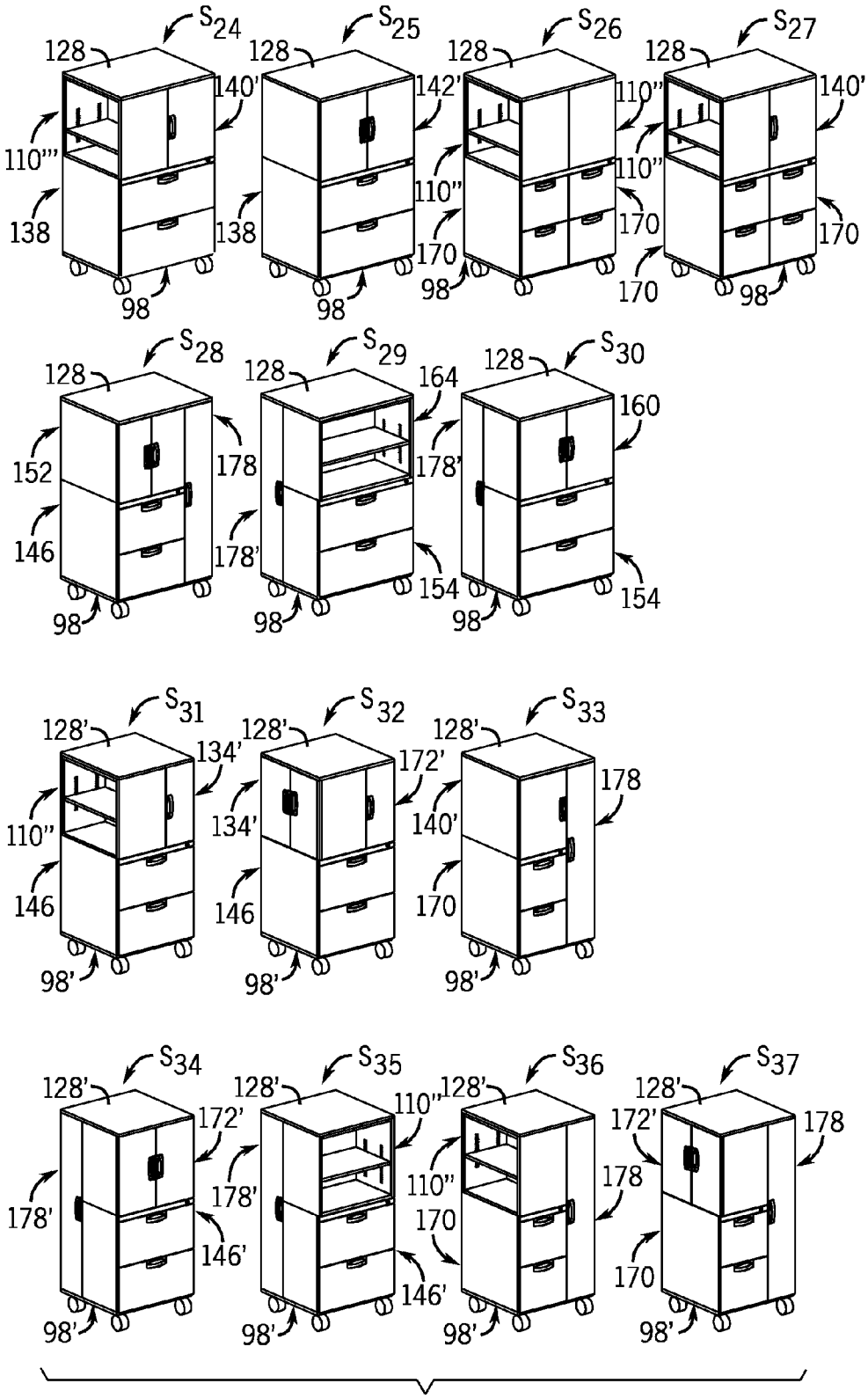
FIG. 13 is a view similar to FIGS. 11 and 12, showing different components incorporated into a storage unit having a third height, and forming a part of the mobile furniture and accessory system of the present invention.

FIG. 13 illustrates shorter height storage unit configurations built on base modules 98 or 98'. The storage units of FIG. 13 are constructed to have a height which corresponds to a shorter wall panel height typically used in a panel-type open plan office space divider system, in this case 54 inches, although it is understood that other satisfactory heights may be selected.

As shown in FIG. 13, a storage unit $S_{24}$ includes drawer module 138 mounted to base module 98, along with a laterally facing bookcase module 110" and a forwardly opening single-door cupboard module 140' mounted to the upper wall of drawer module 138. Top panel 128 is mounted to the upper walls of bookcase module 110 and cupboard module 140'.

A storage unit $S_{25}$ also includes drawer module 138 mounted to base module 98. A double door cupboard module 142', constructed similarly to cupboard module 142 of FIG. 11 but having a greater height, is mounted to the upper wall of drawer module 138, and has the same footprint as drawer module 138 and base module 98. Top panel 128 is mounted to the upper wall of cupboard module 142'.

A storage unit $S_{26}$ includes a pair of side-by-side drawer modules 170 mounted to base module 98. Drawer modules 170 define a combined footprint which is the same as base module 98, and each drawer module 170 includes a pair of vertically stacked drawers. A pair of intermediate height bookcase modules 110" are mounted in back-to-back fashion on top of drawer modules 170. Top panel 128 is mounted to the upper walls of bookcase modules 110".

A storage unit $S_{27}$ also includes a pair of side-by-side drawer modules 170 mounted to base module 98. A bookcase module 110" is stacked on top of one of drawer modules 170, and a single-door cupboard module 140' is stacked on top of the other drawer module 170. Top panel 128 is mounted to the upper walls of bookcase module 110" and cupboard module 140'.

A storage unit $S_{28}$ includes a drawer module 146 and a wardrobe module 178 mounted to base module 98. Wardrobe module 178 is constructed similarly to the forwardly opening versions of wardrobe module 114, but having a greater height which corresponds to the full height of storage unit $S_{28}$. A double door cupboard module 152 is mounted to the upper wall of drawer module 146, to define a combined height equal to that of wardrobe module 178. Top panel 128 is mounted to the upper walls of cupboard module 152 and wardrobe module 178.

A storage unit $S_{29}$ includes a laterally opening full-height wardrobe module 178' and a drawer module 154 mounted to base module 98. A bookcase module 164 is mounted to the upper wall of drawer module 154, to define a combined height equal to that of wardrobe module 178'. Top panel 128 is mounted to the upper walls of bookcase module 164 and wardrobe module 178'.

A storage unit $S_{30}$ includes drawer module 154 and laterally opening wardrobe module 178' mounted to base module 98. Cupboard module 160 is mounted to the upper wall of drawer module 154, which define a combined height equal to that of wardrobe module 178'. Top panel 128 is mounted to the upper walls of cupboard module 160 and wardrobe module 178'.

Storage units $S_{31}$-$S_{37}$ are built on base module 98', and are constructed to have an overall height which is the same as storage units $S_{23}$-$S_{29}$.

Storage unit $S_{31}$ includes a drawer module 146 mounted to base module 98', as well as an intermediate height bookcase module 110" and a single-door cupboard module 134' mounted to the upper wall of drawer module 146. Top panel 128' is mounted to the upper walls of bookcase module 110" and cupboard module 1341.

Storage unit $S_{32}$ includes drawer module 146 mounted to base module 98'. Single-door cupboard module 134' is mounted to the upper wall of drawer module 146, and a laterally opening cupboard module 172' is mounted to drawer module 146 along with cupboard module 134'. Cupboard module 172' is constructed similarly to cupboard module 172 (FIG. 12), but has a greater height so as to correspond in height with cupboard module 134'. Top panel 128' is mounted to the upper walls of cupboard modules 134' and 172'.

A storage unit $S_{33}$ includes full-height wardrobe module 178 and drawer module 170 mounted to base module 98'. A single-door cupboard module 140' is stacked on top of drawer module 170, which define a combined height equal to that of wardrobe module 178. Top panel 128' is mounted to the upper walls of wardrobe module 178 and cupboard module 140'.

A storage unit $S_{34}$ includes a laterally opening wardrobe module 178' and a drawer module 146' mounted to base module 98'. A cupboard module 172' is stacked on drawer module 146', which define a combined height equal to that of wardrobe module 178'. Top panel 128' is mounted to the upper walls of cupboard module 172' and wardrobe module 178'.

A storage unit $S_{35}$ includes drawer module 146' and laterally opening wardrobe module 178' mounted to base module 98'. A forwardly facing bookcase module 110" is stacked on drawer module 146', which have a combined height equal to that of wardrobe module 178'. Top panel 128' is mounted to the upper walls of wardrobe module 178' and bookcase module 110".

A storage unit $S_{36}$ includes a drawer module 170 and a wardrobe module 178 mounted to base module 98'. A laterally facing bookcase module 110" is stacked on drawer module 170, which define a combined height equal to that of wardrobe module 178. Top panel 128' is mounted to the upper walls of wardrobe module 178 and bookcase module 110".

A storage unit $S_{37}$ includes a drawer module 170 and a wardrobe module 178 mounted to base module 98'. A laterally opening cupboard module 172' is stacked on drawer module 170, which define a combined height equal to that of wardrobe module 178. Top panel 128' is mounted to the upper walls of cupboard module 172' and wardrobe module 178.

Again, the components illustrated in connection with storage units $S_{24}$-$S_{37}$ are representative of any number of component types and sizes which may be mounted to base modules 98 or 98'. The component dimensions are selected such that the assembled components all have the same height, in this case 54 inches, which corresponds to a conventional wall panel height in an open plan space dividing system. The various components may be placed in different orientations relative to each other than the specific illustrated orientations, to provide additional flexibility in the storage unit design.

Figure 14:
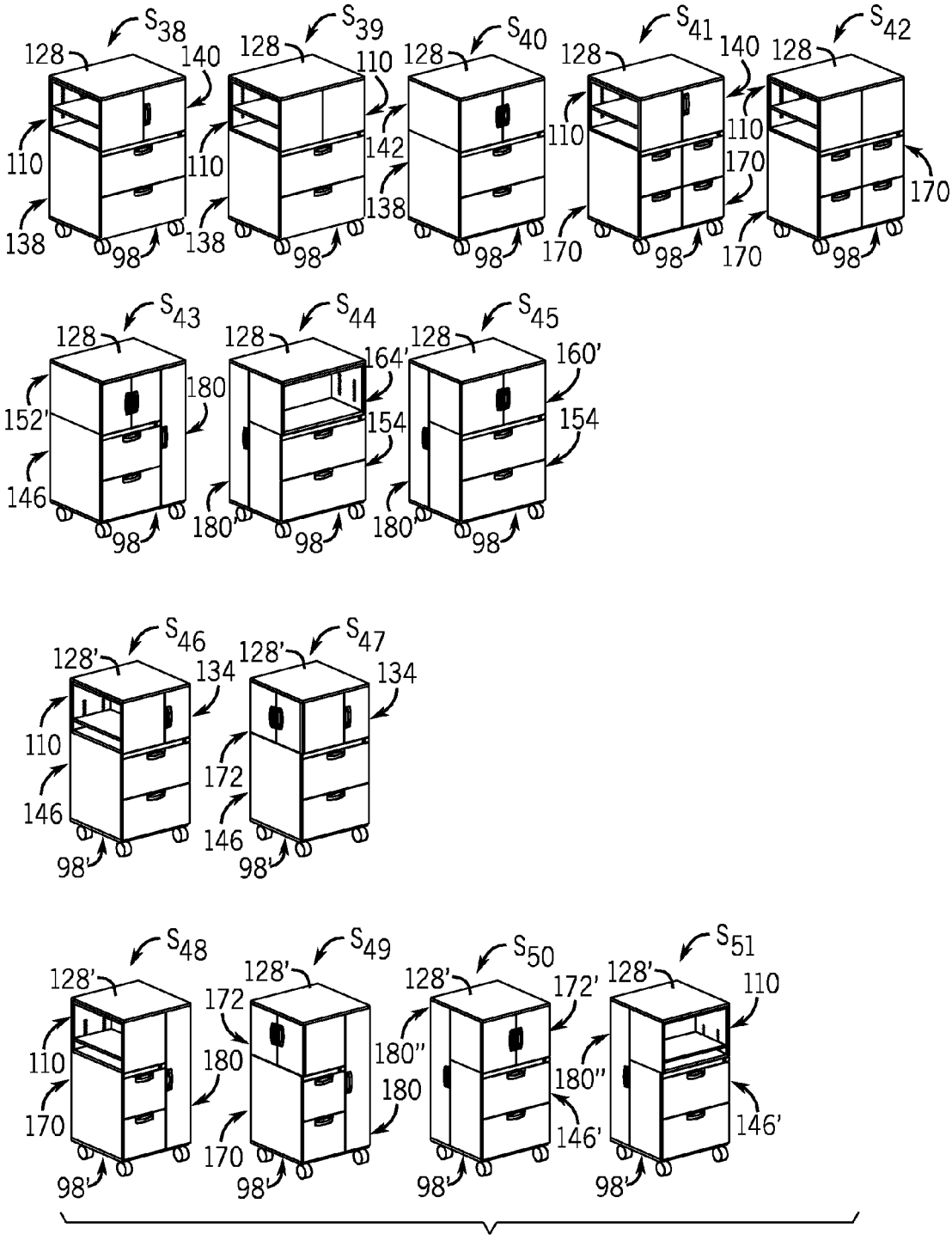
FIG. 14 is a view similar to FIGS. 11-13, showing components incorporated into a storage unit having a fourth height, and forming a part of the mobile furniture and accessory system of the present invention.

FIG. 14 illustrates various storage unit components and configurations having a lesser height than those previously illustrated and described, which again may correspond to the height of a wall panel system in an open plan space dividing arrangement, e.g. 48 inches. Storage units $S_{38}$-$S_{45}$ are built on base module 98, and storage units $S_{46}$-$S_{51}$ are built on base module 98'.

Storage unit $S_{38}$ includes drawer module 138 mounted to base module 98, along with bookcase module 110 and single-door cupboard module 140 mounted to the upper wall of drawer module 138. Top panel 128 is mounted to the upper walls of bookcase module 110 and cupboard module 140.

Storage unit $S_{39}$ includes drawer module 138 mounted to base module 98, and back-to-back bookcase modules 110 mounted to the upper wall of drawer module 138. Top panel 128 is mounted to the upper walls of bookcase modules 110.

Storage unit $S_{40}$ includes drawer module 138 mounted to base module 98, and cupboard module 142 stacked on drawer module 138. Top panel 128 is mounted to the upper wall of cupboard module 142.

Storage unit $S_{41}$ includes side-by-side drawer modules 170 mounted to base module 98. A laterally opening bookcase module 110 is mounted to one of drawer modules 170, and single-door cupboard module 140 is stacked on the other drawer module 170. Top panel 128 is mounted to the upper walls of bookcase module 110 and cupboard module 140.

Storage unit. $S_{42}$ includes side-by-side drawer modules 170 mounted to base module 98, and back-to-back bookcase modules 110 stacked on top of drawer modules 170. Top panel 128 is mounted to the upper walls of bookcase modules 110.

Storage unit. $S_{43}$ includes drawer module 146 mounted to base module 98, along with a wardrobe module 180 constructed similarly to wardrobe module 178 but having a lesser height A double-door forwardly opening cupboard module 152' is stacked on drawer module 146, and is constructed similarly to drawer module 152 but having a lesser height. The combined height of drawer module 146 and cupboard module 152' equals that of wardrobe module 180. Top panel 128 is mounted to the upper walls of cupboard module 152' and wardrobe module 180.

Storage unit $S_{44}$ includes a laterally opening wardrobe module 180' and a drawer module 154 mounted to base module 98. A forwardly facing bookcase module 164' is stacked on drawer module 154, to define a combined height equal to that of wardrobe module 180'. Bookcase module 164' is constructed similarly to bookcase module 164, but having a lesser height Top panel 128 is mounted to the upper walls of wardrobe module 180' and bookcase module 164'.

Storage unit $S_{45}$ includes drawer module 154 and laterally facing wardrobe module 180' mounted to base module 98. A forwardly opening double-door cupboard module 160' is constructed similarly to cupboard module 160, but has a lesser height. Top panel 128 is mounted to the upper walls of cupboard module 160' and wardrobe module 180'.

Storage unit $S_{46}$ includes drawer module 146 mounted to base module 98'. Bookcase module 110 is mounted to the upper wall of drawer module 146, along with single-door forwardly facing cupboard module 134. Top panel 128' is mounted to the upper walls of bookcase module 110 and cupboard module 134.

Storage unit $S_{47}$ also includes drawer module 146 mounted to base module 98'. Cupboard module 134 is mounted to the upper wall of drawer module 146, along with laterally opening double door cupboard module 172. Top panel 128' is mounted to the upper walls of cupboard modules 134 and 172.

Storage unit $S_{48}$ includes drawer module 170 and wardrobe module 180 mounted to base module 98'. Bookcase module 110 is stacked on drawer module 170, which define a combined height equal to that of wardrobe module 180. Top panel 128' is mounted to the upper walls of bookcase module 110 and wardrobe module 180.

Storage unit $S_{49}$ also includes drawer module 170 and wardrobe module 180 mounted to base module 98'. Laterally opening cupboard module 172 is stacked on drawer module 170, which define a combined height equal to that of wardrobe module 180. Top panel 128' is mounted to the upper walls of cupboard module 172 and wardrobe module 180.

Storage unit $S_{50}$ includes drawer module 146' and a laterally opening wardrobe module 180" mounted to base module 98'. Wardrobe module 180" is constructed similarly to wardrobe module 180', but has a lesser depth so as to correspond in width to that of base module 98'. A forwardly opening cupboard module 172' is stacked on drawer module 166', which define a combined height equal to that of wardrobe module 180". Top panel 128' is mounted to the upper walls of cupboard module 172' and wardrobe module 180".

Storage unit $S_{51}$ includes drawer module 146' and wardrobe module 180" mounted to base module 98'. A forwardly facing bookcase module is stacked on drawer module 146', which define a combined height equaling that of wardrobe module 180". Top panel 128' is mounted to the upper walls of wardrobe module 180" and bookcase module 110.

Again, the components illustrated in connection with storage units $S_{38}$-$S_{51}$ are representative of any number of component types and sizes which may be mounted to base-modules 98 or 98'. The component dimensions are selected such that the assembled components all have the same height, in this case 48 inches, which corresponds to a conventional wall panel height in an open plan space dividing system. The various components may be placed in different orientations relative to each other than the specific illustrated orientations, to provide additional flexibility in the storage unit design.

Figure 15:
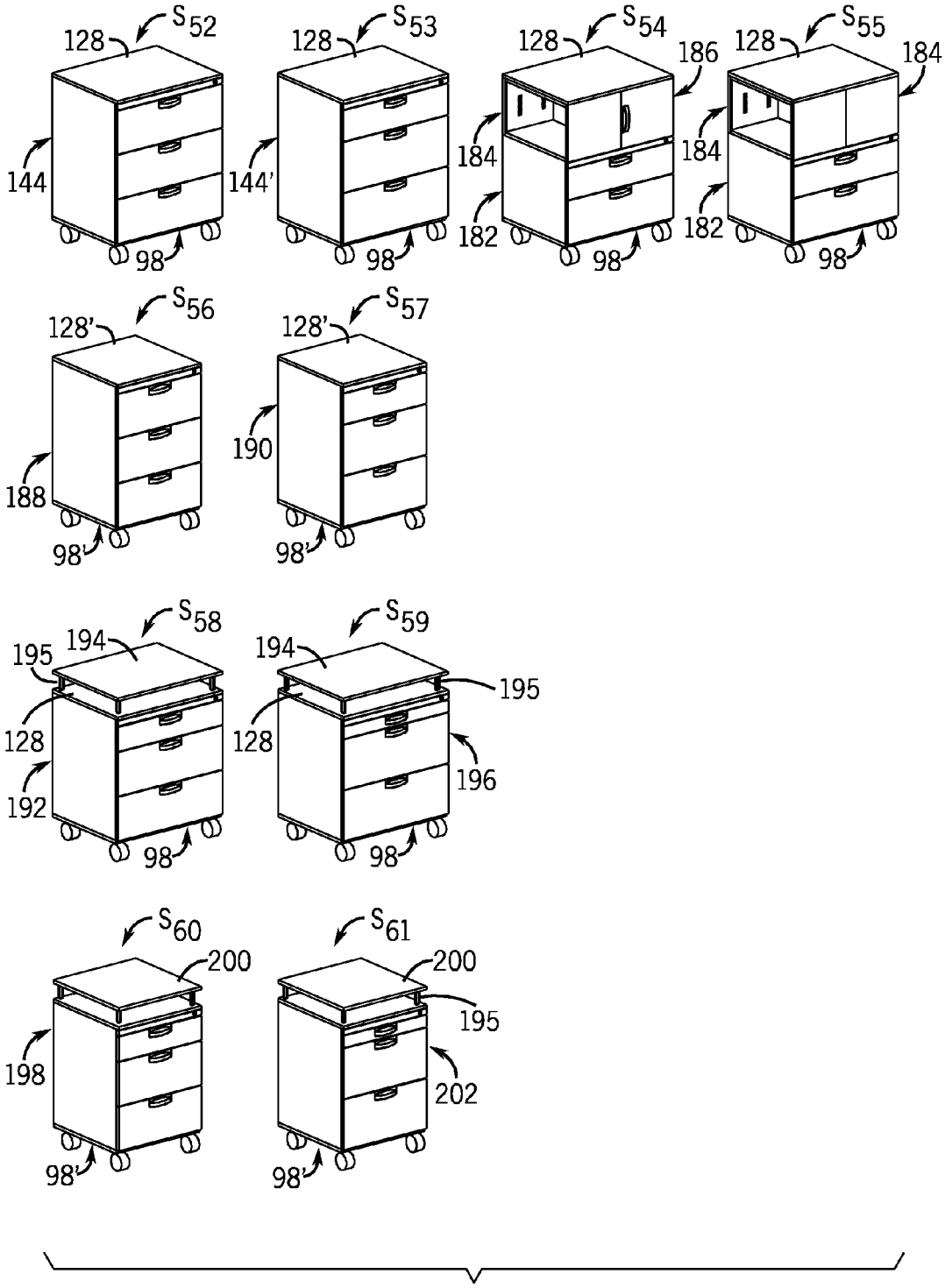
FIG. 15 is a view similar to FIGS. 11-14, showing additional storage units of different configurations, forming a part of the mobile furniture and accessory system of the present invention.

FIG. 15 illustrates a series of modular construction stand height storage units, all of which have a conventional overall stand height of approximately 39¾ inches.

A storage unit $S_{52}$ includes a drawer module 144 mounted to base module 98. Drawer module 144 includes three drawers of equal size. Top panel 128 is mounted to the top wall of drawer module 144. Storage unit $S_{53}$ is similarly configured, including a drawer module 144' mounted to base module 98. Drawer module 144' has the same overall dimensions as drawer module 144, but includes two equally sized larger drawers and one smaller top drawer. Top panel 128 is mounted to the top wall of drawer module 144'.

Storage module $S_{54}$ includes a drawer module 182 which has a relatively large bottom drawer and a smaller top drawer. A laterally facing bookcase module 184 is mounted to the top wall of drawer module 182, along with a forwardly opening single-door cupboard module 186 which together define the same footprint as drawer module 182 and base module 98. Top panel 128 is mounted to the upper walls of bookcase module 184 and cupboard module 186.

Storage module $S_{55}$ includes drawer module 182 mounted to base module 98, along with a pair of back-to-back bookcase modules 184 mounted to the upper wall of drawer module 182. Top panel 128 is mounted to the top walls of bookcase modules 184.

Storage modules $S_{56}$ and $S_{57}$ are built on base module 98'. Storage module $S_{56}$ includes a drawer module 188 having three equally sized drawers. Storage module $S_{57}$ includes a drawer module 190 mounted to base module 98'. Drawer module 190 includes two equally sized larger bottom drawers and a smaller top drawer. Top panel 128' is mounted to the upper wall of each of drawer modules 188, 190.

A storage unit $S_{58}$ includes a drawer module 192 mounted to base module 98. Drawer module 192 has a pair of larger bottom drawers and a smaller top drawer. Top panel 128 is mounted to the upper wall of drawer module 192, and an oversail top panel 194 is adapted for interconnection above top panel 128 via supports 195. Storage unit $S_{59}$ is similarly constructed, including a drawer module 196 having a pair of larger bottom drawers and a small top drawer. Top panel 128 is mounted to the upper wall of drawer module 196, and oversail top 194 is adapted for engagement with top panel 128 via supports 195.

Storage units $S_{60}$ and $S_{61}$ are built on base module 98'. Storage unit $S_{59}$ includes a drawer module 198 mounted to base module 98', which includes a pair of relatively large bottom drawers and a smaller top drawer. An oversail top 200 is adapted for engagement via supports 195 with top panel 128, which is mounted to the upper wall of drawer module 198. Similarly, storage unit $S_6$, includes a drawer module 202 mounted to base module 98', which has a pair of large bottom drawers and a small top drawer. Again, oversail top 200 is adapted for engagement with top panel 128' via supports 195.

Again, the storage unit components and configurations shown in FIG. 15 are illustrative of a variety of other types of storage unit components and configurations which may be used. The components are assembled to base modules 98, 98' to provide a predetermined height, in this case corresponding to a stand height of 39¾ inches.

Figure 16:
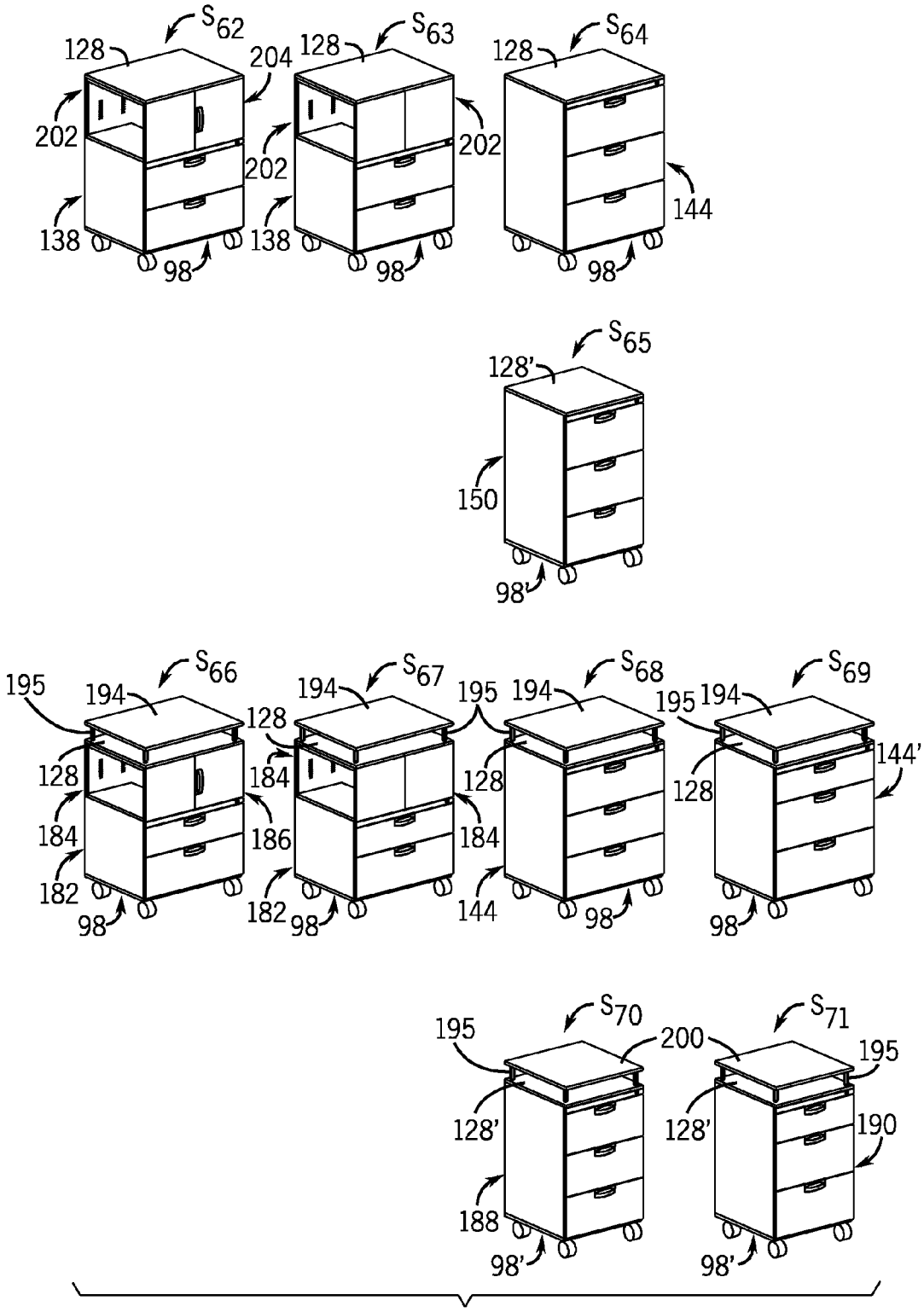
FIG. 16 is a view similar to FIGS. 11-15, showing additional configurations of components to construct storage units forming a part of the mobile furniture and accessory system of the present invention.

FIG. 16 illustrates other stand height storage unit configurations, having a height greater than the configurations illustrated in FIG. 15, in this case a stand height of 44 11/32 inch.

A storage unit $S_{62}$ includes a drawer module 138 having a pair of drawers, mounted to base module 98. A bookcase module 202 is mounted to the top wall of drawer module 138, along with a single-door forwardly facing cupboard module 204, which together define the same footprint as drawer module 138 and base module 98. Top panel 128 is mounted to the upper walls of bookcase module 202 and cupboard module 204.

A storage unit $S_{63}$ also includes drawer module 138 mounted to base module 98. A pair of back-to-back bookcase modules 202 are mounted to the upper wall of drawer module 98, and top panel 128 is mounted to the upper walls of bookcase modules 202.

A storage unit $S_{64}$ includes a drawer module 144 mounted to base module 98, with a top panel 128 mounted to the upper wall of drawer module 144.

A storage unit $S_{65}$ is built on base module 98', and includes a drawer module 150 mounted to base module 98'. Top panel 128' is mounted to the upper wall of drawer module 150.

Storage modules $S_{66}$-$S_{69}$ are built on base module 98.

Storage unit $S_{66}$ includes a drawer module 182 mounted to base module 98, and a bookcase module 184 and single-door cupboard module 186 mounted to the upper wall of drawer module 182. An oversail top 194 is adapted for mounting to top panel 128 via supports 195. Top panel 128 overlies bookcase module 184 and cupboard module 186. Similarly, storage unit $S_{67}$ includes drawer module 182 and back-to-back bookcase modules 184. Top panel 128 overlies bookcase modules 184, and oversail top 194 is engaged with top panel 128 via supports 195. Storage unit $S_{68}$ includes drawer module 144 mounted to base module 98 and top panel 128 mounted to the upper wall of drawer module 144. Oversail top 194 is engaged with top panel 128 via supports 195. Storage unit $S_{69}$ includes drawer module 144' mounted to base module 98, and top panel 128 secured to the upper wall of drawer module 144'. Oversail top 194 is engaged with top panel 128 via supports 195.

Storage units $S_{70}$ and $S_{71}$ are built on base modules 98'. Storage module $S_{70}$ includes drawer module 188 mounted to base module 98', and top panel 128' mounted to the upper wall of drawer module 188. Oversail top 200 is engaged with top panel 128' via posts 195.

Storage unit $S_{71}$ includes drawer module 190 mounted to base module 98', and top panel 128' mounted to the upper wall of drawer module 190. Oversail top 200 is mounted to top panel 128' via posts 195.

As can be appreciated, the various modular storage components incorporated into storage units $S_1$-$S_{70}$ include a number of common components which are used in a variety of storage unit configurations, which increases manufacturing and assembly efficiencies as well as the range of product offerings. In addition, certain of the components, such as the bookcase components and the cupboard components, may be formed of common walls, with the bookcase modules being provided with open fronts and the cupboard modules being provided with doors which close the open fronts. This serves to further enhance manufacturing and assembly efficiencies.

In addition, while certain of the illustrated components are shown as having fully enclosed walls, it is understood that certain walls may be removed, which would otherwise be concealed in assembly. For example, certain of the components located at the top of a storage unit may be formed without a top wall, such that the top components are enclosed by top panels 128, 128'. Sidewalls may be eliminated when the side of the component is to be totally covered, to enable the neighboring component to enclose the open side. Bottom walls may similarly be eliminated. In all cases, the elimination of certain component walls reduces unit cost and weight.

Figure 17:
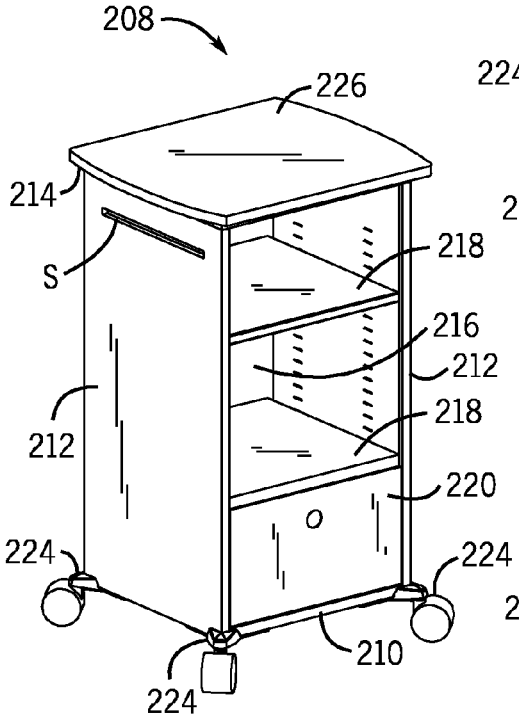
FIG. 17 is an isometric view of another version of a storage unit forming a part of the mobile furniture and accessory system of the present invention.

FIG. 17 illustrates a binder tower storage unit 208 which is intended to replace a conventional overhead storage unit in the mobile office furniture and accessory system of the present invention. The basic structure of binder tower storage unit 208 is in the form of a cabinet which includes a bottom wall 210, upstanding sidewalls 212, a top wall 214 and a back wall 216. Walls 210-216 cooperate to define a forwardly open internal cavity, within which a pair of shelves 218 are mounted by adjustable engagement with sidewalls 212. A bottom file drawer 220 may be mounted below the lower shelf 218 and above bottom wall 210. A thin pencil drawer may be mounted in the interior of storage unit 208 below top wall 214.

A series of casters 224 are located at the lower end of storage unit 208. Casters 224 extend outwardly from each corner defined by bottom wall 210. The outboard orientation of casters 224 functions to provide stability to storage unit 208. A top panel 226 may be mounted to top wall 214 in a conventional manner, to increase the horizontal upwardly facing surface area of storage unit 208, or may be mounted to top wall 214 in an oversail arrangement using posts 227. Certain of the walls of storage unit 208, such as side walls 212, may be formed with one or more slots S for use in suspending a paper management bin PB.

Figure 18:
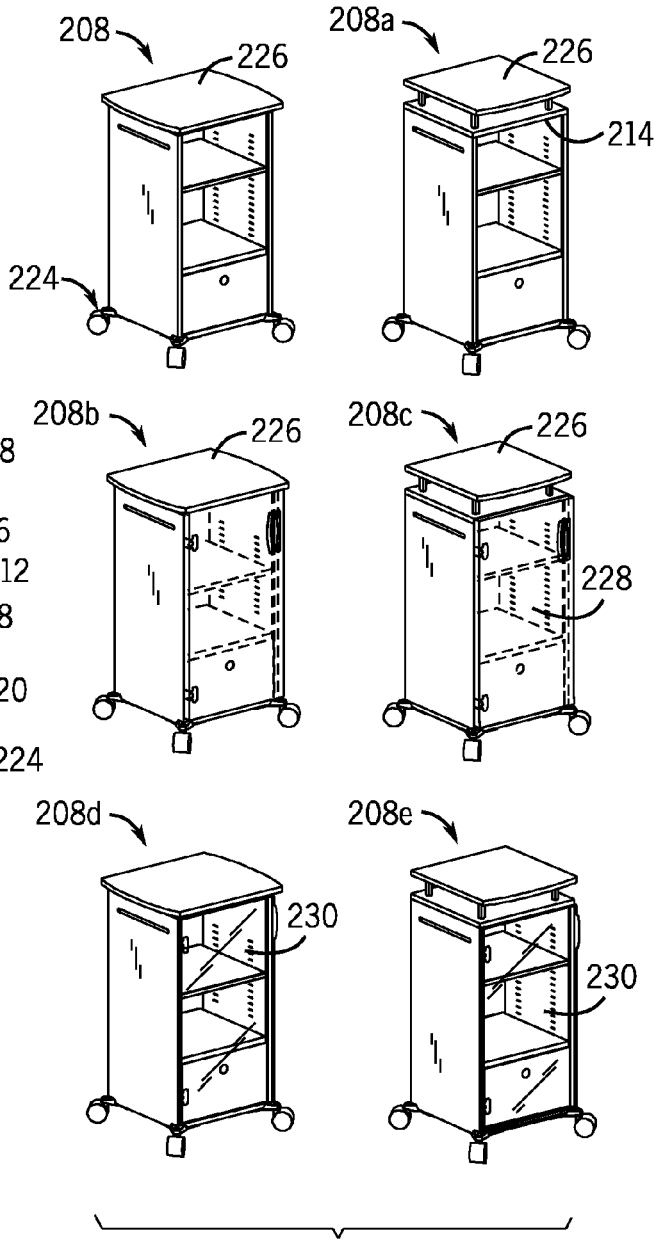
FIG. 18 is a view showing alternative versions of a storage unit similar to FIG. 17, forming a part of the mobile furniture and accessory system of the present invention.

FIG. 18 illustrates various options and heights available for binder tower storage unit 208. The basic version shown at 208 includes an open front and the components as described with respect to FIG. 17. Storage unit 208 has top panel 226 mounted to top wall 214. An alternative storage unit 208*a* has top panel 226 mounted to top wall 214 in an oversail manner via posts 227. In another alternative embodiment, the storage unit 208 has essentially the same construction as storage unit 208 as shown, but is taller in height due to an increased length of its sidewalls 212 and back walls 216. The overall height of storage 208 as shown corresponds to a stand height of 39¾ inches, such as is shown and described with respect to the various storage units of FIG. 15. Similarly, the alternative embodiment of storage unit 208 has a height which corresponds to a stand height of 44 11/16 inches, such as is described in connection with the various storage units of FIG. 16. As shown in FIG. 19, other versions of storage unit 208, shown at 208*b*, 208*c* may be fitted with a front hinged door panel 228 which selectively encloses the interior of the storage unit 208*b*, 208*c*. Door panel 228 may be formed of a material such as wood, steel or any other satisfactory material employed in manufacture of cabinet components.

Alternatively, a translucent door panel 230 may be hingedly mounted to the front of the storage unit, as shown at 208*d*, 208*e*.

FIG. 19 illustrates a mobile storage pedestal 234 built on a base similar to that of storage unit 208. Storage pedestal 234 is in the form of a file-type storage unit having a bottom wall 236, a pair of sidewalls 238, a top wall 240 and a back wall (not shown). A lower drawer 242 and an upper drawer 244 are slidably mounted within the cabinet defined by walls 236-240, in a known manner. An outboard caster 224 is located at each bottom corner of the cabinet defined by walls 236-240, to impart stability to mobile storage pedestal 234.

Mobile storage pedestal 234 includes a handle assembly 246, which facilitates moving mobile storage pedestal 234 from one location to another. Handle assembly 246 includes a pair of stationary receiver tubes 248, mounted one to each sidewall 238 of mobile storage pedestal 234 by means of a lower tube mount 250 and an upper tube mount 252. Lower receiver tube 248 is oriented at an angle, which may be 45°.

Handle assembly 246 further includes an extendible upper handle section 254, which includes a pair of depending side members 256 and a cross member 258 extending between and interconnecting the upper ends of side members 256. Each side member 256 may include an outwardly biased snap-type button which is selectively engaged within an opening in its associated receiver tube 248, for maintaining handle section 254 in an extended position shown in phantom, and a retracted position shown in solid lines.

Figure 20:
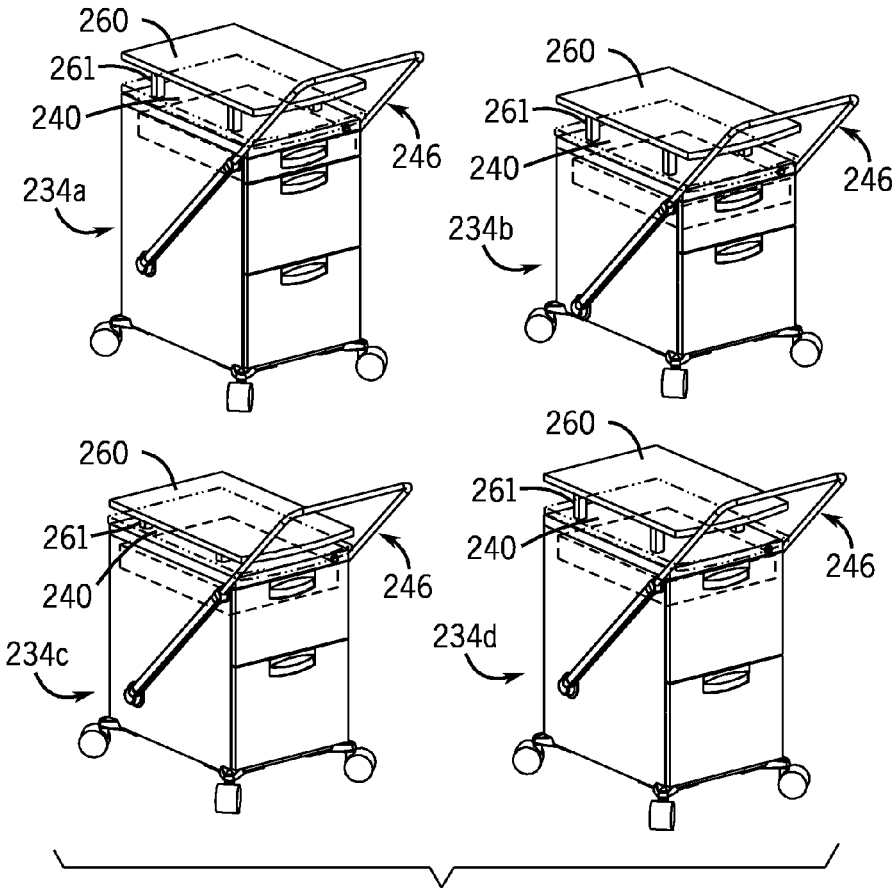
FIG. 20 is a view illustrating alternative versions of a mobile cabinet forming a part of the mobile furniture and accessory system of the present invention.

FIG. 20 illustrates various other mobile storage pedestal configurations, shown at 234*a*-234*d*. Mobile storage pedestal 234*a* has a height slightly greater than that of storage pedestal 234 with a three-drawer front, including a narrow pencil drawer at the top. An oversail top 260 is mounted to top wall 240 by support posts 261. Mobile storage pedestal 234*b* is constructed similarly to mobile storage pedestal 234, and includes oversail top 260 mounted to top wall 240 via support posts 261. Mobile storage pedestal 234*c* has a two-drawer front and a height slightly greater than that of mobile storage pedestal 234*b* but less than that of mobile storage pedestal 234*a*, and includes oversail top 260 mounted to top wall 240 via support posts 261. Mobile storage pedestal 234*d* has a height similar to that of mobile storage pedestal 234*a* but has a two-drawer construction. Oversail top 260 is mounted to top wall 240 via support posts 261.

Figure 21:
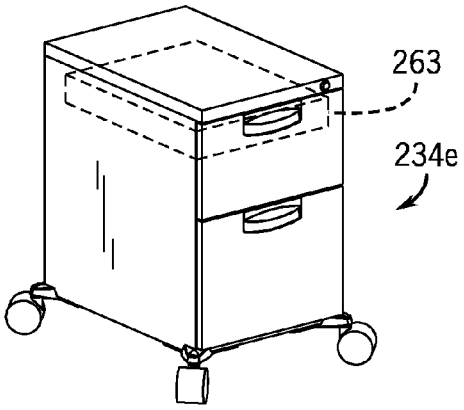
FIG. 21 is a view similar to FIG. 19, showing another embodiment of a mobile cabinet incorporated into the mobile furniture and accessory system of the present invention.

FIG. 21 illustrates a basic version of a mobile storage pedestal, shown at 234*e*, which is similar to mobile storage pedestal 234 but which is constructed without handle assembly 246. In any of the various configurations of mobile storage pedestal 234, the top drawer may include a conventional shallow internal drawer, such as shown at 263.

Figure 22:
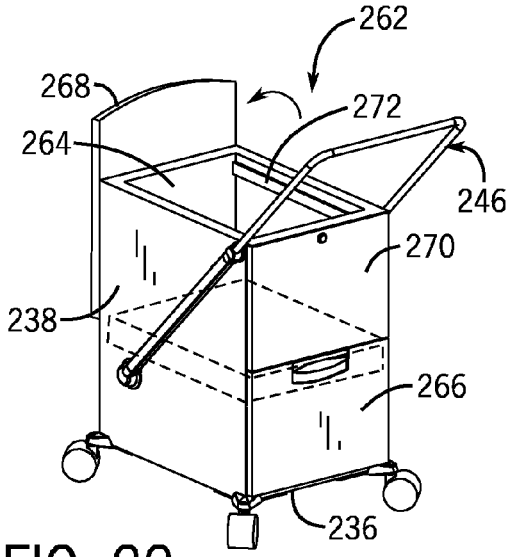
FIG. 22 is a view similar to FIGS. 19 and 21, showing another configuration of a mobile cabinet forming a part of the mobile furniture and accessory system of the present invention.

FIG. 22 illustrates an alternative mobile storage unit 262, which also incorporates casters 224 and a handle assembly 246. Mobile storage unit 262 includes bottom wall 236, sidewalls 238 and a back wall, shown at 264. A bottom drawer 266 is movably mounted between sidewalls 238 at the lower end of mobile storage pedestal 262. At its upper end, the top of mobile storage pedestal 262 is open. Mobile storage pedestal 234 includes a retractable top cover 268, which is movable between an open position as shown, for providing access to the open top of mobile storage pedestal 234, and a closed position in which top cover 268 overlies the upper ends of sidewalls 238, back wall 264 and a front panel 270 located above drawer 266. Rails 272 are mounted to the inside surfaces of sidewalls 238, and are adapted to support hanging file folders or the like within the open interior of mobile storage pedestal 262.

FIGS. 23 and 24 illustrate a low profile lateral-type mobile storage unit 274, which is well suited for placement under a worksurface or the like. Storage unit 274 includes a bottom wall 276, sidewalls 278 and a top 280, as well as a back wall (not shown). A pair of drawers 282, 284 are movably mounted between sidewalls 278, in a known manner. An oversail top 283 may be mounted above top 28 or via support posts 285.

Casters 224, which are located at the bottom corner of binder tower 208 and mobile storage pedestal 234, are oriented at an 85° angle relative to the floor, to improve tracking of the caster wheels during movement.

Paper Management Components

FIG. 25 illustrates a series of differently sized plastic bins 286*a*, 286*b*, 286*c*, which can be used in the various storage units illustrated in FIGS. 3-24. Bins 286*a*, 286*b*, 286*c* are formed of sheet plastic material which is die cut, scored, folded and sonic welded to form a bin having a closed bottom and a series of upstanding sides, and defining an open top. Bins 286*a*, 286*b*, 286*c* are adapted to receive papers or other materials to be grouped together for storage.

FIGS. 26 and 27 show a bin 288, which defines a closed bottom and a series of upstanding walls, including a pair of sidewalls 290 and end walls 292. Bin 288 may be formed of a plastic material in an injection molding process, although it is understood that other materials and forming methods may be employed. Bin 288 corresponds to paper management bin PB shown and described previously. Each end wall 292 defines an outwardly extending edge 294 toward its upper end. In addition, each sidewall 290 terminates in an upper edge and includes an outwardly extending flange 296 having a downwardly extending lip 298.

Figure 28:
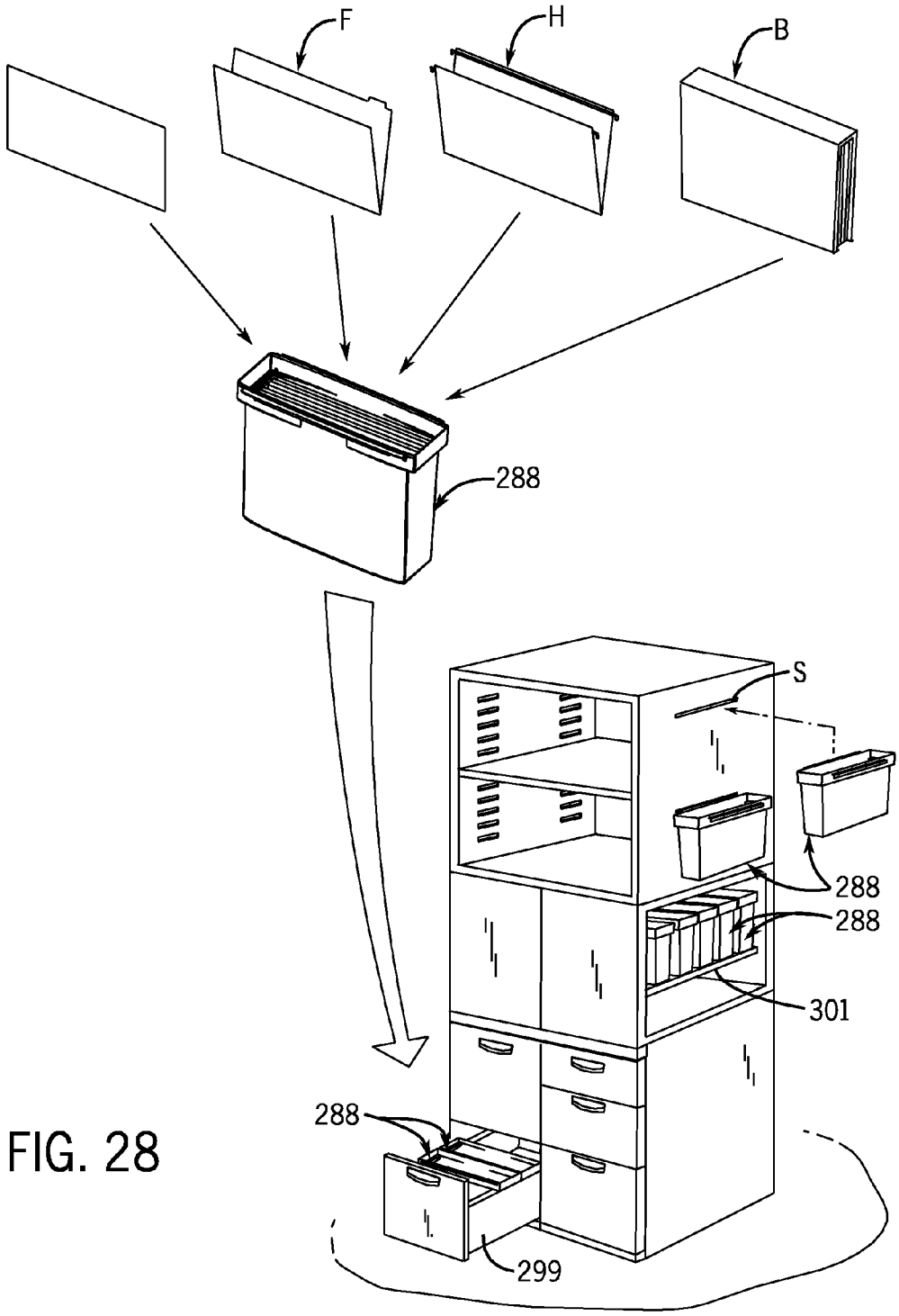
FIG. 28 is an isometric view illustrating a storage bin and its use in connection with an associated storage cabinet forming a part of the mobile furniture and accessory system of the present invention.

As shown in FIG. 28, edges 294 of bin end walls 292 are adapted to rest on upper edges defined by drawer sidewalls 299 of the storage units, for suspending bin 288 within the drawer. Alternatively, bins 288 can be supported simply by placement on a shelf 301 or other supporting surface, in a conventional manner. Bins 288 may also be hung on the side of a storage unit, by engagement of lip 298 within a slot S formed in the storage unit sidewall. Alternatively, lip 298 may be engageable with a hanger member mounted to the storage unit sidewall, to suspend bin 288 from the exterior of the storage unit.

FIG. 28 illustrates the types of materials which can be stored within a bin such as 288. Such materials include paper, conventional file folders F, hanging file folders H and binders B. As shown in FIG. 27, an internal rib 300 is formed at the upper end of each end wall 292, at the location where edge 294 extends outwardly from end wall 292. Each rib 300 is adapted to receive a support hook associated with a hanging-type file folder H, to suspend folder H within the interior of bin 288.

Figure 29:
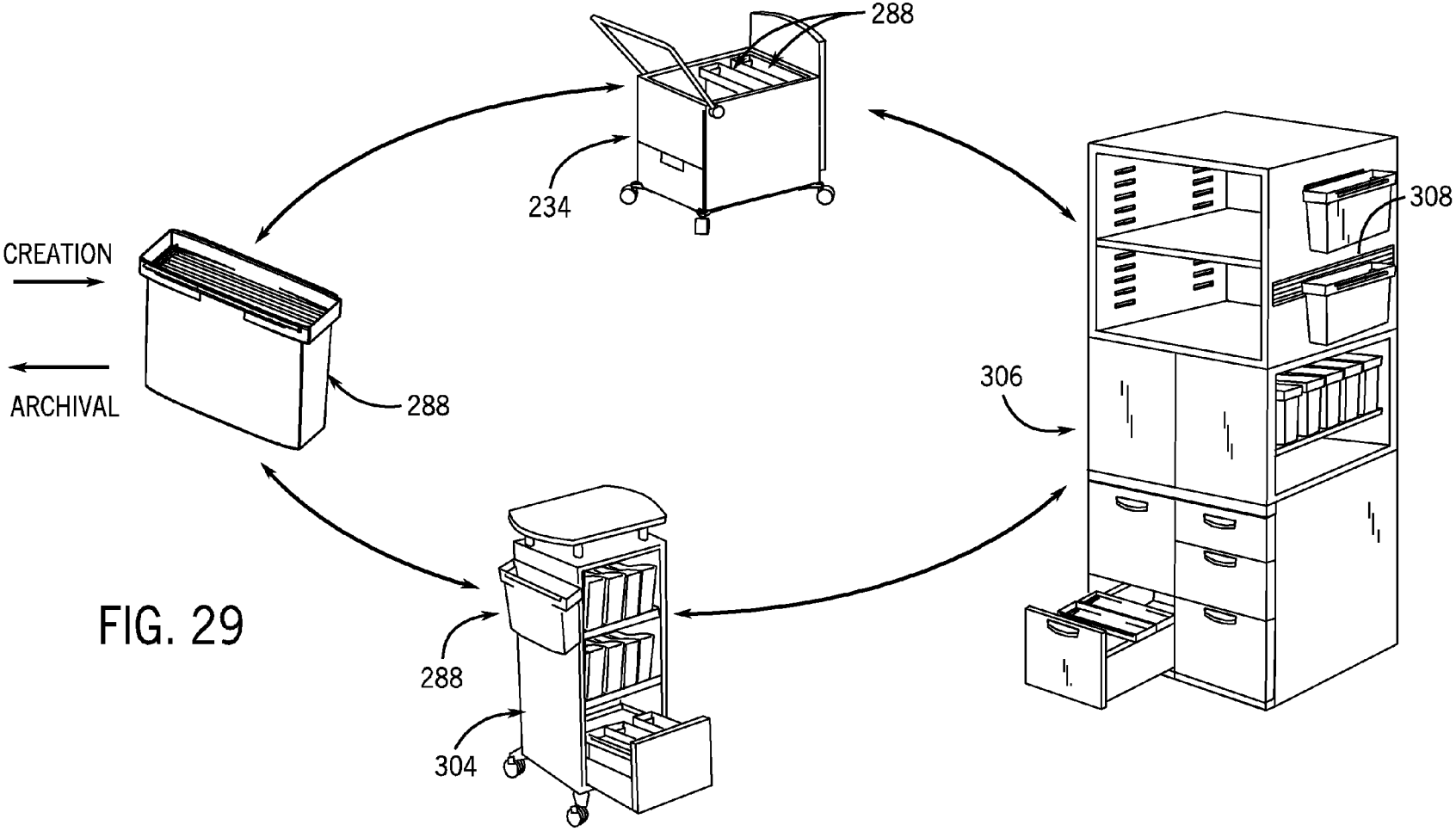
FIG. 29 is a view illustrating use of the bin and storage components incorporated into the mobile furniture and accessory system of the present invention.

FIG. 29 illustrates work flow utilizing the bin-type storage system used in combination with the various storage units of the present invention. Documents or other materials are placed within the bins such as 286, 288, which can be stored in or hung on a personal mobile storage pedestal 234, a workstation or semi-mobile storage unit, shown at 304, which may be configured using the modular type or binder tower construction as described previously, as well as in a team or semi-permanent storage unit 306 which also may be constructed using the modular storage unit construction as described previously. A tool rail 308 may be mounted to a sidewall of storage unit 306.

Lip 298 of bin 288 may be engaged with a slot S in the storage unit sidewall or with one of the slots in tool rail 308, for supporting the bin 288 on the exterior of the storage unit. The bins such as 286, 288 can then be removed from the active work area and used to store materials in conventional archive or permanent storage units.

Referring to FIGS. 26 and 27, lip 298 is formed by each flange 296 at the upper end of each bin sidewall 290. A bin cover 312 defines a top panel 314 and a pair of inwardly facing channels 316 located at opposite sides of top panel 314. Each channel 316 is configured so as to receive a flange 296 and its associated lip 298 in a sliding-type fashion, such that bin cover 312 can be slid onto the upper end of bin 288 to enclose the contents of bin 288. Alternatively, bin cover 312 can be mounted to the underside of a shelf or other horizontal wall associated with a storage unit. Bin cover top panel 314 includes holes 318, which are adapted to receive fasteners for connecting bin cover 312 to a horizontal member using threaded fasteners such as screws. In this manner, bin cover 312 is stationary mounted to the horizontal member, and bin 288 can be stored within the storage unit by sliding bin flanges 296 and lips 298 into engagement with channels 316, such that bin 288 is suspended from bin cover 312. Alternatively, holes 318 and slots 320 in bin cover 312 can be used to mount a strap or a handle to bin cover 312. In this manner, bin 288 can be transported with bin cover 312 attached, by carrying the bin using the attached strap or handle.

Mobile Screen Components

Figure 30:
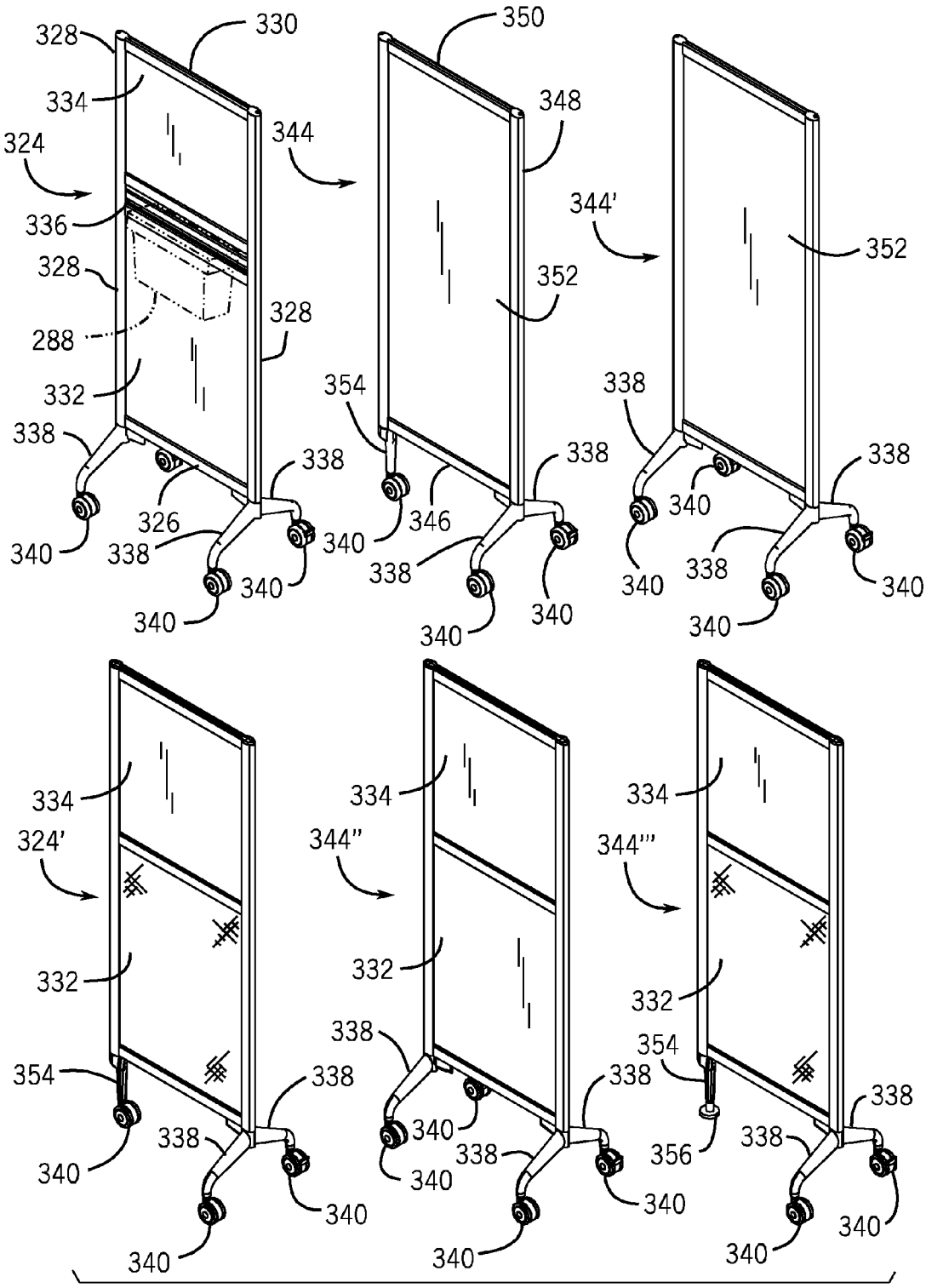
FIG. 30 is an isometric view showing various versions of a movable screen or partition forming a part of the mobile furniture and accessory system of the present invention.

FIG. 30 illustrates mobile screens incorporated into the mobile furniture and necessary system of the present invention. The screens of FIG. 30 correspond to screens or partitions P, described previously. In a first version, a screen or panel 324 includes a rectangular frame having a bottom frame member 326, upstanding side frame members 328 and a top frame member 330. Frame members 326-330 define an open interior, within which a variety of components can be mounted. In screen or panel 324, an acoustic panel 332 is mounted in the lower interior area defined by the frame, and a marker board 334 is mounted within the upper internal area defined by the frame. A tool rail 336 is mounted between acoustic panel 332 and marker board 334.

At the lower end of each side frame member 328, a pair of legs 338 extend outwardly in opposite directions, and a caster 340 is mounted to the lower end of each leg 338. The spacing of casters 340 provided by legs 338 imparts stability to panel 324, to prevent panel 324 from tipping.

In another version, a panel 344 is constructed similarly to panel 324, including a bottom frame member 346, a pair of side frame members 348, and a top frame member 350. Panel 344 is shown as having a full-height marker board panel 352, although it is understood that any other type of interior panel components may be employed. As with panel 324, legs 338 extend outwardly in opposite directions from the lower end of one of panel side frame members 348, and a caster 340 is mounted to the end of each leg 338. The opposite side frame member 348 includes a single downwardly extending leg 354 which terminates at its lower end in a caster 340. Panel 344 thus has a three-point stance. Other alternative versions include a panel 344' having a full-height marker board panel 352 (which may also be an acoustic or translucent panel), and including legs 338 and casters 340 at both ends. An alternative version 324' includes a lower acoustic panel 332 and an upper marker board panel 334 (which may also be a translucent panel), with a leg and caster structure similar to that of panel 344. A further alternative panel 344" includes a lower acoustic or translucent panel 332 and an upper marker board or translucent panel 334, in combination with the same leg and caster structure as panel 344'. Another alternative panel 344", includes a lower acoustic or translucent panel 332, an upper translucent or marker board panel 334, and a pair of legs 338 and caster 340 at one end. At the opposite end, a glide 356 is mounted to the lower end of leg 354. It is understood that the illustrated and described panel configurations are representative of any number of types of materials and components that can be incorporated into the panel.

Figure 32:
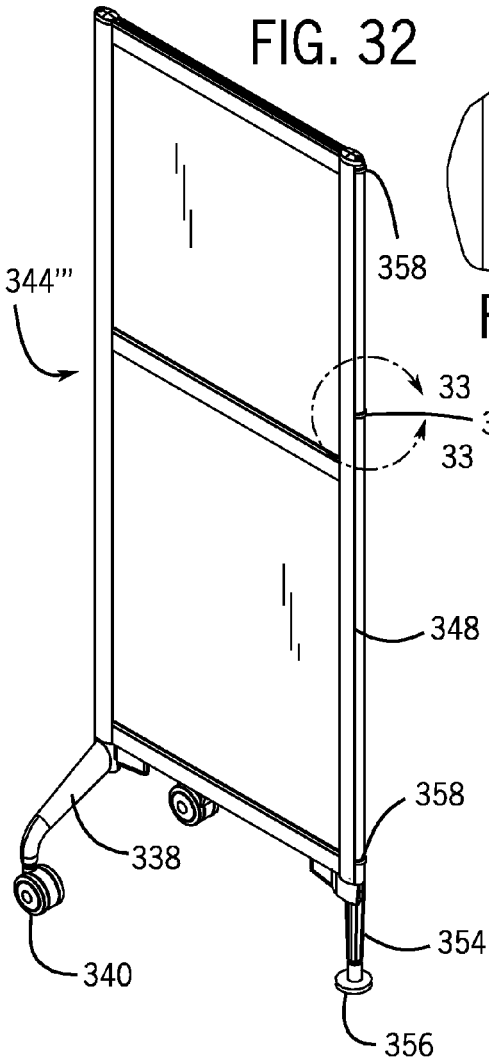
FIGS. 31 and 32 are isometric views illustrating embodiments of a screen incorporated into the mobile furniture and accessory system of the present invention.
Figure 33:
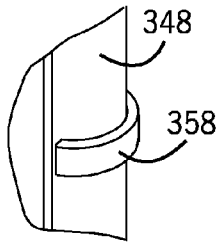
FIG. 33 is an enlarged partial elevation view with reference to line 33-33 of FIG. 32.
Figure 31:
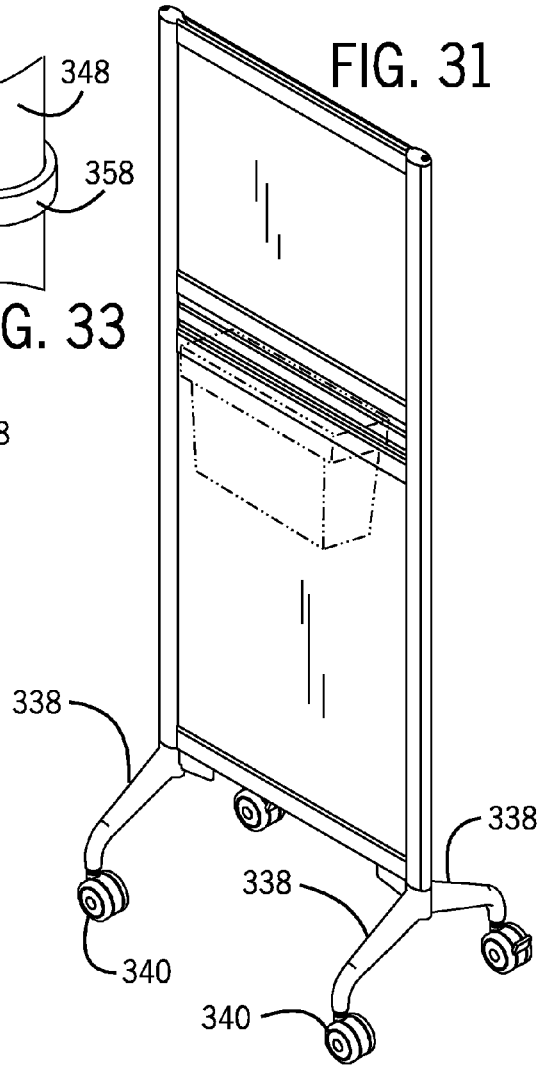
Figure 34:
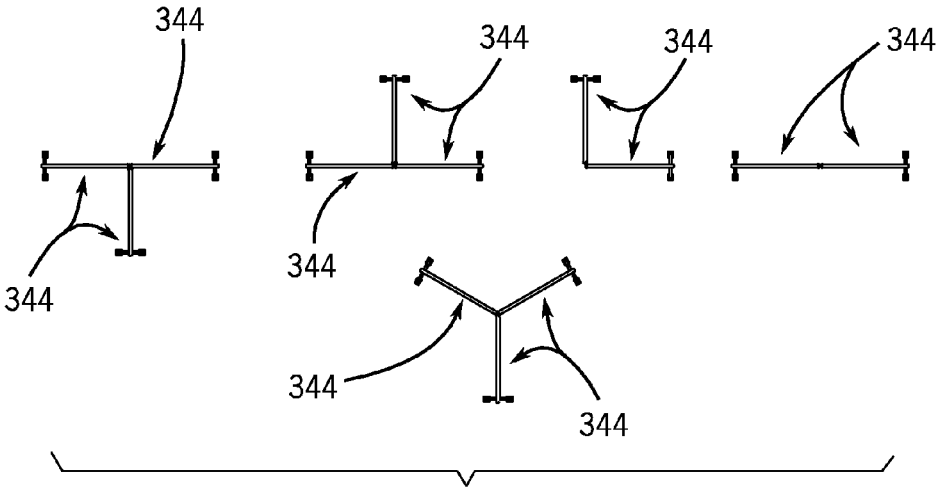
FIG. 34 is a top plan view illustrating different configurations which can be attained using the screen of FIG. 32.

A number of panels like those illustrated in FIG. 30 can be connected together in various configurations, as shown in FIG. 34. As a means of interconnecting the panels together, a series of magnets 358 (FIGS. 32, 33) may be mounted to one or both of side frame members 348 along its length. Each magnet 358 has a rounded face, which allows panels such as 344''' to be connected together at any angular position relative to each other. Any desired number of panels 344 can be connected, and examples are illustrated in FIG. 34.

Magnets 358 may be mounted to one or both of side frame members 348. Typically, however, magnets 358 are mounted to a side frame member 348 which is located above a downwardly extending leg 354 having either a caster 340 of a glide 356 at its lower end. When the panels are secured together as shown in FIG. 34, use of panels with leg 354 facilitates connection of the panels together, since the presence of legs 338 typically prevents movement of the panels to varying angular orientations relative to the each other.

When not in use, the panels can be nested together for storage. The downwardly extending angle of legs 338 facilitates movement of the panels together in a side-by-side orientation, such that the legs 338 of one panel extend below the bottom frame member 346 of the adjacent panel.

FIGS. 35 and 36 illustrate a marker board cart panel 362 having a similar construction as panel 324 described previously, including bottom frame member 326, side frame members 328 and top frame member 330. Marker board cart panel 362 includes a top interior panel 364, which may be a marker board or any other type of panel, and a bottom interior panel 366, which also may be a marker board panel or an acoustic or other type of panel. A tool rail 368 is located between top and bottom panels 364, 366, and includes a slot for mounting a tray 370. Tool rail 368 may also be used to mount bin 288. A marker board storage rack 372 is mounted to the frame of marker board cart panel 362, and is adapted to store a series of marker boards 374. Rack 372 includes a bottom support wall 376, and at least a pair of upwardly extending vertical supports 378 having transverse sections 380, all of which cooperate to define a pocket within which the lower portions of marker boards 374 are received. In use, marker boards 374 can be removed from rack 374 for use, and then returned to rack 372 for storage.

Marker Board Components

FIGS. 35 and 37-46 illustrate the construction of the marker board, such as 374 incorporated in the mobile furniture and accessory system of the present invention. The marker boards such as 374 correspond to marker boards M as described previously.

Each marker board 374 includes a core 382, which may be formed of any satisfactory material such as a relatively thin (e.g. ⅜ inch thick) foam core, which is preferably die cut to obtain the desired shape. A thin plastic sheet 384, which may be formed of any satisfactory plastic material such as polyethylene, is applied to both surfaces of foam core 382 in any satisfactory manner, such as by use of an adhesive. Sheet 384 may be of any satisfactory thickness, such as 0.020 inches. The outwardly facing surface of sheet 384 forms a dry erase marker surface for marker board 374, in a manner as is known.

Foam core 382 is cut to define an eraser retaining recess 386 as well as a pair of slots 388, which are configured to grip a dry erase marker in a manner to be explained. Sheet 384 is die cut to a shape similar to that of foam core 382, and defines an outer edge which is located slightly inward of the outer edge of foam core 382 throughout the periphery of foam core 382. Sheet 384 further includes a pair of openings 389 which surround slots 388.

A pair of hanging clip assemblies 389 are mounted to the upper edge of marker board 374.

FIGS. 37 and 45-47 illustrates the configuration of slots 388 in greater detail. Each slot 388 includes a main section 392 and a pair of end sections 394, each of which extends outwardly from one end of main section 392. Main section 392 is generally rectangular, and each end section 394 has a truncated triangular shape. Main section 392 of each slot 388 has a height which is slightly less than the diameter of a conventional large dry erase marker, such as shown at 396. In this manner, marker 396 can be pushed lengthwise into main section 392, which has a length slightly greater than the length of dry erase marker 396. The dry erase marker cap typically includes a protrusion 398 which accommodates the marker tip, which is received within one of slot end sections 394. The resiliency of foam core 382 allows the edges of slot 388 to flex outwardly as necessary so as to conform to the shape of marker 396 and to grip marker 396 within slot 388. In this manner, marker 396 can be stored within slot 388 when not in use.

Alternatively, as shown in FIGS. 46 and 47, a series of dry erase markers 396 can be inserted transversely into slot main section 392, such that each marker 396 extends outwardly from the front surface of marker board 374. In this manner, several markers 396 can be engaged within each slot 388, to enable a user to store a number of markers, e.g. markers of different colors, which are conveniently accessible when needed to mark on marker board 374.

As shown in FIG. 45, slots 388 are also able to accommodate thin dry erase markers, such as shown at 400. Thin dry erase markers 400 typically have a length greater than that of large dry erase markers 396. Slot end sections 394 are configured to engage the ends of thin dry erase markers 400. Again, the resiliency of foam core 382 enables the edges of slot end sections 394 to grip the ends of marker 400, so as to maintain marker 400 within slot 388.

Figure 39:
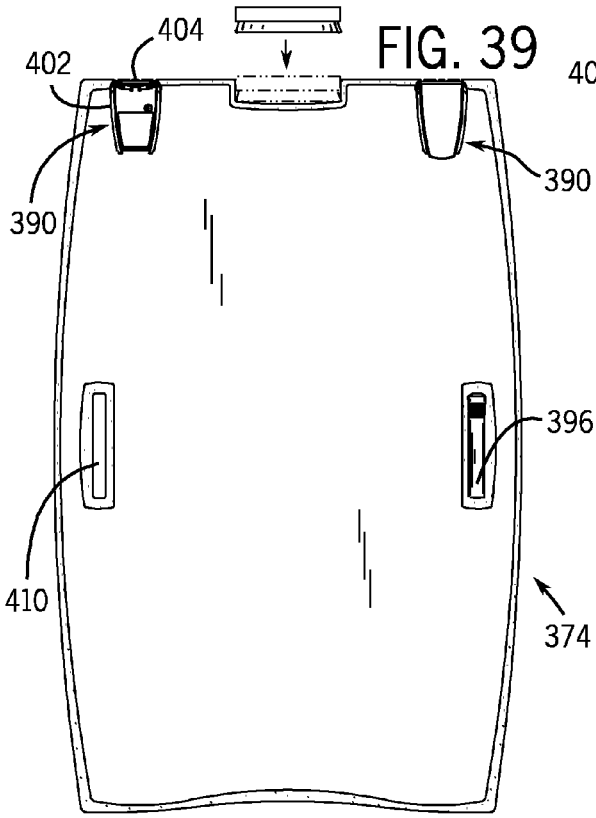
FIG. 39 is an elevation view showing one side of the marker board of FIG. 38.
Figure 38:
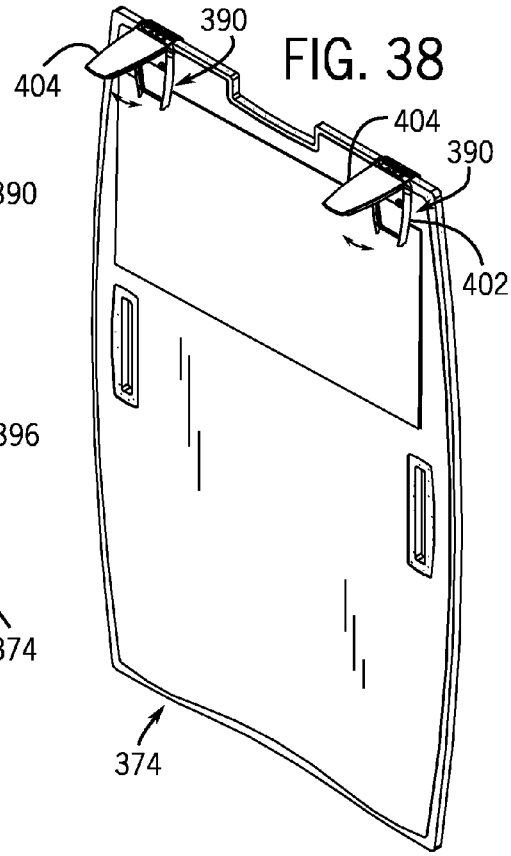
FIG. 38 is an isometric view of a marker board forming a part of the mobile furniture and accessory system of the present invention.

In an alternative construction, the slots may be configured so as to accept only a large dry erase marker (as shown in FIGS. 38 and 39) or only a thin dry erase marker. However, the illustrated embodiment provides use of a single slot configuration for accommodating two distinct types of markers.

Further, while only a pair of slots are shown, it is understood that any number of slots could be formed in marker board 374 to accommodate any desired number of markers.

FIGS. 38-44 illustrate clip assemblies 390, and the manner in which clip assemblies 390 are employed to support a marker board 374. Each clip assembly 390 includes a pair of body sections 402, which are located on opposite sides of marker board 374. Body sections 402 are secured to each other with foam core 382 and sheets 384 sandwiched therebetween.

A hanger section 404 is pivotably mounted at the upper end of each body section 402. Each hanger section 404 is pivotable between an open position, as shown in FIG. 38, and a closed position as shown in FIG. 35. When in the open position, the hanger sections 404 on the rear side of marker board 374 are used to hang marker board 374 from any satisfactory horizontal support surface, such as the upper edge of a cubicle panel, the edge of a cabinet, top frame member 330 of marker board cart panel 362, a top frame member 330, 350 of a panel, etc. In this manner, marker board 374 can easily be hung from any satisfactory support surface in any location, and removed when needed for storage or for replacement with another marker board 374. When not in use, hanger sections 404 are pivoted to the closed position to allow for compact storage of marker boards 374. Each hanger section 404 may be provided with a gripping material (such as rubber) in its underside, to facilitate engagement of hanger section 404 with a support surface.

The forwardly facing hanger sections 404 can be opened to enable a sheet of paper or the like to be engaged between the surface of marker board 374 and body section 402. Hanger section 404 is used as a lever to create a separation between the surface of marker board 374 and the underside of body section 402, to enable a sheet of paper to be inserted therebetween. Alternatively, the user may lift body section 402 away from the surface of marker board 374 by engaging a fingertip below an inwardly extending surface 405 defined by the lower end of body section 402, to create the required separation between body section 402 and the surface of marker board 374. In either case, body section 402 functions to grip the sheet of paper when the outward force thereon is removed, to releasably maintain the sheet of paper in engagement with maker board 374. FIG. 44 illustrates the manner in which body section 402 is raised relative to the surface of marker board 374, so as to insert a sheet of paper therebetween.

Figure 40:
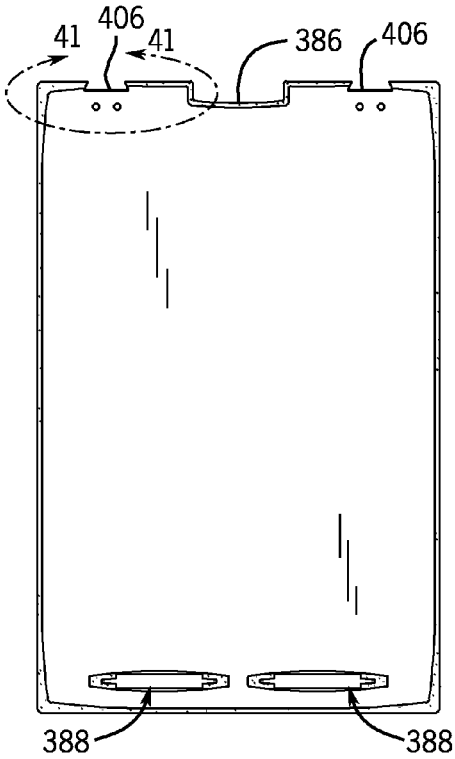
FIG. 40 is an elevation view of a marker board forming a part of the mobile furniture and accessory system of the present invention.
Figure 41:
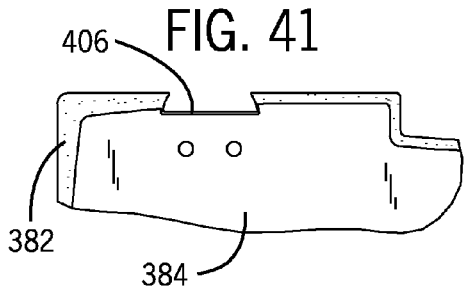
FIG. 41 is an enlarged partial elevation view with reference to line 41-41 of FIG. 40.

FIGS. 40 and 41 illustrate a rectangular marker board 374, and shows die cut recesses 406 which are adapted to receive hanging clip assemblies 390. FIG. 40 also shows recess 386 which is adapted to receive and retain a dry eraser 408 (FIG. 39). Marker board 374 of FIG. 39 includes a pair of rectangular slots 410, which are configured as described above so as to receive large dry erase markers, without the previously described end sections. In addition, slots 410 can be used as handles to facilitate handling of marker board 374.

FIG. 42 illustrates the manner in which a clip assembly 390 is used to suspend marker board 374 from a horizontal surface, shown generally at H, which may be defined by the top or a storage unit, the top of a wall panel, or any other horizontal surface adjacent a vertical surface against which marker board 374 can be positioned.

FIG. 42 illustrates hanger section 404 of clip assembly 390 extended, and a rubber pad 411 mounted to the underside of hanger section 404 located so as to engage horizontal surface H so as to frictionally maintain clip assembly 390 in engagement therewith.

FIG. 43 illustrates a system for mounting marker board 374 to a wall shown at 412. In this arrangement, a wall mount bracket 414 is secured to wall 412, and a hanger bracket 416 is engaged with wall mount bracket 414. Marker board 374 is suspended from hanger bracket 416 via engagement of bracket 416 by clip hanger section 404.

Wall mount bracket 414 defines a mounting section 418 which engages wall 412, and an upwardly extending hanger bracket engagement section 420 which is laterally offset from mounting section 418. Wall mount bracket 414 is secured to wall 412 using a series of anchors 422. Wall mount bracket 414 has any desired length according to the desired positions for hanging marker boards 374 on wall 412.

Hanger bracket 416 includes an outer wall 424 and an inwardly extending lower spacer section 426 located at the bottom of outer wall 424, and which is adapted to engage wall 412. At its upper end, hanger bracket 416 includes an inner engagement lip 428. The upper end of wall mount bracket engagement section 420 and engagement lip 428 include snap-fit engagement structure, such as an axially extending inwardly facing recess formed in engagement section 420 and an outwardly extending rib formed on engagement lip 428. A web 430 extends inwardly from outer wall 424, and engagement lip 428 extends downwardly from the inner end of web 430. An upwardly and outwardly facing surface 432 is defined by web 430 at its inner end.

In operation, once wall mount bracket 414 is secured to wall 412 using anchors 422, hanger bracket 416 is positioned above wall mount bracket 414 and moved downwardly so as to initially bring engagement lip 428 into contact with engagement section 420 of wall mount bracket 414. The user then engages the tip of a screw driver or other similar tool with surface 432, and applies a downward pounding force, such as using a mallet, on surface 432. This causes engagement lip 428 to snap fit into engagement with engagement section 420, to secure hanger bracket 416 to wall mount bracket 414.

Once hanger bracket 416 is mounted to wall 412 in this manner, marker board 374 can be mounted to hanger bracket 416 by placing hanger sections 404 of hanger clip assemblies 390 in their closed positions, and moving marker board 374 downwardly so as to bring hanger sections 404 into contact with an upward extension, shown at 434, defined by hanger bracket outer wall 424. Each hanger section 406 includes a downwardly extending end protrusion 436, which is located within the space between extension 434 and wall 412, for providing a positive engagement of marker board 374 with hanger bracket 416. In order to remove marker board 374, the user exerts an upward force so as to dislodge protrusions 436 from behind outer wall extension 434.

Figure 48:
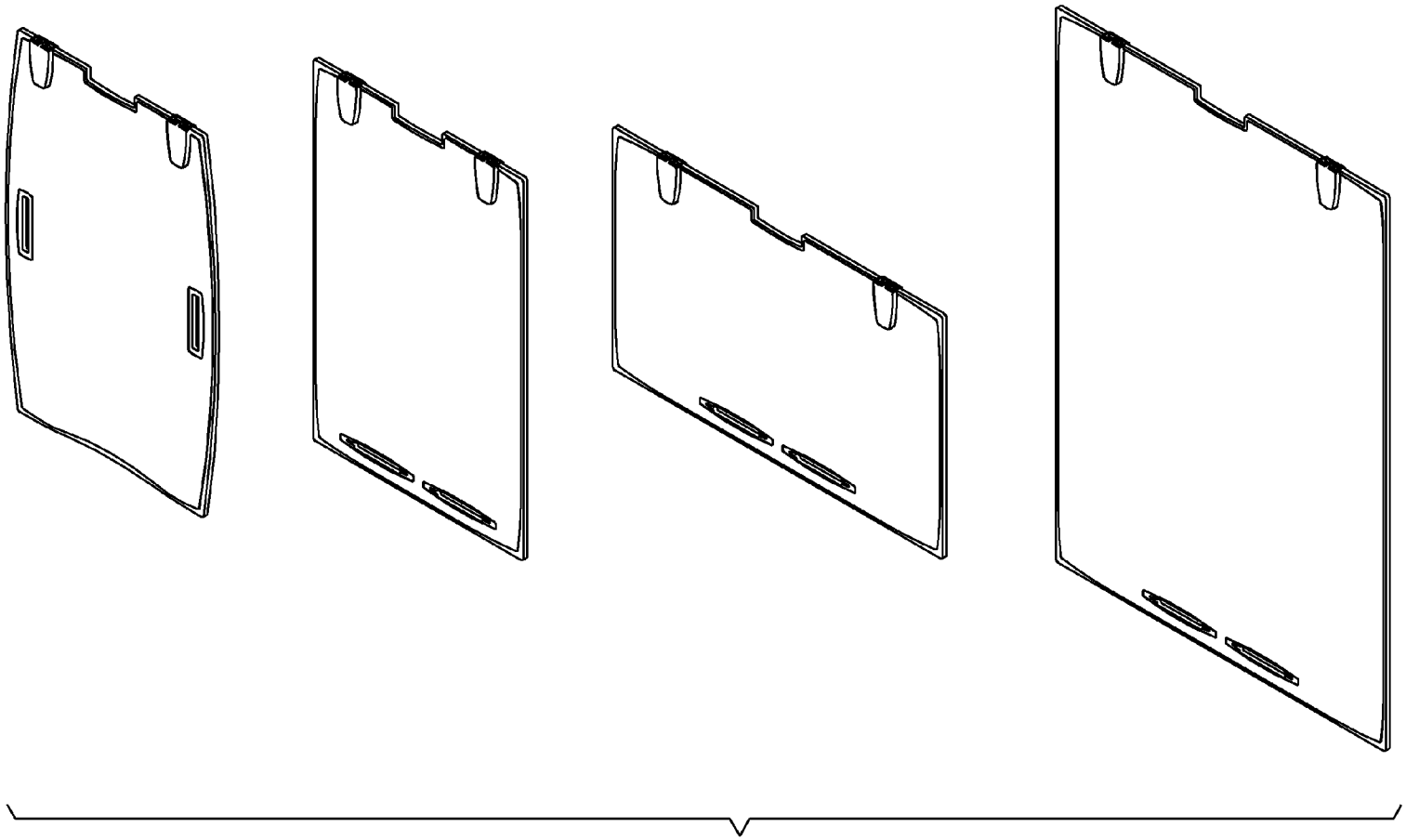
FIG. 48 is an isometric view illustrating various shapes and sizes of marker boards forming a part of the mobile furniture and accessory system of the present invention.

FIG. 48 illustrates different styles of marker boards that can be incorporated in the mobile furniture and accessory system of the present invention. The marker boards of FIG. 48 are constructed as shown and described, and provide different sizes and shapes according to user requirements and intended usage.

Table or Desk Components

Figure 49:
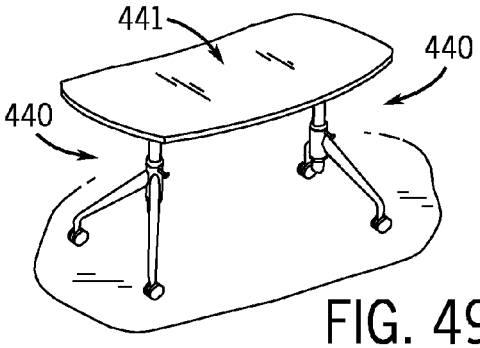
FIG. 49 is an isometric view of a representative table incorporated into the mobile furniture and accessory system of the present invention.
Figure 50:
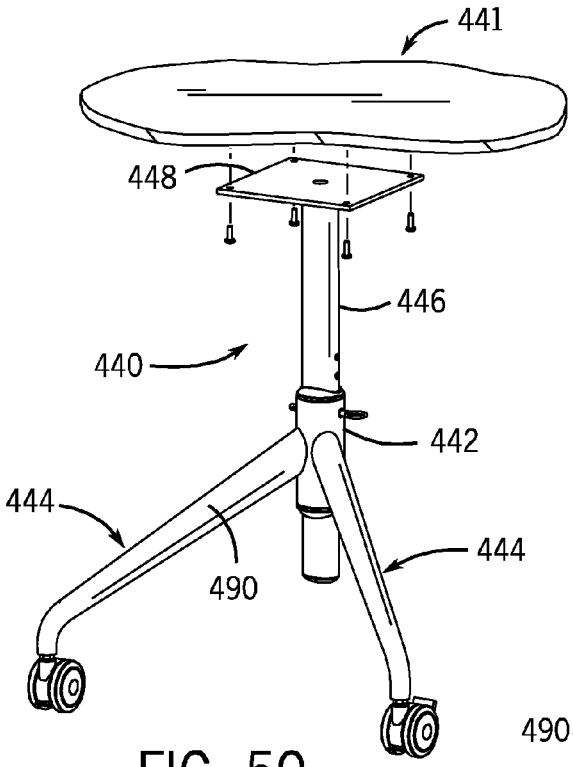
FIG. 50 is a partial isometric view showing one of the legs and a portion of the table top of the table of FIG. 49.

Another aspect of the mobile furniture system of the present invention contemplates a mobile table or desk system which provides work surfaces which can easily be moved to various locations within a workspace. The table or desk components generally correspond to tables or desks $T_1$, $T_2$ as illustrated in FIG. 1, and as shown in FIG. 49.

Referring to FIGS. 49-52, the table system of the present invention utilizes an adjustable height table base assembly 440 which is adapted to support a table top, representatively shown at 441. In a typical construction, a pair of table base assemblies 440 are mounted below table top 441 in a symmetrical manner, to support table top 441 above a supporting surface such as a floor.

Figure 51:
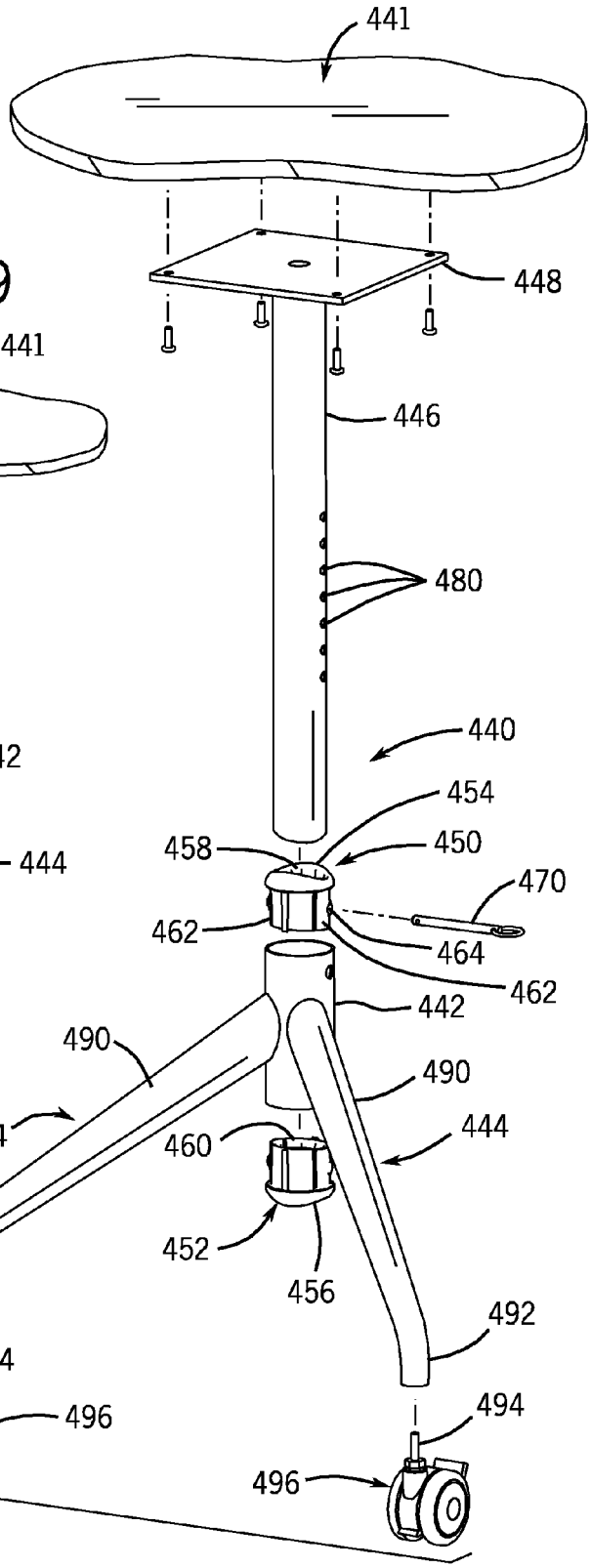
FIG. 51 is an exploded isometric view of the components of the table leg of FIG. 50.

Table base assembly 440 includes a cylindrical sleeve or collar 442 to which a pair of legs 444 are mounted. Legs 444 may be splayed as shown, or may be in alignment with each other. A table support column or post 446 is engaged with collar 442, and a mounting plate 448 is connected to the upper end of column 446. Openings are formed in mounting plate 448, and are adapted to receive fasteners such as screws for mounting table top 441 to mounting plate 448. As shown in FIG. 51, collar 442 is in the form of an open-ended tubular member. A top bushing 450 is engaged within the open upper end of collar 442, and a bottom bushing 452 is engaged within the open lower end of collar 442. Bushings 450, 452 may be mounted to collar 442 in any satisfactory manner, such as by a press-fit engagement with collar 442. Top bushing 450 defines an exposed upper end 454 having a downwardly facing shoulder which engages the upper edge of collar 442. Similarly, bottom bushing 452 has an exposed lower end 456 defining an upwardly facing shoulder which engages the bottom edge of collar 442. Top bushing 450 and bottom bushing 452 define aligned passages 458, 460, respectively. Passages 458 are non-circular in shape and correspond in shape to the cross section of column 446. In the illustrated embodiment, column 446 is in the form of a tubular member having an elliptical cross section, and passages 458, 460 are elliptical in shape and sized slightly larger than column 446, so as to receive column 446 therewithin. In this manner, column 446 is slidably movable within collar 442.

The depending wall of collar 450, shown at 462, includes a raised area 464 defining an opening 466. A similar raised area and opening are located on the opposite side of wall 462. Openings 466 are placed into alignment with a pair of openings 468 formed in the wall of collar 442 toward its upper end, and a pin 470 having a shaft 472 and a detent 474, is adapted to be inserted through openings 466, 468.

Bottom bushing 452 is similarly constructed. However, the raised areas of bottom bushing 452, shown at 476, are solid and do not have an opening therethrough.

Figure 52:
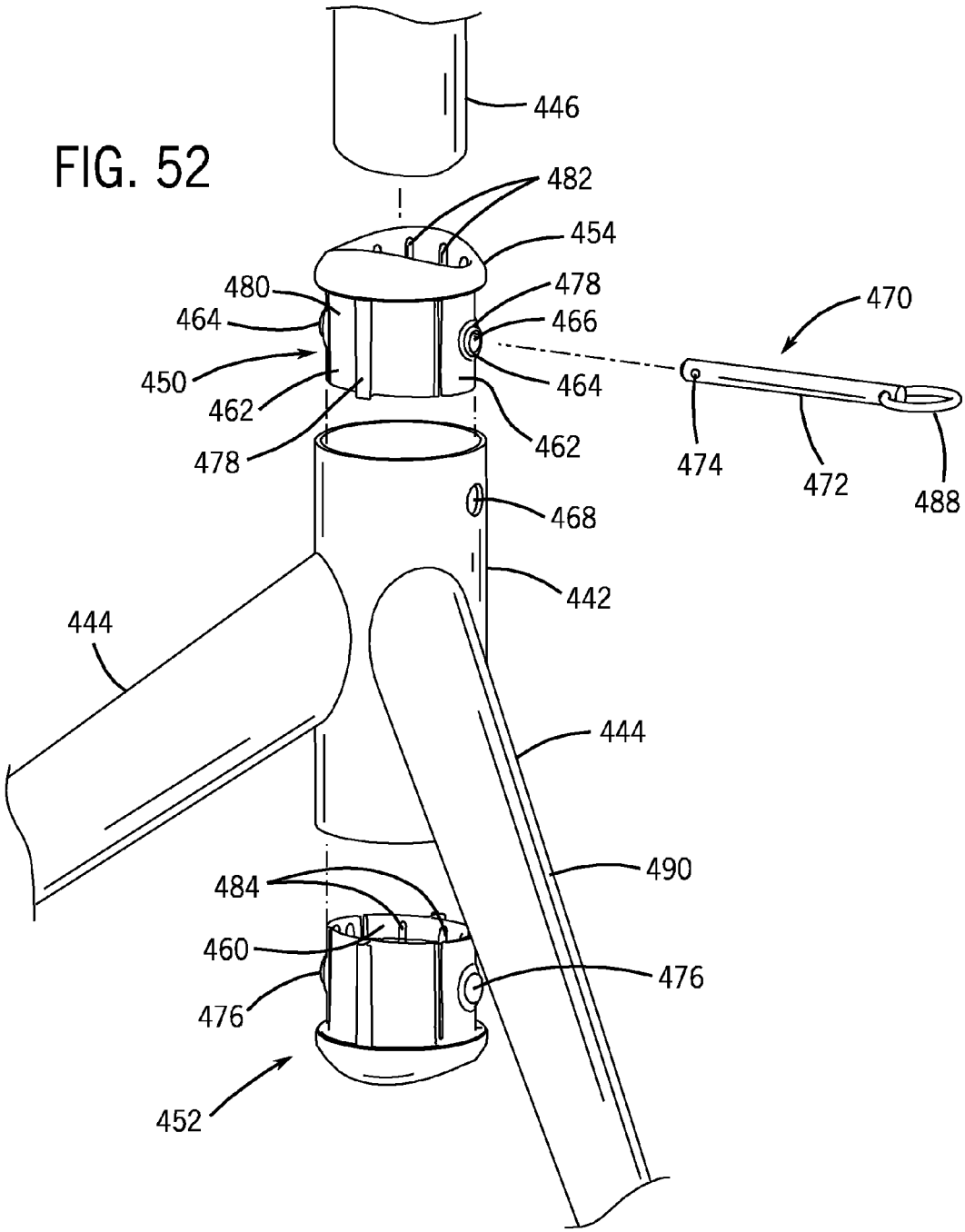
FIG. 52 is an enlarged partial isometric view showing portions of the table leg of FIG. 51.

As shown in FIG. 52, depending wall 462 of top bushing 450 extends downwardly from exposed upper end 454, and is segmented so as to be capable of flexing inwardly relative to exposed upper end 454. Raised area 464 defines a ring 478. With this arrangement, when top bushing 450 is pushed into the open upper end of collar 442, walls 462 of top bushing 450 are flexed inwardly. One or more external ribs 478 formed in opposed guide walls 480, which are separate from depending walls 462, provide engagement with the inner surfaces of collar 442, to provide a tight fitting engagement of top bushing 450 with collar 442. When top bushing 450 attains its fully engaged position, i.e. the shoulder defined by exposed upper end 454 engages the top edge of collar 442, raised areas 464 are positioned so as to align rings 478 with openings 468 in the wall of collar 442, and the resiliency of walls 462 snaps rings 478 into openings 468. This engagement of top bushing 450 with collar 442 places top bushing 450 in a proper predetermined alignment relative to collar 442 and thereby legs 444. Similar construction of bottom bushing 452 provides a snap-fit engagement of bottom bushing 452 with the lower end of collar 442. Bottom bushing 452 does not have openings such as 468 in raised areas 476. Rather, raised areas 476 have solid material defining a button 480, which snaps into aligned openings formed toward the lower end of collar 442.

The inner surfaces of bushings 450, 452 which define respective passages 458, 460, are provided with a series of axially extending guide ribs, such as 482, 484, respectively, which are configured to closely engage column 446 to prevent column 446 from wobbling relative to collar 442 when inserted within collar 442 and engaged with top and bottom bushings 450, 452, respectively.

Column 446 includes a series of aligned pairs of openings, such as shown at 480, in its walls. Each pair of openings 480 is adapted to be placed into alignment with collar openings 468, so as to receive shaft 472 of pin 470 to fix mounting plate 448 in a desired vertical position, according to user requirements. Pin 470 includes a finger engagement ring 488 which enables a user to easily withdraw pin 470. When a desired elevation of mounting plate 448 is obtained, the user inserts pin shaft 472 through collar openings 468 and aligned column openings 480, to fix column 446 in position relative to collar 442 and to thereby fix the vertical position of mounting plate 448 and table top 441 connected thereto.

Each leg 444 extends outwardly and downwardly from collar 442. Legs 444 are connected to collar 442 in any satisfactory manner, such as by welding, brazing or the like. Each leg 444 includes a primary upper support section 490 and a lower caster mounting section 492 which includes an upwardly extending opening adapted to receive the mounting stem 494 of a caster assembly 496. Caster mounting section 492 is preferably oriented so as to extend in a generally vertical direction. With this construction, table base assembly 440 is adapted to provide mobile support for a table top or other work surface connected to mounting plate 448.

The drawings illustrate a pair of legs 444 connected to and extending outwardly and downwardly from collar 442. It should be understood that any number of legs may be mounted to collar 442. Representatively, a single leg 444 may be mounted to collar 442, and can be used to provide support for table top or worksurface when one additional base assembly 440 having multiple legs 444 is also engaged with the table top or worksurface. Alternatively, several single-leg base assemblies can be mounted to the table top or worksurface at various locations to provide support for the table top or worksurface. When a pair of legs 444 are mounted to collar 442 as shown and described, another base assembly 440 having a single leg 444 or multiple legs 444 is also mounted to the table top or worksurface at a spaced location, to provide support for the table top or worksurface. Three or more legs 444 can be secured to a collar 442, for table configurations which require a single table base assembly 440. In applications such as this, three, four or five legs 444 can be mounted to collar 442, to provide stable and adequate support for the worksurface.

Figure 53:
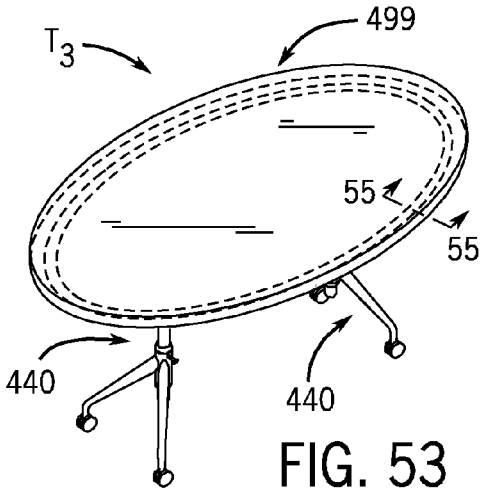
FIG. 53 is an isometric view of an alternative table top configuration for a table forming a part of the mobile furniture and accessory system of the present invention.
Figure 54:
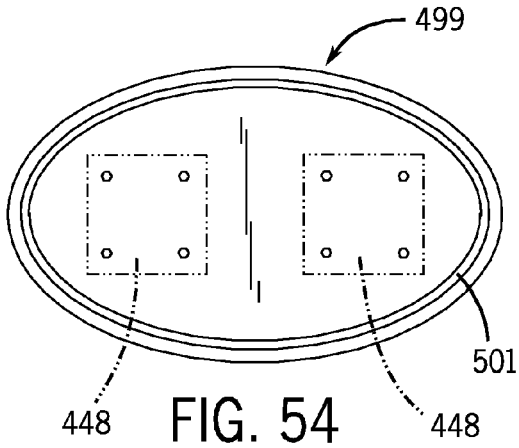
FIG. 54 is a bottom plan view of the table top of FIG. 53.
Figure 55:
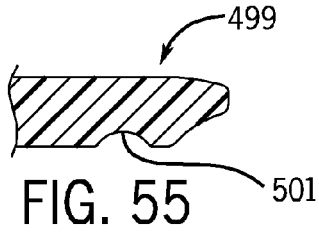
FIG. 55 is a partial section view taken along line 55-55 of FIG. 53.

FIG. 53 illustrates a representative table $T_3$ which can be produced using the modular table system of the present invention. Table $T_3$ includes a table top 499 which may have any satisfactory shape, e.g. an oval shape, and which has table base assemblies 440 secured to its underside in spaced locations for providing support to table top 499 in a manner similar to that of table top 441 of FIG. 49. FIG. 54 illustrates the locations at which mounting plates 448 of base assemblies 440 are to be secured to the underside of table top 499. As shown in FIG. 55, table top 499 includes a peripheral groove 501 in its underside, which provides a recess within which the user's fingers are received when gripping the edge of table top 499 so as to move table $T_3$ from one location to another.

Figure 56:
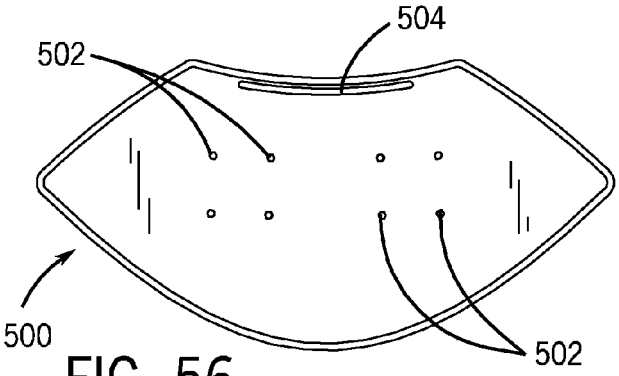
FIGS. 56-59 are top plan views of representative alternative table top configurations for the table forming a part of the mobile furniture and accessory system of the present invention.
Figure 57:
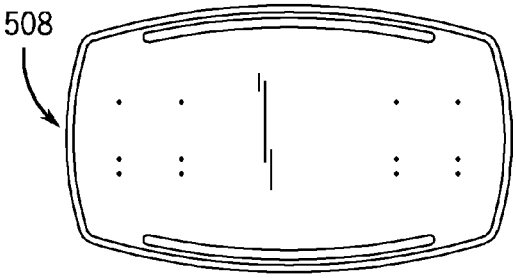
Figure 59:
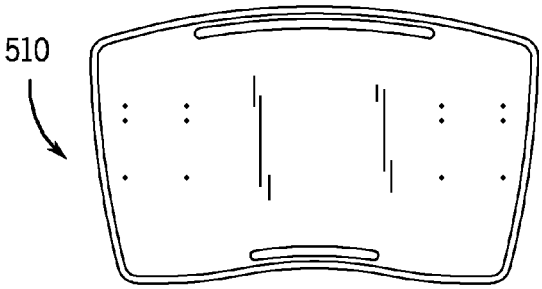

FIG. 56 illustrates a corner table top or worksurface 500 which is adapted to be supported by a pair of table base assemblies 440. Worksurface 500 includes a series of predrilled passages 502 in its underside, which are adapted to receive screws extending through the openings in mounting plate 448 so as to mount worksurface 500 to each table base assembly 440. Worksurface 500 is formed with a groove 504 in its underside adjacent its inner edge, which provides a finger grip area for the user to facilitate gripping of worksurface 500 when it is desired to move the table assembly on the floor or other supporting surface. FIG. 57 illustrates a worksurface 508 with two sets of predrilled passages and grooves along both sides, to facilitate gripping of worksurface 508 from either side during movement FIG. 59 shows a differently shaped worksurface 510, again including two sets of predrilled mounting passages and grooves at both edges.

Figure 58:
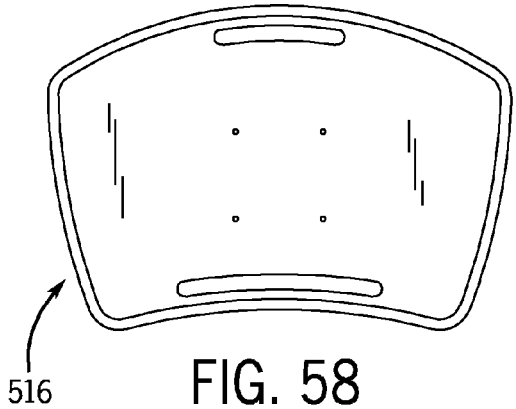
Figure 60:
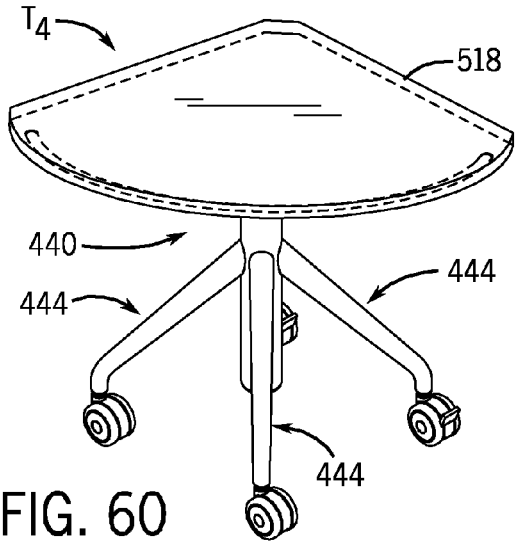
FIG. 60 is an isometric view of an adjustable height stand or table forming a part of the mobile furniture and accessory system of the present invention.
Figure 61:
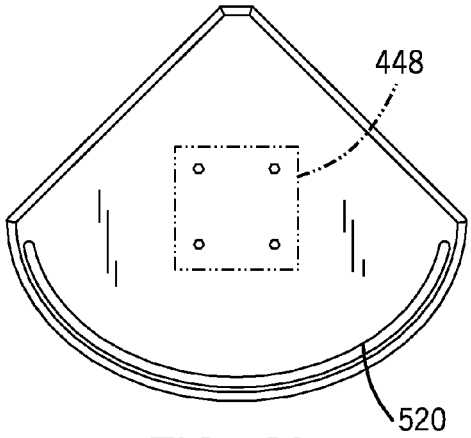
FIG. 61 is a bottom plan view of the table top of the table of FIG. 60.
Figure 62:
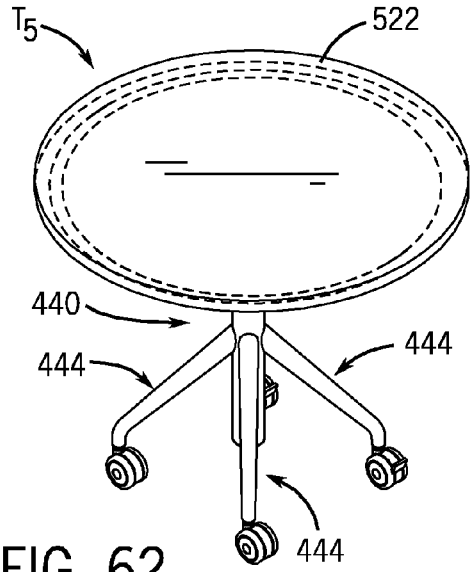
FIG. 62 is an isometric view of another embodiment of an adjustable height table similar to the adjustable height table of FIG. 60.
Figure 63:
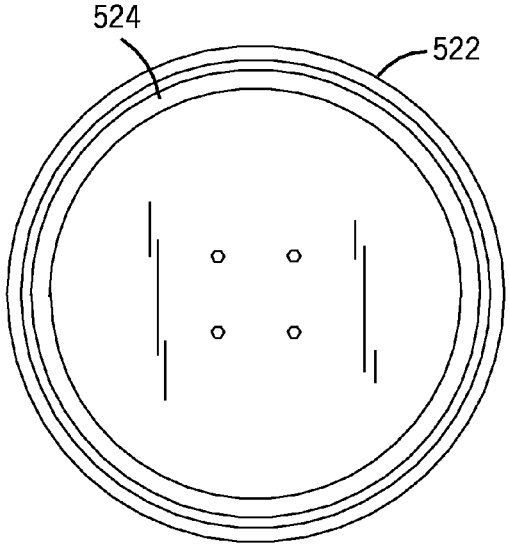
FIG. 63 is a bottom plan view of the table top of the table of FIG. 62.

FIG. 58 shows a short worksurface 516 having a single set of mounting passages for mounting a base assembly 440 having at least three legs 444. Worksurface 516 includes a groove in its underside at both edges of the underside. FIG. 60 illustrates an alternative version of a table, shown at $T_4$, which includes a ledge-shaped table top 518. Base assembly 440 of table $T_4$ includes four legs 444, for providing stable support of table top 518. A groove 520 is formed in the underside of table top 518 toward its curved front surface, to facilitate gripping of table top 518 for movement by a user. FIG. 62 illustrates another alternative table, shown at $T_5$, having a round table top 522 and a four-legged base 440. Table top 522 has a groove 524 that extends about the entire periphery of its underside.

Figure 64:
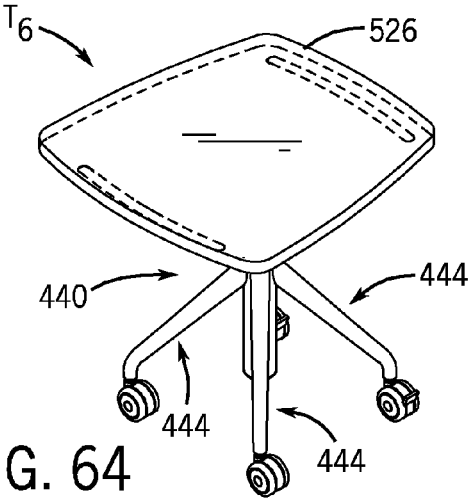
FIG. 64 is an isometric view of another embodiment of an adjustable height table similar to the table of FIG. 60.
Figure 65:
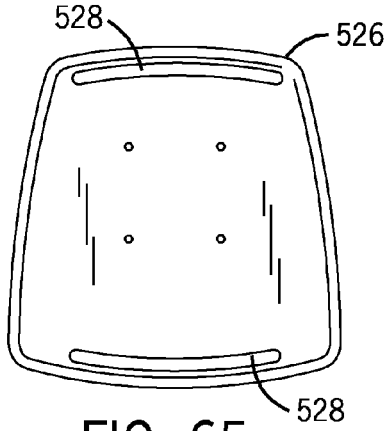
FIG. 65 is a bottom plan view of the table top of the table of FIG. 64.
Figure 66:
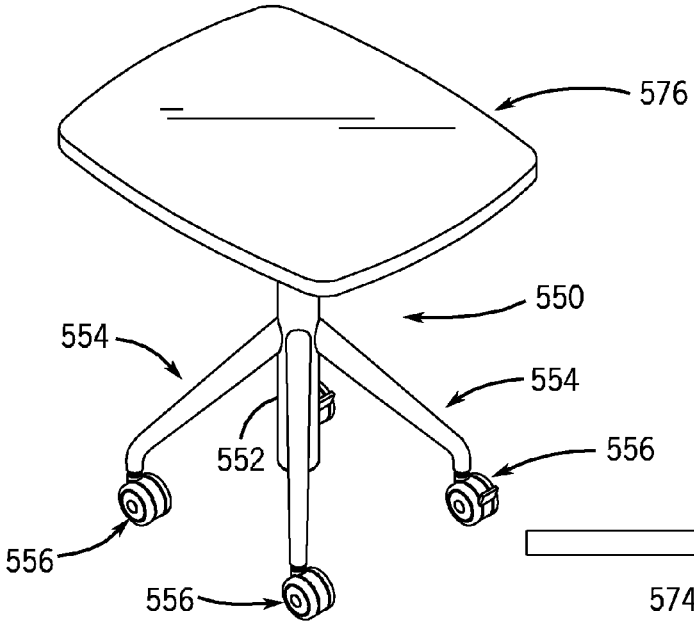
FIG. 66 is another embodiment of an adjustable height table similar to the table of FIG. 60.
Figure 67:
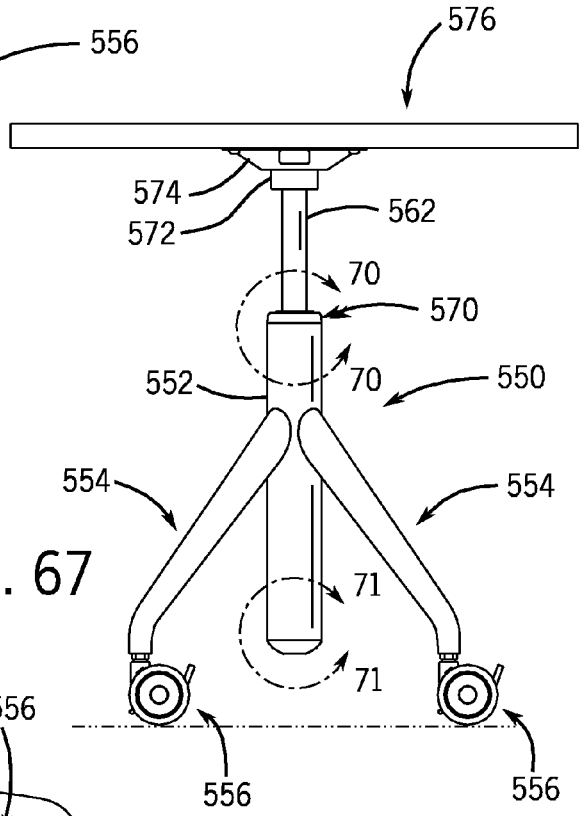
FIG. 67 is a side elevation view of the adjustable height table of FIG. 66.
Figure 68:
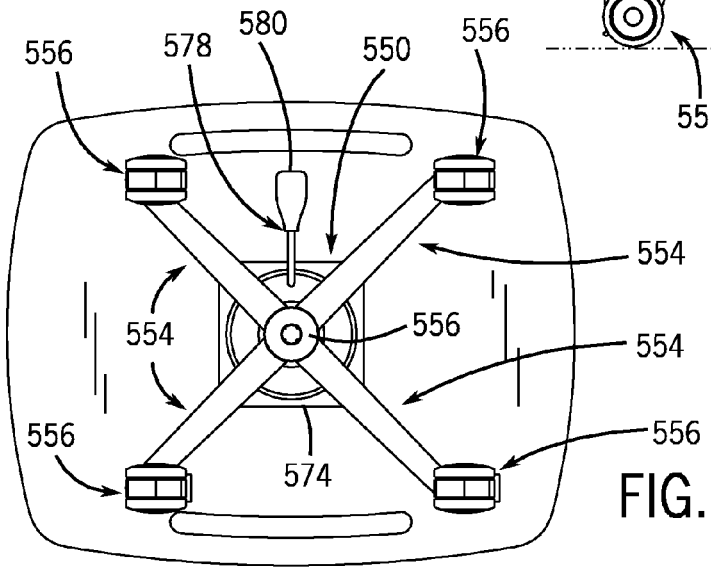
FIG. 68 is a bottom plan view of the table of FIGS. 66 and 67.

FIG. 64 illustrates another alternative table, shown at $T_6$, incorporating a generally trapezoidal table top 526 and a four-legged base assembly 440. Grooves 528 are formed in the underside of table top 526, adjacent opposite side edges of table top 526.

The various table top configurations as shown and described are representative of any number of table tops, having any desired shape, which can be supported using base assemblies 440. In addition, the pedestal-type table such as $T_4$, $T_5$ and $T_6$ may incorporate base assembly 440 as described previously, or the adjustable height base assembly described hereafter.

FIGS. 66-71 show a pneumatic adjustable height base assembly 550 which can be employed in place of manually adjustable base assembly 440 to support a worksurface. FIG. 69 illustrates the components of base assembly 550 in an exploded fashion, and FIGS. 66-68, 70 and 71 illustrate the assembled components of base assembly 550.

Base assembly 550 includes a cylindrical support tube 552 to which a series of legs 554 are mounted, in a manner similar to mounting of legs 444 to collar 442 in table base assembly 440. Legs 554 are similar in shape and provide the same function as legs 444, and caster assemblies 556 are mounted to the outer, lower ends of legs 554. Alternatively, glides may be employed in place of caster assemblies 556.

Support tube 552 is adapted to mount a pneumatic height adjustment cylinder assembly 558, which includes a cylinder body 560 and an extendible and retractable rod 562, in accordance with conventional construction. Cylinder assembly 558 is of the type commonly employed to adjust the height of a worksurface or seat, and includes a piston received within cylinder body 560 to which rod 562 is connected, and a spring which normally biases rod 562 to an extended position.

A lower cup or bushing 564 is adapted to be received within the upwardly open interior of support tube 552, and rests on a lower end wall 566 defined by support tube 552. Bushing 564 provides a snug fit of the lower end of cylinder body 560 within support tube 552. A screw 568 extends through an opening in end wall 566 and into a threaded passage associated with the lower end of cylinder body 560, for securely mounting cylinder assembly 558 to support tube 552.

An upper bushing 570 is engaged with the upper end of support tube 552 and with the upper end of cylinder body 560. Upper bushing 570 is in the form of a ring having a central opening through which cylinder rod 562 extends, and which conforms in shape to a shoulder defined by the upper end of cylinder body 560. Upper bushing 570 includes depending prongs 571 that are configured to wedge between the upper end of cylinder body 560 and the inner surface of support tube 552 to secure the upper end of cylinder body 560 in position within support tube 552.

Figure 73:
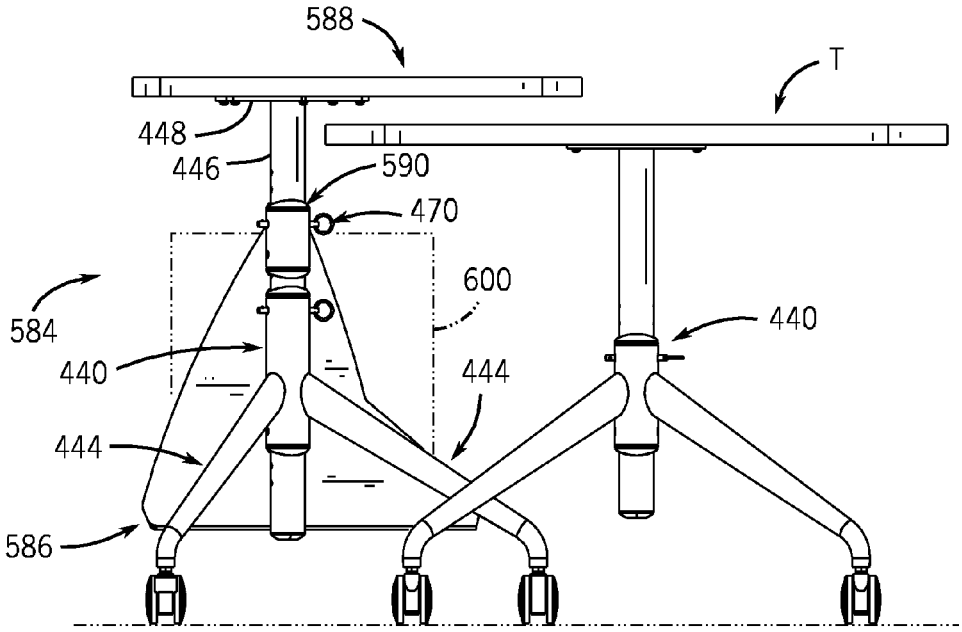
FIG. 73 is a side elevation view showing the computer stand of FIG. 72 in combination with an adjustable height table such as the table illustrated in FIG. 49.
Figure 72:
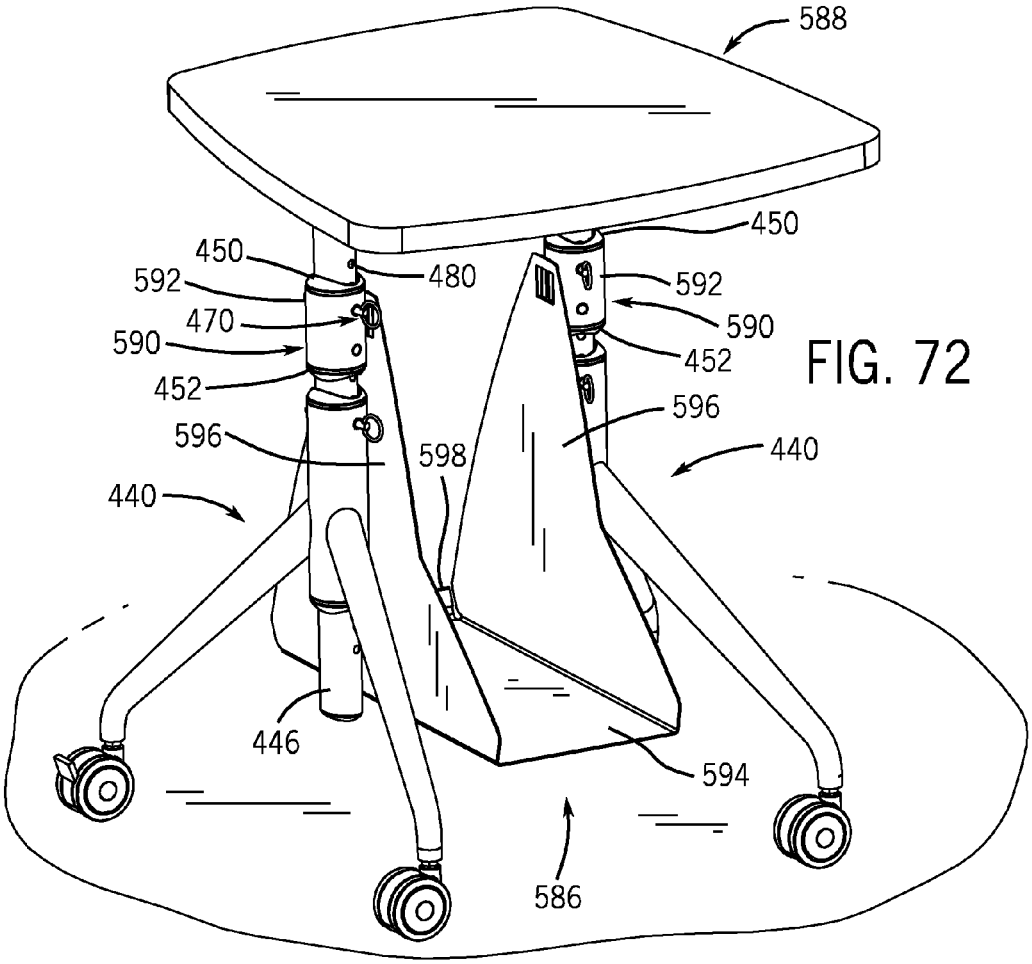
FIG. 72 is an isometric view of an adjustable height computer stand forming a part of the mobile furniture and accessory system of the present invention.
Figure 74:
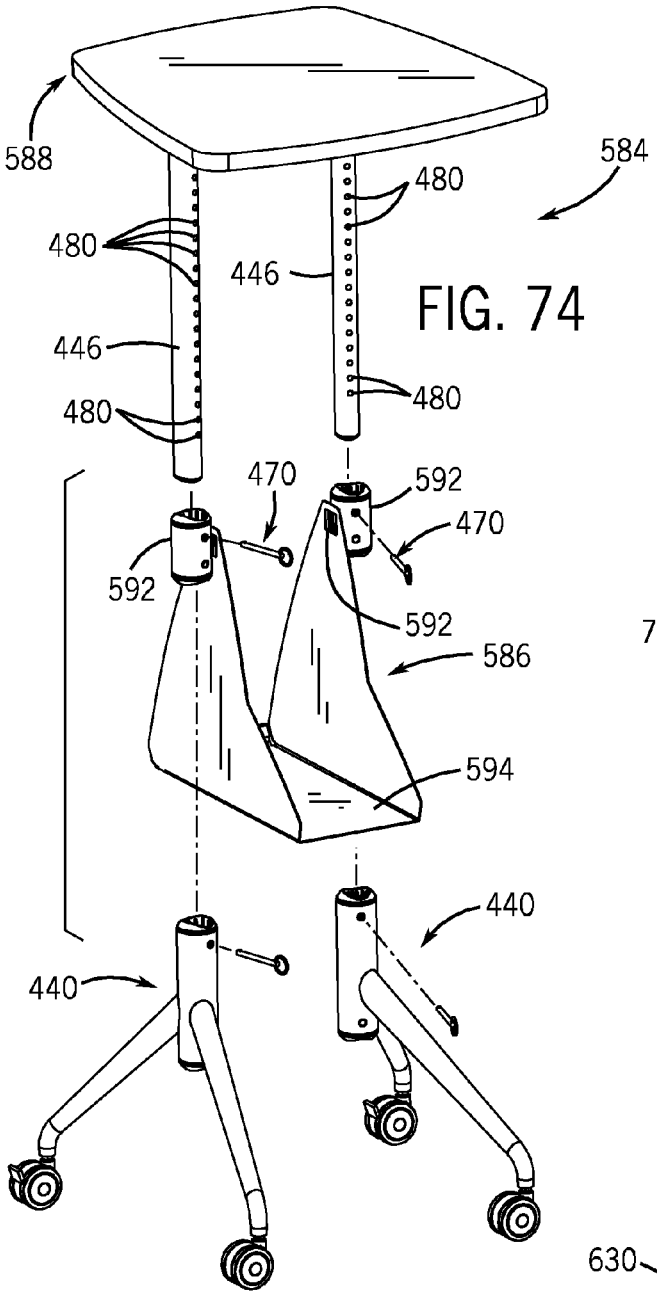
FIG. 74 is an exploded isometric view of the adjustable height computer stand of FIG. 72.

A bracket 572 is mounted to the upper end of cylinder rod 562, and is interconnected with a worksurface mounting plate 574 which is adapted to be connected to the underside of the worksurface, which is shown representatively at 576. An actuator lever 578 is pivotably mounted to bracket 572, and includes an outer engagement area 580 and an inner end which engages an actuator button at the upper end of cylinder rod 562, in a manner as is known. With this construction, lever 578 is operated so as to selectively allow a user to adjust the height of worksurface 576 by extending or retracting cylinder rod 562 by exerting an upward or downward force on worksurface 576. When lever 578 is released, engagement of the actuator button associated with cylinder rod 562 is relieved, such that the position of cylinder rod 562 relative to cylinder body 560 is locked to secure worksurface 576 in a desired vertical position FIGS. 72-74 illustrate a computer table assembly 584 which forms a part of the mobile furniture and accessory system of the present invention, and which is typically used in combination with a table T. Generally, computer table assembly 584 includes a pair of base assemblies 440 as shown and described with respect to FIGS. 49-52, in combination with a CPU support cradle 586 located between base assemblies 440, and a monitor supporting worksurface 588 connected to mounting plates 448 of base assemblies 440.

Each base 440 of computer table assembly 584 is constructed as described previously to support worksurface 588 above a supporting surface such as a floor in an adjustable height manner. Base 440 of table assembly 584 differs slightly from the construction as described previously, however, in that each column 446 has vertically spaced pairs of openings or apertures 480 in its walls substantially throughout its entire height.

CPU support cradle 586 is supported between table base assemblies 440 in a suspended manner by means of a pair of support sleeves 590, each of which is secured to one of columns 446. Each support sleeve 590 includes a tubular sleeve 592 having a top bushing 450 and a bottom bushing 452, mounted in the same manner as described previously with respect to mounting of top bushing 450 and bottom bushing 452 to collar 442. Support sleeve 590 further includes a removable pin 470 as described previously, such that support sleeves 590 can be manually adjusted to varying positions on columns 446 so as to adjust the height of CPU support cradle 586. Each support sleeve 592 further includes an inwardly facing hanger tab 592. CPU support cradle 586 includes a bottom support wall 594 and a pair of upstanding sidewalls 596. Each sidewall 596 has an opening within which support tab 592 is received, such that CPU support cradle 586 is suspended from support tabs 592 between base assemblies 440. Bottom wall 594 terminates in an upturned lip 598, which is configured to prevent a computer CPU, shown representatively at 600, from sliding off bottom wall 594.

It can thus be appreciated that computer table assembly 584 employs common components as table base assembly 440 to provide a computer support table, with the minor adaptation of providing columns 446 with openings throughout its entire length and the addition of CPU support cradle 586. The height of CPU support cradle 586 can be adjusted according to the height of CPU 600, and the overall height of monitor supporting worksurface 588 can be adjusted in the same manner as described previously with respect to table base assembly 440.

Furniture Glide

Figure 75:
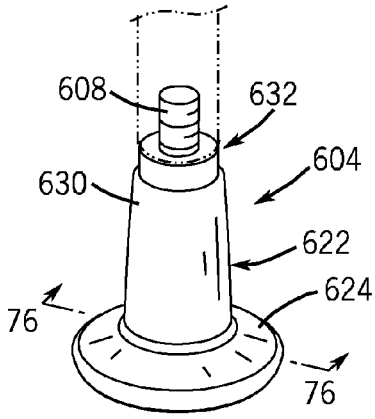
FIG. 75 is an isometric view of a glide adapted for use in supporting the components of the mobile furniture and accessory system of the present invention.
Figure 76:
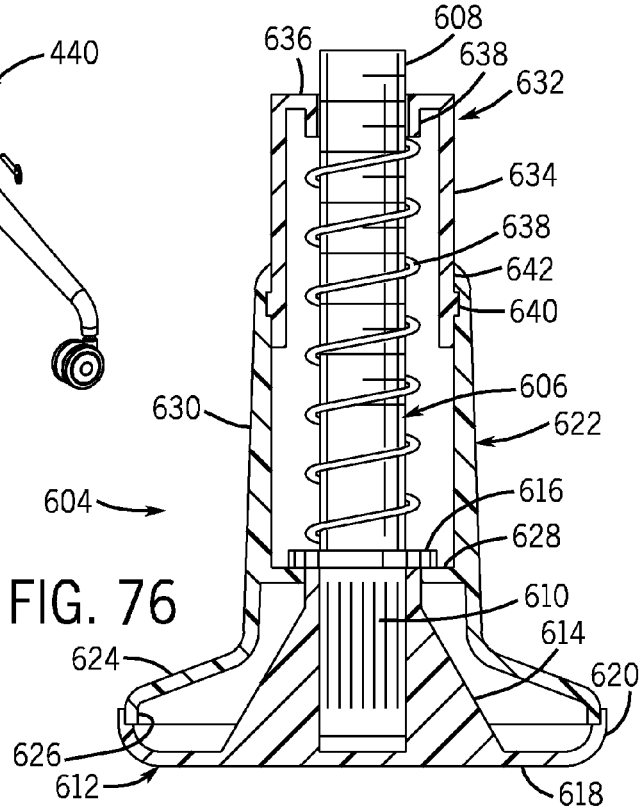
FIG. 76 is a section view taken along line 76-76 of FIG. 75.

FIGS. 75 and 76 illustrate a glide assembly 604 which can be employed in the various components of the mobile furniture and accessory system of the present invention, either in place of or in combination with the illustrated caster assemblies.

Glide assembly 604 includes a stem 606 having a threaded upper end 608 which is adapted to be threadedly engaged with a mounting insert or the like associated with the furniture component to which glide assembly 604 is adapted to be mounted. Stem 606 further includes an irregular lower end 610. A foot 612 is engaged with lower end 610. Foot 612 includes a stem mounting section 614 having an internal passage within which irregular lower end 610 of stem 606 is received, either in an insert molding operation or in a press-fit construction. Stem 606 includes a retainer disc 616 which engages an upper end defined by stem mounting section 614. Foot 612 further includes an annular outwardly extending engagement section 618 which terminates in an upturned flange or wall 620.

Glide assembly 604 further includes an intermediate riser member 622 which extends upwardly from foot 612. Riser member 622 has a lower annular wall 624 terminating in a lip 626 which engages wall 620 of foot 612 in a snap-fit manner. Riser member 622 further includes an inwardly extending ring 628 engaged by disc 616, which is operable to secure riser member 622 to foot 612 when stem 606 is engaged with stem mounting section 614. Riser member 622 further includes an outer wall 630 which extends upwardly from lower wall 624, and which defines a slight inward taper in an upward direction. Riser member 622 is open at its upper end, and a telescoping collar 632 extends from the upper end of riser member 622. Collar 632 defines an outer wall 634 and a top wall 636 having a central opening, through which threaded upper end 608 of stem 606 extends. A spring 638 beaus between disc 616 and a guide flange 638 extends inwardly from upper wall 636.

Collar 636 is vertically movable relative to riser member 622, and is outwardly biased by spring 638. The lower end of outer wall 634 is provided with a slight outward ring protrusion 640, and the upper end of riser outer wall 630 is provided with a slight inward protrusion 642, which provide a snap-type lock arrangement so as to maintain collar 632 in engagement with riser member 622.

In operation, glide assembly 604 is secured to an insert or other mounting structure associated with an item of furniture, by tuning threaded upper end 608 of stem 606 into engagement with the internal threads of the insert or other such mounting structure. On continued advancement of threaded upper end 608 in this manner, upper wall 636 of collar 632 engages the insert or other downwardly facing surface defined by the article of furniture to which glide assembly 604 is mounted, to fully conceal stem 606 between the glide mounting surface and the support surface such as a floor, with which foot 612 is engaged Stem 606 is turned so as to provide the desired amount of engagement of threaded upper end 608 within the insert. As advancement of stem 606 continues, collar 632 is retracted relative to riser member 622 against the force of spring 638, to reduce the overall height of glide assembly 604 defined between the lower end of foot 612 and upper wall 636. This functions to fully conceal stem 606. If it is desired to back stem 606 out of the threaded insert for any reason, such as when the article of furniture is moved or to level or otherwise adjust the elevation of the article of furniture, glide assembly 604 is turned so as to move foot 612 outwardly relative to the article of furniture. During such movement of glide assembly 604, collar 632 is extended under the influence of spring 638, to maintain upper wall 636 in engagement with the downwardly facing surface of the article of furniture from which glide assembly 604 extends.

Figure 77:
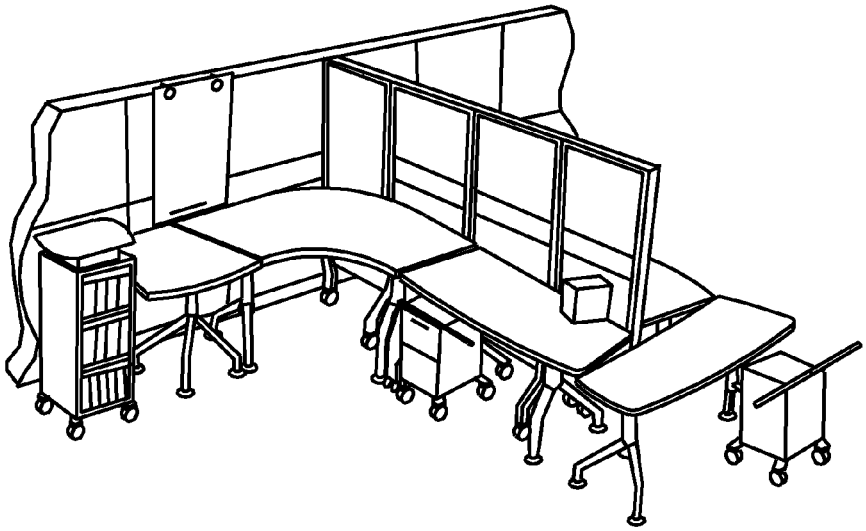
FIGS. 77-84 are isometric view illustrating representative environments which can be attained using the mobile furniture and accessory system of the present invention.
Figure 78:
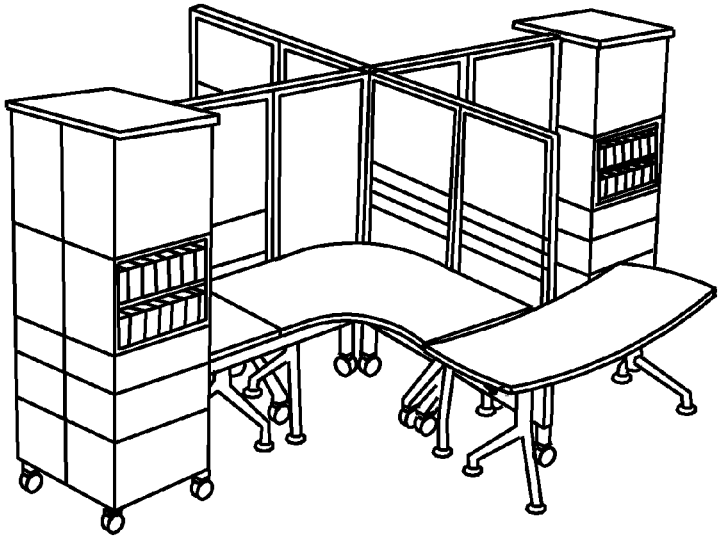
Figure 79:
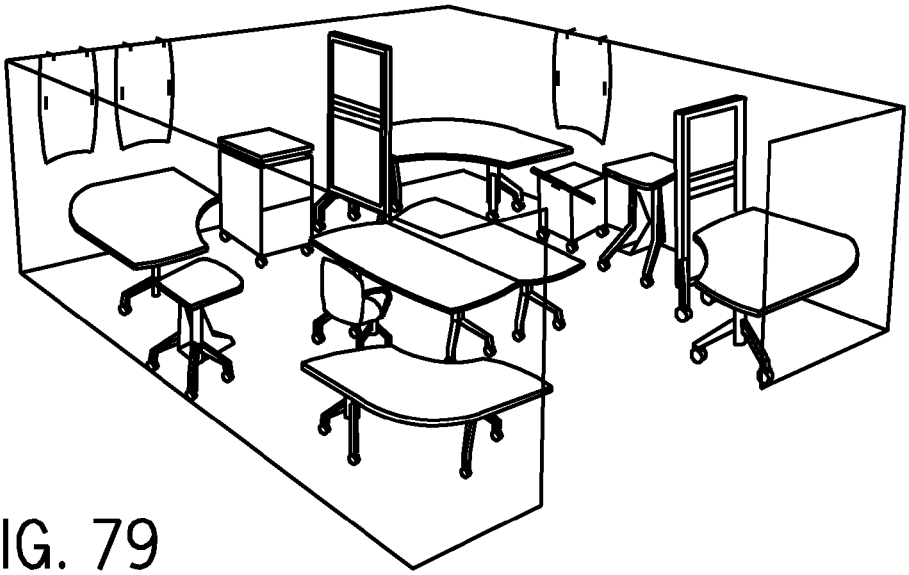
Figure 80:
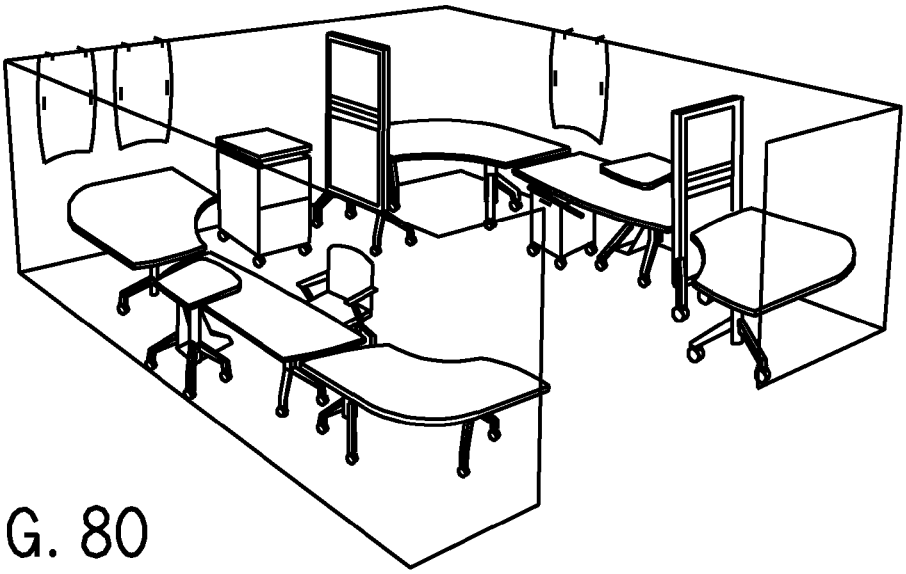
Figure 81:
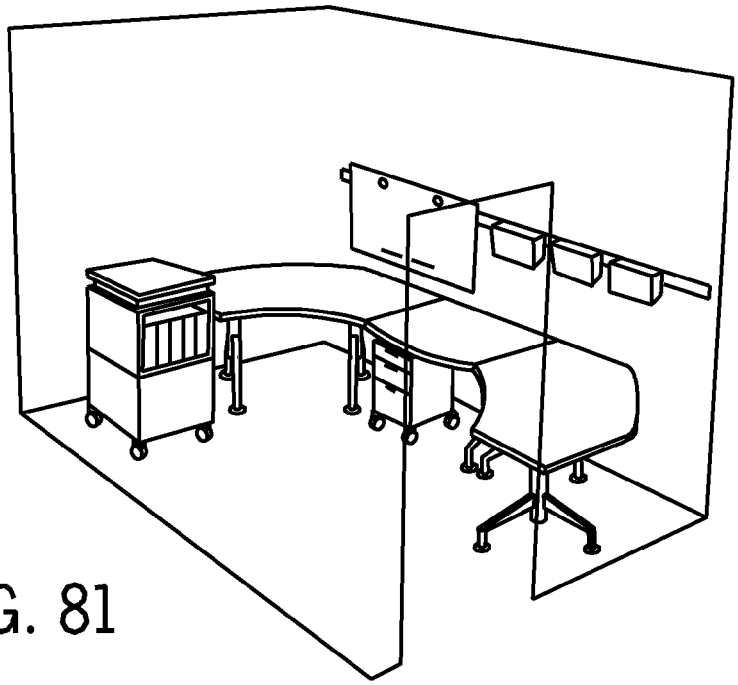
Figure 82:
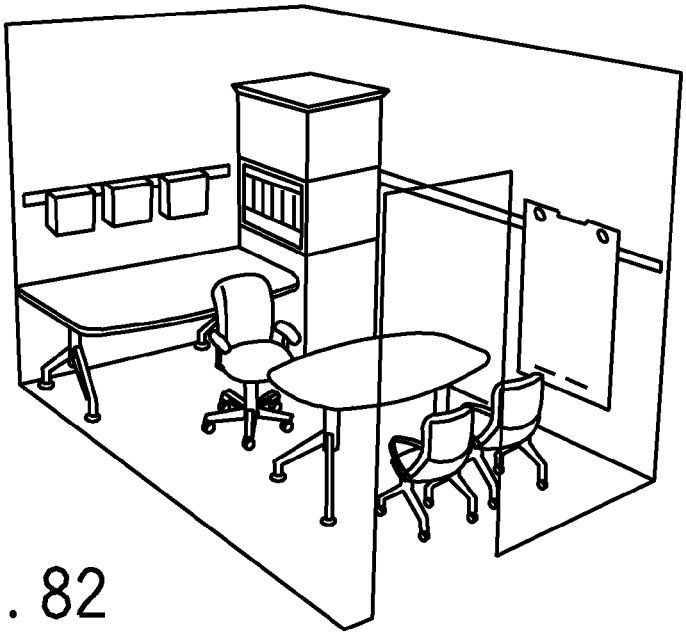
Figure 83:
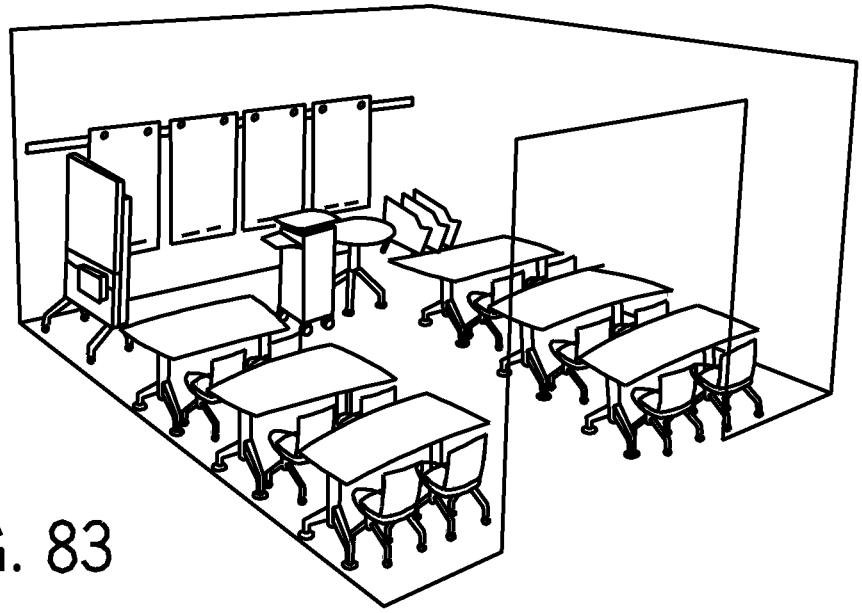
Figure 84:
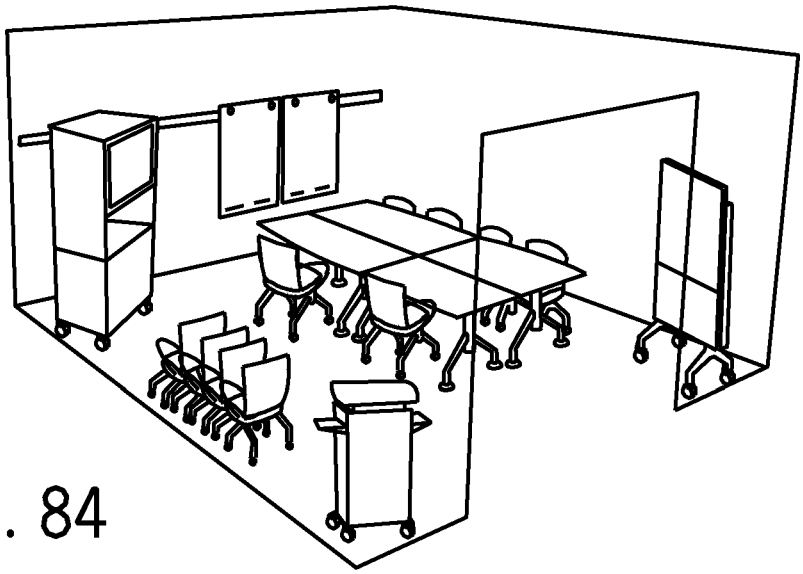

FIGS. 77-84 illustrate a variety of different applications for the modular mobile furniture and accessory system of the present invention. FIG. 77 includes tables, partitions and storage units used to create a work area in combination with a panel-type wall system FIG. 78 illustrates tables or desks in combination with storage units and screens or partitions for creating several different work areas in an open area. FIG. 79 shows the table or desk components as well as the storage, screen and marker board components in providing a team-type work environment within an enclosed space. FIG. 80 illustrates the reconfigurability of the components shown in FIG. 79, for altering the layout of the space. FIG. 81 illustrates the table or desk, storage, marker board and bin components in a private office environment, which is also illustrated in FIG. 82. FIGS. 83 and 84 illustrate a series of tables or desks which can be moved as required for use in either a training environment as shown in FIG. 83 or in a conference environment as shown in FIG. 84.

It can thus be appreciated that the components of the present invention greatly facilitate flexibility in an office environment, and can be custom-ordered to user specifications and arranged according to user requirements for optimizing workflow and efficiency.

Various alternatives and embodiments are contemplated as being within the scope of the following claims particularly pointing out and distinctly claiming the subject matter regarded as the invention.

We claim:

1. A marker board, comprising:

a marking member having a resilient core and a substantially flat marking surface shaped similar to and covering the core; and one or more cut out areas associated with the marking member, wherein the cut out area includes an opening formed in the resilient core and defining a resilient edge area, wherein the opening and the resilient edge area are configured to releasably engage one or more markers adapted to be used in marking on the marking surface inside a periphery of the marking member, the resiliency of the core allowing the edge area to flex outwardly as necessary enabling various shapes, numbers and orientations of the markers to be releasably retained within the opening formed in the core.

2. The marker board of claim 1, wherein the marking member includes recesses formed in the periphery of the marking member for retaining an eraser and hanging clips therein.

3. The marker board of claim 1, wherein the marking member includes a marking sheet that defines the flat marking surface, wherein the marking sheet overlies the core and includes an opening at each of the one or more cut out areas, wherein each opening in the marking sheet is configured to expose a portion of the core, and wherein the core at the cut out areas is resilient so as to define the resilient edge areas of the opening.

4. The marker board of claim 3, wherein each cut out area includes a main section and a pair of end sections, wherein the end sections extend outwardly in opposite directions from the main section.

5. The marker board of claim 1, further comprising a hanger arrangement for use in suspending the marking member from a support structure, wherein the hanger arrangement includes a base structure interconnected with an upper area defined by the marking member, and a movable hanger member interconnected with the base structure, wherein the hanger member is movable between an inoperative closed position in which the hanger member is engaged with the base member, and an operative open position in which the hanger member extends outwardly relative to the marking surface and is adapted to be engaged with a support surface for suspending the marking member from the support surface.

6. A marker board, comprising:

a marking member defining a marking surface; and a hanger arrangement for use in suspending the marking member from a support structure, wherein the hanger arrangement includes a base structure interconnected with an uppermost end of the marking member, and a movable hanger member interconnected with the base structure, wherein the hanger member is movable between an inoperative closed position in which the hanger member is held recessed and engaged within the base structure, and an operative open position in which the hanger member extends outwardly from within the base structure relative to the marking surface and is adapted to be engaged with a support surface for suspending the marking member from the support surface, the base structure being movable towards and away from the marking member and adapted to releasably retain a sheet member against the marking member, the base structure being movable by means of direct engagement therewith or engagement of the hanger member connected to the base structure.

7. The marker board of claim 6, wherein the base structure comprises a pair of base members that overlie opposite surfaces defined by the marking member and that are secured together with the marking member therebetween.

8. The marker board of claim 7, including a pair of movable hanger members, wherein each hanger member is movably mounted to one of the base members.

9. The marker board of claim 8, wherein each hanger member is pivotably mounted to one of the base members for movement between the operative and inoperative positions.

10. The marker board of claim 6, wherein the hanger member includes a protrusion that is configured for engagement with an upwardly facing area of a hanger bracket when the hanger member is in the inoperative position.

11. The marker board of claim 6, wherein the marking member includes one or more cut out areas, wherein each cut out area includes an opening bordered by a resilient edge area, wherein each opening in the resilient edge area is configured to releasably engage one or more markers adapted to be used in marking on the marking surface.

12. A marker board, comprising:

a marking member having a substantially flat marking surface; and one or more cut out areas associated with the marking member, wherein each cut out area includes an opening bordered by a resilient edge area, wherein the opening and the resilient edge area are configured to releasably engage one or more markers adapted to be used in marking on the marking surface, the resiliency of the edge area bordering the opening enabling various shapes, numbers and orientations of the markers to be releasably retained within the opening, wherein the marking member comprises a resilient core, and wherein the one or more cut out areas associated with the marking member comprise openings formed in the core, and wherein the marking member includes a marking sheet that defines the flat marking surface, wherein the marking sheet overlies the core and includes an opening at each of the one or more cut out areas, wherein each opening in the marking sheet is configured to expose a portion of the core, and wherein the core at the cut out areas is resilient so as to define the resilient edge areas of the opening.

13. The marker board of claim 12, wherein each cut out area includes a main section and a pair of end sections, wherein the end sections extend outwardly in opposite directions from the main section.

* * * * *